US011686063B2

(12) United States Patent
Daggett

(10) Patent No.: US 11,686,063 B2
(45) Date of Patent: Jun. 27, 2023

(54) INTERLOCKING BLOCKING SYSTEM FOR RETAINING WALLS AND OTHER USES

(71) Applicant: Robert Daggett, Denver, NC (US)

(72) Inventor: Robert Daggett, Denver, NC (US)

( * ) Notice: Subject to any disclaimer, the term of this patent is extended or adjusted under 35 U.S.C. 154(b) by 224 days.

(21) Appl. No.: 17/114,657

(22) Filed: Dec. 8, 2020

(65) Prior Publication Data

US 2021/0180283 A1 Jun. 17, 2021

Related U.S. Application Data

(60) Provisional application No. 62/947,016, filed on Dec. 12, 2019.

(51) Int. Cl.

| | |
|---|---|
| ***E04B 2/18*** | (2006.01) |
| ***E02D 29/02*** | (2006.01) |
| *E04B 2/02* | (2006.01) |

(52) U.S. Cl.

CPC ..... *E02D 29/025* (2013.01); *E02D 29/0266* (2013.01); *E04B 2/18* (2013.01); *E04B 2002/0206* (2013.01); *E04B 2002/0213* (2013.01)

(58) Field of Classification Search

CPC ..... E02D 29/025; E02D 29/0266; E04B 2/14; E04B 2/18; E04B 2/20; E04B 2002/0206; E04B 2002/0213

See application file for complete search history.

(56) References Cited

U.S. PATENT DOCUMENTS

| | | | | | |
|---|---|---|---|---|---|
| 800,385 | A * | 9/1905 | Miller | E04B 1/2403 | 52/289 |
| 1,552,077 | A * | 9/1925 | Palanti | E04B 2/18 | 52/286 |
| 2,131,803 | A * | 10/1938 | Henderson | E04B 2/14 | 52/437 |
| 2,640,348 | A | 6/1953 | Rigaumont | | |
| 2,826,906 | A * | 3/1958 | Rice | E04B 2/16 | 52/270 |
| 2,861,388 | A | 11/1958 | Gianni | | |
| 3,382,632 | A | 5/1968 | Grofcsik | | |
| 3,618,279 | A * | 11/1971 | Sease | E04B 2/46 | 52/439 |
| 4,124,961 | A | 11/1978 | Habegger | | |
| 5,484,235 | A * | 1/1996 | Hilfiker | E02D 17/205 | 405/262 |

(Continued)

*Primary Examiner* — Benjamin F Fiorello

(74) *Attorney, Agent, or Firm* — Jeffrey C. Watson; Grell & Watson Patent Attorneys LLC

(57) ABSTRACT

An interlocking blocking system includes a plurality of interlocking blocks. Each of the interlocking blocks includes a tapered opening, a protruding bottom, and a hollow tapered inside. The tapered opening is through a top surface of the interlocking block. The protruding bottom extends beyond a bottom surface of the interlocking block. The protruding bottom includes a tapered outer surface, a thickness, and an inner tapered surface. The hollow tapered inside extends from the tapered opening on the top surface and tapers into the inner tapered surface of the protruding bottom. The tapered outer surface of the protruding bottom is shaped and sized to match and fit inside of the tapered opening at the top surface of the interlocking block. Wherein the plurality of interlocking blocks are configured to be stacked onto one another.

19 Claims, 35 Drawing Sheets

(56) References Cited

U.S. PATENT DOCUMENTS 5,702,208 A * 12/1997 Hilfiker ..... E02D 17/205 405/20
5,775,047 A * 7/1998 Jensen ..... E04B 2/18 52/596
5,960,604 A 10/1999 Blanton
5,987,840 A 11/1999 Leppert
6,088,987 A * 7/2000 Simmons ..... E04B 2/14 52/592.4
6,105,330 A * 8/2000 Nanayakkara ..... E04B 2/14 52/592.6
6,161,357 A * 12/2000 Altemus ..... E04B 2/24 446/124
6,223,493 B1 5/2001 Ruggeri
6,233,897 B1 5/2001 Jurik
6,244,009 B1 6/2001 Cerrato
6,467,229 B2 10/2002 Azar
6,490,837 B1 12/2002 Dueck et al.
6,523,317 B1 2/2003 Bott et al.
6,550,208 B2 4/2003 Nanayakkara
6,571,525 B2 6/2003 Coleman
D479,000 S * 8/2003 van Oort ..... D25/113
6,641,452 B2 * 11/2003 Racine ..... A63H 33/088 446/124
6,651,401 B2 11/2003 Price et al.
6,665,994 B1 12/2003 Ruggeri
6,871,468 B2 3/2005 Whitson
7,207,146 B1 4/2007 Morrell
D679,416 S * 4/2013 Nanayakkara ..... D25/114
9,187,895 B2 11/2015 Rodriguez Carassus
9,938,713 B1 * 4/2018 Ertl ..... E04B 2/50
10,781,588 B1 * 9/2020 Nadeau ..... E04C 5/163
2002/0046529 A1 * 4/2002 Nanayakkara ..... E04B 2/14 52/592.6
2004/0221538 A1 * 11/2004 Thorpe ..... E04C 1/397 52/596
2006/0059824 A1 * 3/2006 Barbisch ..... E02D 29/025 52/503
2007/0107333 A1 * 5/2007 Marsh ..... E04B 2/16 52/223.7
2007/0186502 A1 * 8/2007 Marsh ..... E04B 2/16 52/604
2008/0134615 A1 * 6/2008 Risi ..... E02D 29/025 52/598
2008/0216436 A1 * 9/2008 Rodriguez ..... E04B 2/44 52/588.1
2008/0256894 A1 * 10/2008 Marsh ..... E02D 27/02 52/719
2014/0260029 A1 * 9/2014 Browning ..... E04B 1/78 52/564
2015/0159371 A1 * 6/2015 Rodriguez Carassus ..... E04B 2/44 52/204.2
2016/0130810 A1 5/2016 Radford
2018/0266105 A1 * 9/2018 Rodriguez Carassus ..... E04B 2/06
2019/0390452 A1 * 12/2019 Baker ..... E04B 1/043
2020/0385984 A1 * 12/2020 Raffion ..... E04C 1/40
2021/0207336 A1 * 7/2021 Castonguay ..... E04C 1/395
2022/0170264 A1 * 6/2022 Badin Cherit ..... E04C 5/065

* cited by examiner

INTERLOCKING BLOCKING SYSTEM FOR RETAINING WALLS AND OTHER USES

CROSS-REFERENCE TO RELATED APPLICATIONS

This application claims the priority benefit of U.S. Provisional Application No. 62/947,016, filed on Dec. 12, 2019, entitled "Interlocking Block System for Retaining Walls and Other Uses", which is incorporated by reference herein in its entirety.

FIELD OF THE DISCLOSURE

The present disclosure relates to retaining walls and other similar structures. Namely, the instant disclosure relates to an interlocking blocking system for retaining walls, the like, or other similar uses.

BACKGROUND

Generally speaking, a retaining wall is a relatively rigid wall used for supporting soil laterally so that it can be retained at different levels on the two sides. Retaining walls are structures designed to restrain soil to a slope that it would not naturally keep to (typically a steep, near-vertical or vertical slope). They are used to bound soils between two different elevations often in areas of terrain possessing undesirable slopes or in areas where the landscape needs to be shaped severely and engineered for more specific purposes like hillside farming or roadway overpasses. A retaining wall that retains soil on the backside and water on the front side is called a seawall or a bulkhead.

Retaining walls are typically erected out of a concrete masonry block. Concrete masonry blocks some of the most versatile building products available because of the wide variety of appearances that can be achieved using them. Concrete blocks are made from cast concrete (e.g. Portland cement and aggregate, usually sand and fine gravel, for high-density blocks). Lower density blocks may use industrial wastes, such as fly ash or bottom ash, as an aggregate. Recycled materials, such as post-consumer glass, slag cement, or recycled aggregate, are often used in the composition of the blocks. Use of recycled materials within blocks can create different appearances in the block, such as a terrazzo finish. Lightweight blocks can also be produced using autoclaved aerated concrete.

The use of concrete blocks allows structures to be built in the traditional masonry style with layers (or courses) of staggered blocks. Concrete blocks may be produced with hollow centers (cores) to reduce weight, improve insulation and provide an interconnected void into which concrete can be poured to solidify the entire wall after it's built. Blocks come in modular sizes, with the most popular typically referred to (by their thickness) as "4-inch", "6-inch", "8-inch", and "12-inch". Concrete block, when built with integral steel reinforcing or in tandem with concrete columns and tie beams and reinforced with rebar, is a very common building material for the load-bearing walls of buildings, in what is termed concrete block structure (CBS) construction. American suburban houses typically employ a concrete foundation and slab with a concrete block wall on the perimeter. Other common uses for concrete block walls are interior fire-rated partition walls, and exterior backup wall for attachment of building envelope systems and facades.

The instant disclosure recognizes the skill, time, difficulty, and expense required to erect concrete blocking structures. This includes not only the process required to align, mortar or connect the blocks together, but also the difficulty in moving each of the concrete blocks, the difficulty in connecting and reinforcing concrete block structures and/or the difficulty in sealing a concrete block structure. Thus, there is clearly a need to provide a blocking system that is easier and less expensive to install. In addition, the instant disclosure recognizes the limited shapes, sizes, and styles that typical concrete blocking is available in. Thus, there is clearly a need to provide more ornamental or decorative concrete blocking blocks and systems.

The instant disclosure may be designed to address at least certain aspects of the problems or needs discussed above by providing an interlocking blocking system for retaining walls, the like, or other uses.

SUMMARY

The present disclosure solves the aforementioned limitations of the currently available blocking systems and/or retaining walls by providing an interlocking blocking system for retaining walls, the like, or other uses. The interlocking blocking system may generally include a plurality of interlocking blocks. Each of the interlocking blocks may include a tapered opening, a protruding bottom, and a hollow tapered inside. The tapered opening may be through a top surface of the interlocking block. The protruding bottom may extend beyond a bottom surface of the interlocking block. The protruding bottom may include a tapered outer surface, a thickness, and an inner tapered surface. The hollow tapered inside may extend from the tapered opening on the top surface and may taper into the inner tapered surface of the protruding bottom. The tapered outer surface of the protruding bottom may be shaped and sized to match and fit inside of the tapered opening at the top surface of the interlocking block. Wherein the plurality of interlocking blocks may be configured to be stacked onto one another, where the protruding bottom of a top block may be inserted into the tapered opening of a bottom block, whereby the top block is interlocked to the bottom block.

One feature of the disclosed interlocking blocking system may be that it can be configured for a retaining wall.

Another feature of the disclosed interlocking blocking system may be that the interlocking blocks may be configured to interlock without mortar using their matching tapers thereby reducing a time and skill level necessary to install the retaining wall.

Another feature of the disclosed interlocking blocking system may be that the hollow tapered inside of each of the plurality of interlocking blocks may be configured as forms for additional concrete of other material.

Another feature of the disclosed interlocking blocking system may be that the hollow tapered inside of each of the plurality of interlocking blocks may be configured to allow for easy handling and tying of structure together without mortar.

Another feature of the disclosed interlocking blocking system may be that the interlocking blocking system may be configured with a minimal amount of concrete to reduce manufacture cost, weight, and shipping costs.

Another feature of the disclosed interlocking blocking system may be that the interlocking blocking system may be configured with the ability to easily be handled by light equipment since a significant portion of each of the interlocking blocks is the hollow tapered inside.

Another feature of the disclosed interlocking blocking system may be that the interlocking blocking system may be configured with a modular design that can be configured to allow for multiple configurations with a minimum number of different pieces.

Another feature of the disclosed interlocking blocking system may be that the interlocking blocking system can be configured with the ability to build either structures that allow water to flow thru them or ones that are a barrier to water.

Another feature of the disclosed interlocking blocking system may be that the disclosed interlocking blocking system can be configured to use the hollow tapered inside of each interlocking block as a form for additional reinforcement or for adding concrete once the structure is in place.

In select embodiments of the disclosed interlocking blocking system a cap or plurality of caps may be included. The cap may be configured to interlock and cover the top surface of one of the interlocking blocks. The cap may include a flat top face and a bottom face. The bottom face may include a tapered protrusion. The tapered protrusion may be shaped and sized to match and fit inside of the tapered opening at the top surface of one of the interlocking blocks.

In select embodiments of the disclosed interlocking blocking system, each of the plurality of interlocking blocks may include decorative face inserts. The decorative face inserts may be on at least a front side, a left side, a right side, or a combination thereof. The decorative face inserts may be configured to provide for texture or patterning of any visible block faces.

In select embodiments of the disclosed interlocking blocking system, a sealing system may be included. The sealing system may be for creating a sealed structure or wall. The sealing system may include a front groove and/or a back groove. The front groove may be around the periphery of each of the interlocking blocks approximate a front. The back groove may be around the periphery of each of the interlocking blocks approximate a back. An expanding material may be included with the sealing system. The expanding material may be inserted into the front groove and/or the back groove. The expanding material may be configured for sealing the plurality of interlocking blocks with one another via the front groove, the back groove, or the combinations thereof. In select embodiments, the expanding material may be an expanding foam.

In select embodiments of the disclosed interlocking blocking system, a tie down system may be included. The tie down system may be for tying down a top block to a bottom block or for tensioning the top block onto the bottom block. The tie down system may be configured for securely tying down the top block to the bottom block. In select embodiments, the tie down system may include a first indentation and a second indentation. The first indentation may be on a first side of the hollow tapered inside extending down from the tapered opening at the top surface. The second indentation may be on an opposing second side of the hollow tapered inside extending down from the tapered opening at the top surface matching the first indentation. A tie down rod may extend from a first bracket positioned below the bottom surface of the bottom block through the tapered hollow interior of the bottom block up the tapered hollow interior of the top block to a second bracket positioned in between the first indentation and the second indentation. In select embodiments, the tie down rod may be configured to be tightened thereby putting tension between the top block and the bottom block.

Another feature of the disclosed interlocking blocking system may be that, for blocks with multiple hollow tapered insides, the first indentation on the first side of a first hollow tapered inside, and the second indentation on the second side of an adjacent second hollow tapered inside, may create a non-tapered or flat surface between the adjacent hollow tapered insides. This non-tapered or flat surface between adjacent hollow tapered insides may provide for a gripping surface for lifting, moving and/or manipulating such blocks with multiple hollow tapered insides.

In select embodiments of the disclosed interlocking blocking system a plurality of square blocks may be included. Each of the square blocks may include a square tapered opening, a square protruding bottom, and a square hollow tapered inside. The square tapered opening may be through the top surface of the square block. The square protruding bottom may extend beyond the bottom surface of the square block. The square protruding bottom may include a square tapered outer surface, the thickness, and a square inner tapered surface. The square hollow tapered inside may extend from the square tapered opening on the top surface and may taper into the square inner tapered surface of the square protruding bottom. The square tapered outer surface of the square protruding bottom may be shaped and sized to match and fit inside of the square tapered opening at the top surface of the square block.

In select embodiments of the disclosed interlocking blocking system a plurality of rounded blocks may be included. Each of the rounded blocks may include a rounded tapered opening, a rounded protruding bottom, and a rounded hollow tapered inside. The rounded tapered opening may be through the top surface of the rounded block. The rounded protruding bottom may extend beyond the bottom surface of the rounded block. The rounded protruding bottom may include a rounded tapered outer surface, the thickness, and a rounded inner tapered surface. The rounded hollow tapered inside may extend from the rounded tapered opening on the top surface and may taper into the rounded inner tapered surface of the rounded protruding bottom. The rounded tapered outer surface of the rounded protruding bottom may be shaped and sized to match and fit inside of the rounded tapered opening at the top surface of the rounded block.

In select embodiments of the disclosed interlocking blocking system a plurality of adaptor blocks may be included. Each of the adaptor blocks may include a square tapered opening, a rounded tapered opening, a square protruding bottom, a rounded protruding bottom, a square rounded hollow tapered inside, and a rounded hollow tapered inside. The square tapered opening may be through the top surface of the adaptor block. The rounded tapered opening may be through the top surface of the adaptor block. The square protruding bottom may extend beyond the bottom surface of the adaptor block. The square protruding bottom may include the square tapered outer surface, the thickness, and the square inner tapered surface. The rounded protruding bottom may extend beyond the bottom surface of the adaptor block. The rounded protruding bottom may include the rounded tapered outer surface, the thickness, and the rounded inner tapered surface. The square hollow tapered inside may extend from the square tapered opening on the top surface and may taper into the square inner tapered surface of the square protruding bottom, where the square tapered outer surface of the square protruding bottom is shaped and sized to match and fit inside of the square tapered opening at the top surface of the adaptor block. The rounded hollow tapered inside may extend from the rounded tapered opening on the top surface and may taper into the rounded inner tapered surface of the rounded protruding bottom, where the rounded tapered outer surface of the rounded protruding bottom is shaped and sized to match and fit inside of the rounded tapered opening at the top surface of the adaptor block.

One feature of the disclosed interlocking blocking system may be that the included rounded blocks and/or adaptor blocks can be configured for non-right angles and radiuses. As such, these rounded blocks and/or adaptor blocks may be configured to allow blocks to be positioned together at various angles without the need to cut or manipulate any blocks.

In select embodiments of the disclosed interlocking blocking system plurality of square 1×1 blocks may be included. Each of the square 1×1 blocks may include the square tapered opening, the square protruding bottom, and the square hollow tapered inside. The square tapered opening may be through the top surface of the square 1×1 block. The square protruding bottom may extend beyond the bottom surface of the square 1×1 block. The square protruding bottom may include a square tapered outer surface, the thickness, and a square inner tapered surface. The square hollow tapered inside may extend from the square tapered opening on the top surface and may taper into the square inner tapered surface of the square protruding bottom. The square tapered outer surface of the square protruding bottom may be shaped and sized to match and fit inside of the square tapered opening at the top surface of the square 1×1 block.

In select embodiments of the disclosed interlocking blocking system plurality of square 2×1 blocks may be included. Each of the square 2×1 blocks may include two square tapered openings, two square protruding bottoms, and two square hollow tapered insides. The two square tapered openings may be through the top surface of the square 2×1 block. The two square protruding bottoms may extend beyond the bottom surface of the square 2×1 block. Each of the two square protruding bottoms may include a square tapered outer surface, the thickness, and a square inner tapered surface. Each of the two square hollow tapered insides may extend from one of the square tapered openings on the top surface and taper into one of the square inner tapered surfaces of one of the square protruding bottoms. Each of the square tapered outer surfaces of the two square protruding bottoms may be shaped and sized to match and fit inside of one of the square tapered openings at the top surface of the square 2×1 block.

In select embodiments of the disclosed interlocking blocking system plurality of square 2×2 blocks may be included. Each of the square 2×2 blocks may include four square tapered openings, four square protruding bottoms, and four square hollow tapered insides The four square tapered openings may be through the top surface of the square 2×2 block. The four square protruding bottoms may extend beyond the bottom surface of the square 2×2 block. Each of the four square protruding bottoms may include a square tapered outer surface, the thickness, and a square inner tapered surface. Each of the four square hollow tapered insides may extend from one of the square tapered openings on the top surface and taper into one of the square inner tapered surfaces of one of the square protruding bottoms. Each of the square tapered outer surfaces of the four square protruding bottoms may be shaped and sized to match and fit inside of one of the square tapered openings at the top surface of the square 2×2 block.

In select embodiments of the disclosed interlocking blocking system plurality of square L-blocks may be included. Each of the square L-blocks may include three square tapered openings in an L-formation, three square protruding bottoms in the L-formation, and three square hollow tapered insides in the L-formation. The three square tapered openings may be through the top surface of the square L-block. The three square protruding bottoms may extend beyond the bottom surface of the square L-block. Each of the three square protruding bottoms may include a square tapered outer surface, the thickness, and a square inner tapered surface. Each of the three square hollow tapered insides may extend from one of the square tapered openings on the top surface and taper into one of the square inner tapered surfaces of one of the square protruding bottoms. Each of the square tapered outer surfaces of the three square protruding bottoms may be shaped and sized to match and fit inside of one of the square tapered openings at the top surface of the square L-block.

In select embodiments of the disclosed interlocking blocking system plurality of square T-blocks may be included. Each of the square T-blocks may include three square tapered openings in a T-formation, three square protruding bottoms in the T-formation, and three square hollow tapered insides in the T-formation. The three square tapered openings may be through the top surface of the square T-block. The three square protruding bottoms may extend beyond the bottom surface of the square T-block. Each of the three square protruding bottoms may include a square tapered outer surface, the thickness, and a square inner tapered surface. Each of the three square hollow tapered insides may extend from one of the square tapered openings on the top surface and taper into one of the square inner tapered surfaces of one of the square protruding bottoms. Each of the square tapered outer surfaces of the three square protruding bottoms may be shaped and sized to match and fit inside of one of the square tapered openings at the top surface of the square T-block.

In select embodiments of the disclosed interlocking blocking system plurality of rounded 1×1 blocks may be included. Each of the rounded 1×1 blocks may include the rounded tapered opening, the rounded protruding bottom, and the rounded hollow tapered inside. The rounded tapered opening may be through the top surface of the rounded 1×1 block. The rounded protruding bottom may extend beyond the bottom surface of the rounded 1×1 block. The rounded protruding bottom may include a rounded tapered outer surface, the thickness, and a rounded inner tapered surface. The rounded hollow tapered inside may extend from the rounded tapered opening on the top surface and may taper into the rounded inner tapered surface of the rounded protruding bottom. The rounded tapered outer surface of the rounded protruding bottom may be shaped and sized to match and fit inside of the rounded tapered opening at the top surface of the rounded 1×1 block.

In select embodiments of the disclosed interlocking blocking system plurality of rounded 2×1 blocks may be included. Each of the rounded 2×1 blocks may include two rounded tapered openings, two rounded protruding bottoms, and two rounded hollow tapered insides. The two rounded tapered openings may be through the top surface of the rounded 2×1 block. The two rounded protruding bottoms may extend beyond the bottom surface of the rounded 2×1 block. Each of the two rounded protruding bottoms may include a rounded tapered outer surface, the thickness, and a rounded inner tapered surface. Each of the two rounded hollow tapered insides may extend from one of the rounded tapered openings on the top surface and taper into one of the rounded inner tapered surfaces of one of the rounded protruding bottoms. Each of the rounded tapered outer surfaces of the two rounded protruding bottoms may be shaped and sized to match and fit inside of one of the rounded tapered openings at the top surface of the rounded 2×1 block.

In select embodiments of the disclosed interlocking blocking system plurality of rounded 2×1 caps may be included. Each of the rounded 2×1 caps may be configured to interlock and cover the top surface of one of the rounded 2×1 blocks. Each of the 2×1 rounded caps may include a flat top face and a bottom face. The bottom face may include two rounded tapered protrusions. Each of the rounded tapered protrusions may be shaped and sized to match and fit inside of one of the rounded tapered openings at the top surface of one of the rounded 2×1 blocks.

In select embodiments of the disclosed interlocking blocking system plurality of rounded T-blocks may be included. Each of the rounded T-blocks may include three rounded tapered openings in a T-formation, three rounded protruding bottoms in the T-formation, and three rounded hollow tapered insides in the T-formation. The three rounded tapered openings may be through the top surface of the rounded T-block. The three rounded protruding bottoms may extend beyond the bottom surface of the rounded T-block. Each of the three rounded protruding bottoms may include a rounded tapered outer surface, the thickness, and a rounded inner tapered surface. Each of the three rounded hollow tapered insides may extend from one of the rounded tapered openings on the top surface and taper into one of the rounded inner tapered surfaces of one of the rounded protruding bottoms. Each of the rounded tapered outer surfaces of the three rounded protruding bottoms may be shaped and sized to match and fit inside of one of the rounded tapered openings at the top surface of the rounded T-block.

In select embodiments of the disclosed interlocking blocking system plurality of rounded T-caps may be included. Each of the rounded T-caps may be configured to interlock and cover the top surface of one of the rounded T-blocks. Each of the rounded T-caps may include a flat top face and a bottom face. The bottom face may include three rounded tapered protrusions in the T-formation. Each of the rounded tapered protrusions may be shaped and sized to match and fit inside of one of the rounded tapered openings at the top surface of one of the rounded T-blocks.

In another aspect, the instant disclosure embraces a retaining wall. The retaining wall disclosed herein may generally include the interlocking blocking system in any of the various embodiments and/or combination of embodiments shown and/or described herein. As such, the disclosed retaining wall may include a plurality of the interlocking blocks in any of the various embodiments and/or combination of embodiments shown and/or described herein. Each of the interlocking blocks used in the disclosed retaining wall may include a tapered opening, a protruding bottom, and a hollow tapered inside. The tapered opening may be through a top surface of the interlocking block. The protruding bottom may extend beyond a bottom surface of the interlocking block. The protruding bottom may include a tapered outer surface, a thickness, and an inner tapered surface. The hollow tapered inside may extend from the tapered opening on the top surface and may taper into the inner tapered surface of the protruding bottom. The tapered outer surface of the protruding bottom may be shaped and sized to match and fit inside of the tapered opening at the top surface of the interlocking block. Wherein the plurality of interlocking blocks may be configured to be stacked onto one another, where the protruding bottom of a top block may be inserted into the tapered opening of a bottom block, whereby the top block is interlocked to the bottom block.

One feature of the disclosed retaining wall may be that the interlocking blocks may be configured to interlock without mortar using their matching tapers thereby reducing a time and skill level necessary to install the retaining wall.

Another feature of the disclosed retaining wall may be that the hollow tapered inside of each of the plurality of interlocking blocks may be configured as forms for additional concrete of other material.

Another feature of the disclosed retaining wall may be that the hollow tapered inside of each of the plurality of interlocking blocks may be configured to allow for easy handling and tying of structure together without mortar.

Another feature of the disclosed retaining wall may be that the interlocking blocking system may be configured with a minimal amount of concrete to reduce manufacture cost, weight, and shipping costs.

Another feature of the disclosed retaining wall may be that the interlocking blocking system may be configured with the ability to easily be handled by light equipment since a significant portion of each of the interlocking blocks is the hollow tapered inside.

Another feature of the disclosed retaining wall may be that the interlocking blocking system may be configured with a modular design that can be configured to allow for multiple configurations with a minimum number of different pieces.

Another feature of the disclosed retaining wall may be that the interlocking blocking system can be configured with the ability to build walls that allow water to flow thru them or ones that are a barrier to water.

Another feature of the disclosed retaining wall may be that the disclosed interlocking blocking system can be configured to use the hollow tapered inside of each interlocking block as a form for additional reinforcement or for adding concrete once the structure is in place.

In select embodiments of the disclosed retaining wall a cap or plurality of caps may be included. Each of the caps may be configured to interlock and cover the top surface of one of the interlocking blocks. The cap may include a flat top face and a bottom face. The bottom face may include a tapered protrusion. The tapered protrusion may be shaped and sized to match and fit inside of the tapered opening at the top surface of one of the interlocking blocks.

In select embodiments of the disclosed retaining wall, each of the plurality of interlocking blocks may include decorative face inserts. The decorative face inserts may be on at least a front side, a left side, a right side, or a combination thereof. The decorative face inserts may be configured to provide for texture or patterning of any visible block faces of the retaining wall.

In select embodiments of the disclosed retaining wall, a sealing system may be included. The sealing system may be for creating a sealed wall. The sealing system may include a front groove and/or a back groove. The front groove may be around the periphery of each of the interlocking blocks approximate a front. The back groove may be around the periphery of each of the interlocking blocks approximate a back. An expanding material may be included with the sealing system. The expanding material may be inserted into the front groove and/or the back groove. The expanding material may be configured for sealing the plurality of interlocking blocks with one another via the front groove, the back groove, or the combinations thereof. In select embodiments, the expanding material may be an expanding foam.

In select embodiments of the disclosed retaining wall, a tie down system may be included. The tie down system may be for tying down a top block to a bottom block or for tensioning the top block onto the bottom block. The tie down system may be configured for securely tying down the top block to the bottom block. In select embodiments, the tie down system may include a first indentation and a second indentation. The first indentation may be on a first side of the hollow tapered inside extending down from the tapered opening at the top surface. The second indentation may be on an opposing second side of the hollow tapered inside extending down from the tapered opening at the top surface matching the first indentation. A tie down rod may extend from a first bracket positioned below the bottom surface of the bottom block through the tapered hollow interior of the bottom block up the tapered hollow interior of the top block to a second bracket positioned in between the first indentation and the second indentation. In select embodiments, the tie down rod may be configured to be tightened thereby putting tension between the top block and the bottom block.

In select embodiments of the disclosed retaining wall, the plurality of interlocking blocks may include a plurality of square blocks, a plurality of rounded blocks, a plurality of adaptor blocks, or a combination thereof.

The terminology used herein is for the purpose of describing particular embodiments only and is not intended to limiting of the disclosure. As used herein, the term "and/or" includes any and all combinations of one or more of the associated listed items. As used herein, the singular forms "a", "an" and "the" are intended to include the plural forms as well as the singular forms, unless the contest clearly indicates otherwise. It will be further understood that the terms "compromises" and/or "comprising" when used in this specification, specify the presence of stated features, steps, operations, elements and/or components, but do not preclude the presence of addition of one or more other features, steps, operations, elements, components and/or groups thereof.

Unless otherwise defined, all terms (including technical and scientific terms) used herein have the same meaning as commonly understood by one having ordinary skill in the art to which this disclosure belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the disclosure, it will be understood that a number of thermal enhancements are disclosed. Each of these has individual benefit, and each can also be used in conjunction with one or more, or in some cases all, of the other disclosed techniques. Accordingly, for the sake of clarity, the description will refrain from repeating every possible combination of the individual steps in an unnecessary fashion. Nevertheless, the specification and claims should be read with the understanding that such combinations are entirely within the scope of the intervention and the claims.

It will be evident, however, to one skilled in the art that the present disclosure may be practiced without specific details.

The present disclosure is to be considered as an exemplification of the disclosure, and is not intended to limit the disclosure to the specific embodiments illustrated by the figures or description below.

The present disclosure will not be described by referencing the appended figures representing preferred embodiments.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are with the spirit and scope of the present disclosure, are contemplated thereby, and are intended to be covered by the following general description.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Figure 58:
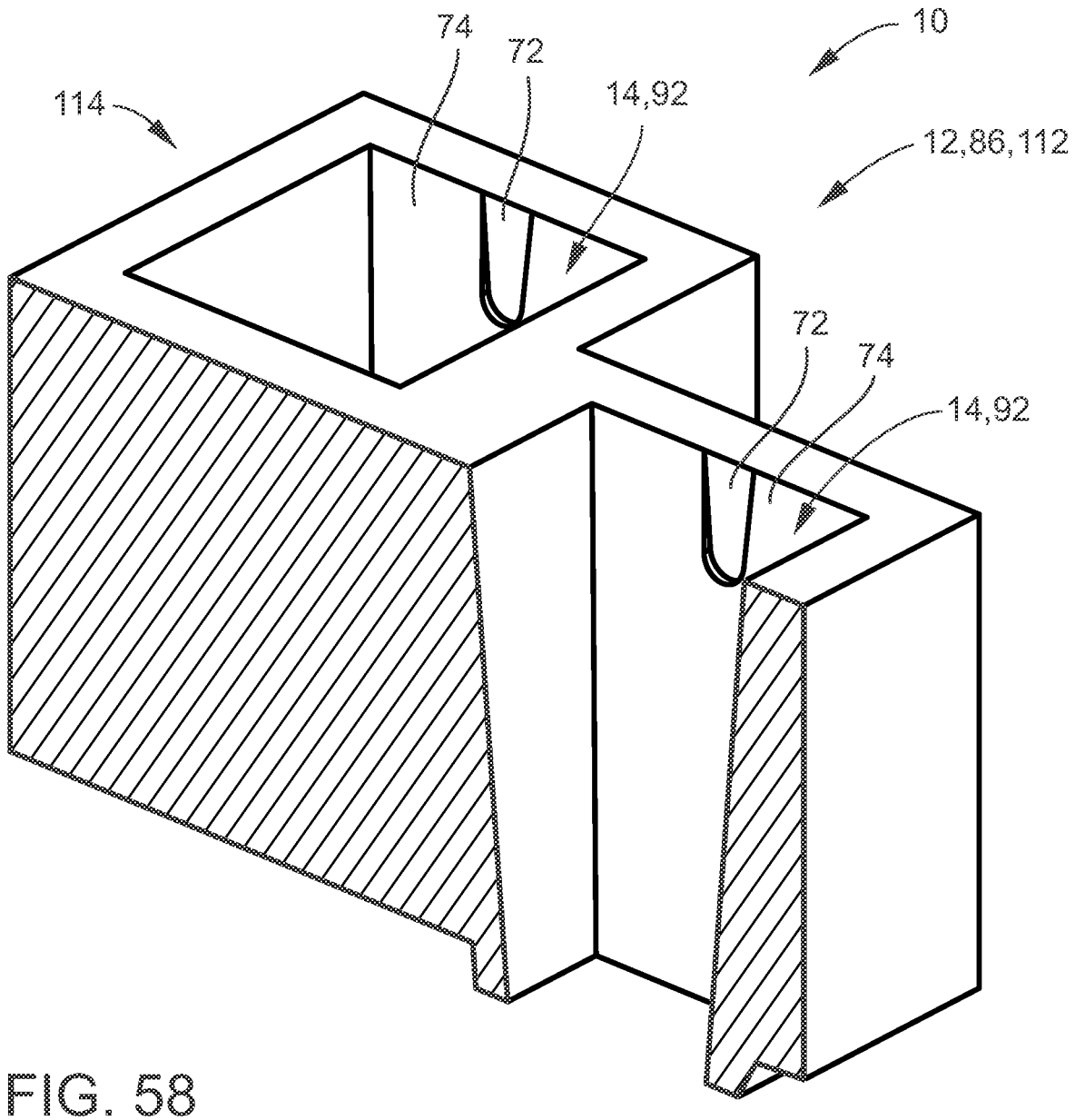
FIG. 58 is a cross-sectional top perspective view of the square T-block from FIG. 56.

Referring now to FIG. 58, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples. The present disclosure may solve the aforementioned limitations of the currently available devices and methods of blocks, interlocking blocks, retaining walls, the like, etc. or other uses by providing interlocking blocking system 10. Interlocking blocking system 10 may be used for creating any type of structure, including, but not limited to retaining walls 34, as shown in the Figures. However, the disclosure is not so limited, and interlocking blocking system 10 may be used and designed for other structures or uses, including, but not limited to, buildings, walls, bridges, the like, etc.

The present disclosure solves the aforementioned limitations of the currently available blocking systems and/or retaining walls by providing an interlocking blocking system 10 for retaining walls 34, structures, the like, or other uses. Interlocking blocking system 10 may generally include a plurality of interlocking blocks 12. Each of the interlocking blocks 12 may include tapered opening 14, protruding bottom 18, and hollow tapered inside 28. Tapered opening 14 may be through top surface 16 of interlocking block 12. Protruding bottom 18 may extend beyond bottom surface 20 of interlocking block 12. Protruding bottom 18 may include tapered outer surface 22, thickness 24, and inner tapered surface 26. Hollow tapered inside 28 may extend from tapered opening 14 on top surface 16 and may taper into inner tapered surface 26 of protruding bottom 18. Tapered outer surface 22 of protruding bottom 18 may be shaped and sized to match and fit inside of tapered opening 14 at top surface 16 of interlocking block 12. Wherein the plurality of interlocking blocks 12 may be configured to be stacked onto one another, where the protruding bottom 18 of top block 30 may be inserted into tapered opening 14 of bottom block 32, whereby top block 30 is interlocked to bottom block 32.

As shown in FIGS. 3, 4, 5, 8, 9, 10, 13, 14, 15, 18, 19, 20, 23, 24, 25, 30, 31, 32, 37, 38, 39, 42, 43, 44, 45, 48, 49, 50, 53, 54, and 55, one feature of the disclosed interlocking blocking system 10 may be that it can be configured for retaining wall 34. As shown and described herein, interlocking blocking system 10 may be configured to interlock without mortar using their matching tapers thereby reducing a time and skill level necessary to install retaining wall. 34, other structures, or the like. Another feature of interlocking blocking system 10, like as used for retaining wall 34, may be that hollow tapered inside 28 of each of the plurality of interlocking blocks 12 may be configured as forms for additional concrete of other material. Another feature of interlocking blocking system 10, like as used for retaining wall 34, may be that hollow tapered inside 28 of each of the plurality of interlocking blocks 12 may be configured to allow for easy handling and tying of structure together without mortar. Another feature of interlocking blocking system 10, like as used for retaining wall 34, may be that interlocking blocking system 10 may be configured with a minimal amount of concrete to reduce manufacture cost, weight, and shipping costs. Another feature of interlocking blocking system 10, like as used for retaining wall 34, may be that interlocking blocking system 10 may be configured with the ability to easily be handled by light equipment since a significant portion of each interlocking blocks 12 is hollow tapered inside 28. Another feature of interlocking blocking system 10, like as used for retaining wall 34, may be that interlocking blocking system 10 may be configured with a modular design that can be configured to allow for multiple configurations with a minimum number of different pieces. Another feature of interlocking blocking system 10, like as used for retaining wall 34, may be that interlocking blocking system 10 can be configured with the ability to build either structures that allow water to flow thru them or ones that are a barrier to water (see FIGS. 40-45). Another feature of interlocking blocking system 10, like as used for retaining wall 34, may be that the disclosed interlocking blocking system 10 can be configured to use hollow tapered inside 28 of each interlocking block 12 as a form for additional reinforcement or for adding concrete once the structure is in place, like retaining wall 34.

Figure 1:
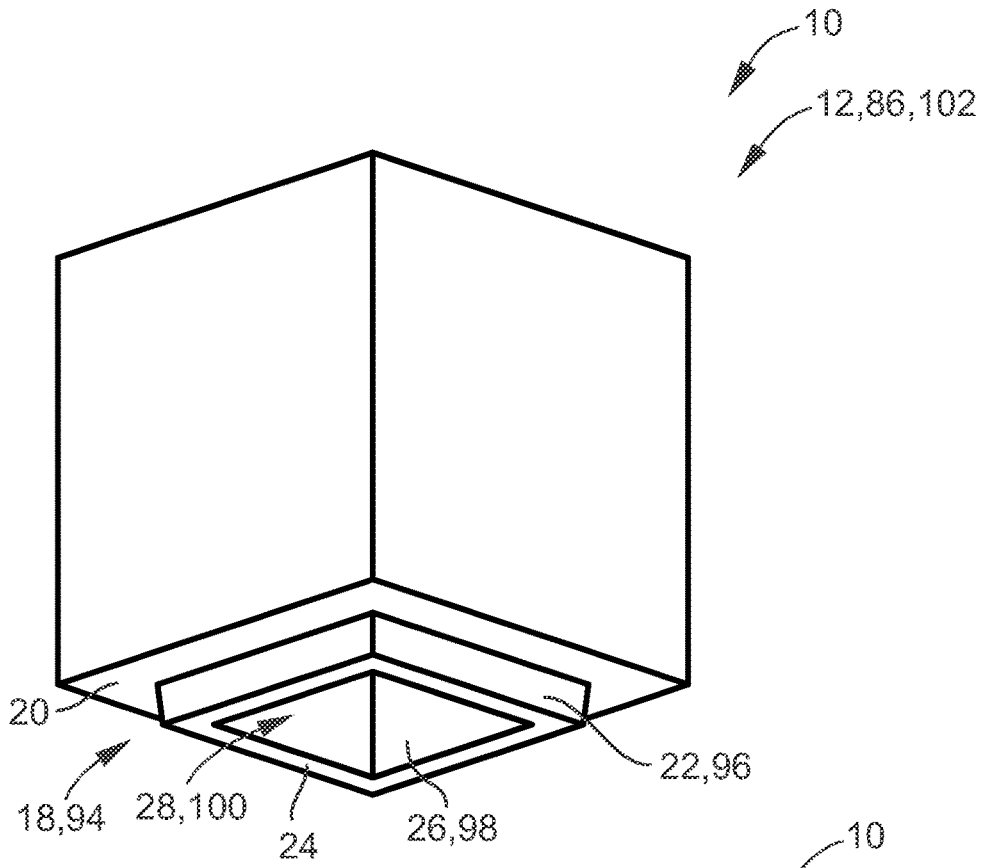
FIG. 1 is a bottom perspective view of a square 1×1 block for the interlocking blocking system according to select embodiments of the instant disclosure.
Figure 2:
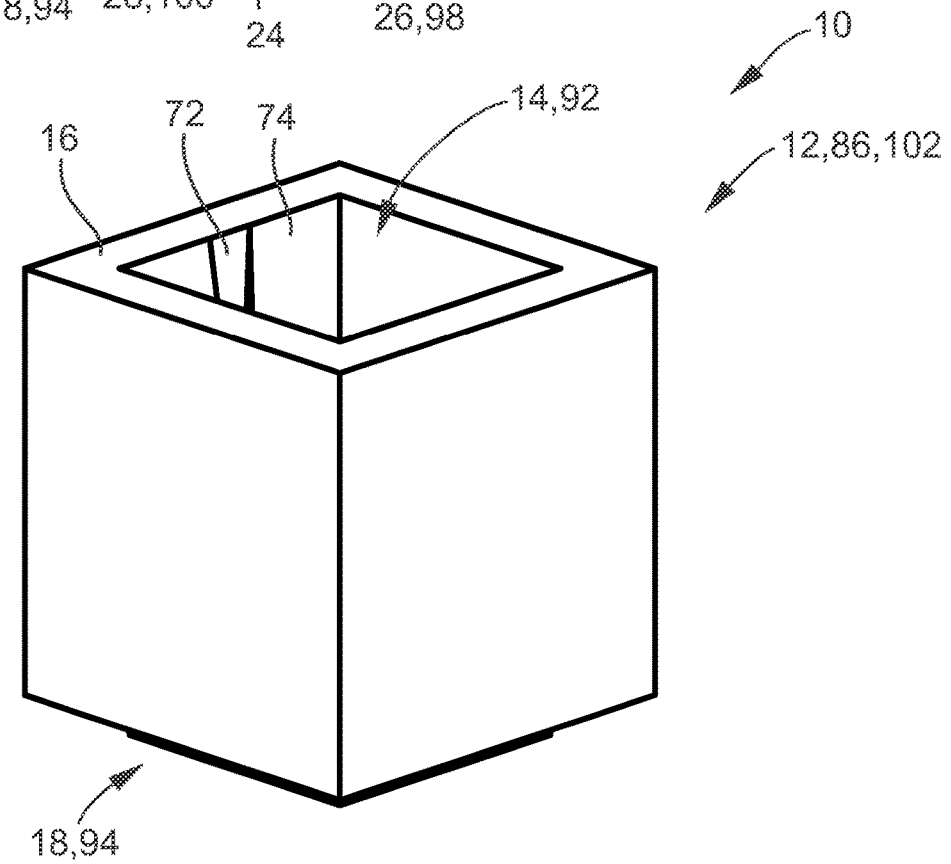
FIG. 2 is a top perspective view of the square 1×1 block of FIG. 1.
Figure 3:
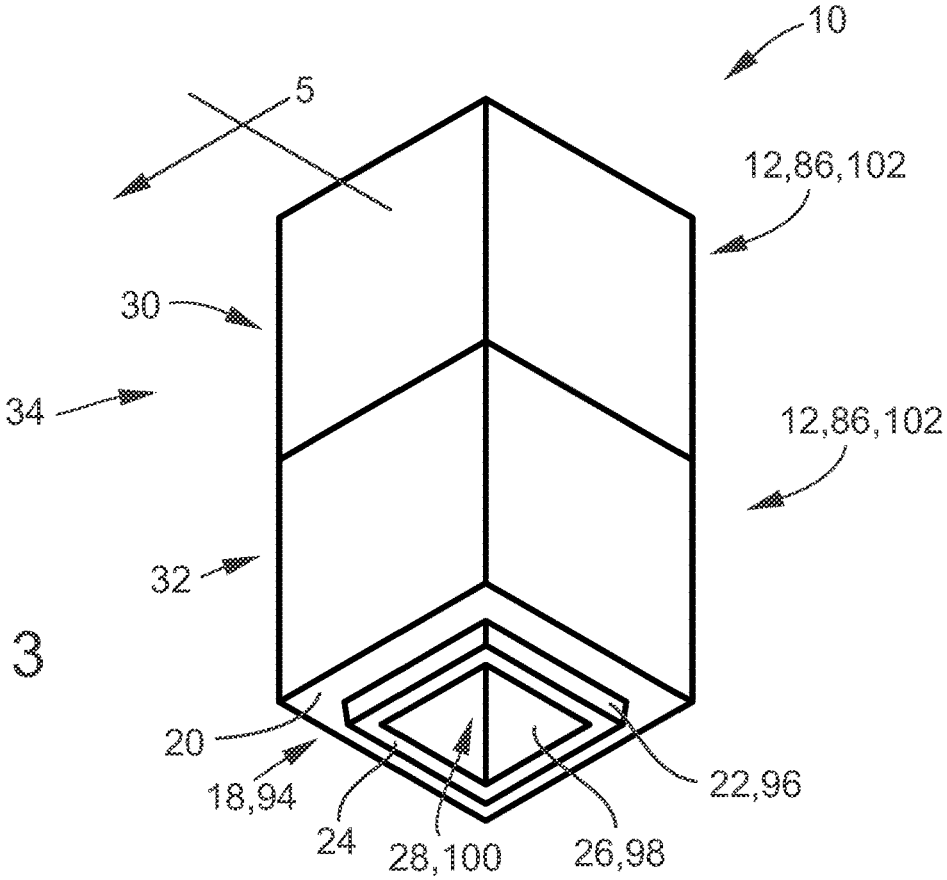
FIG. 3 is a bottom perspective view of two square 1×1 blocks from FIG. 1 stacked on top of one another according to select embodiments of the interlocking blocking system of the instant disclosure.
Figure 4:
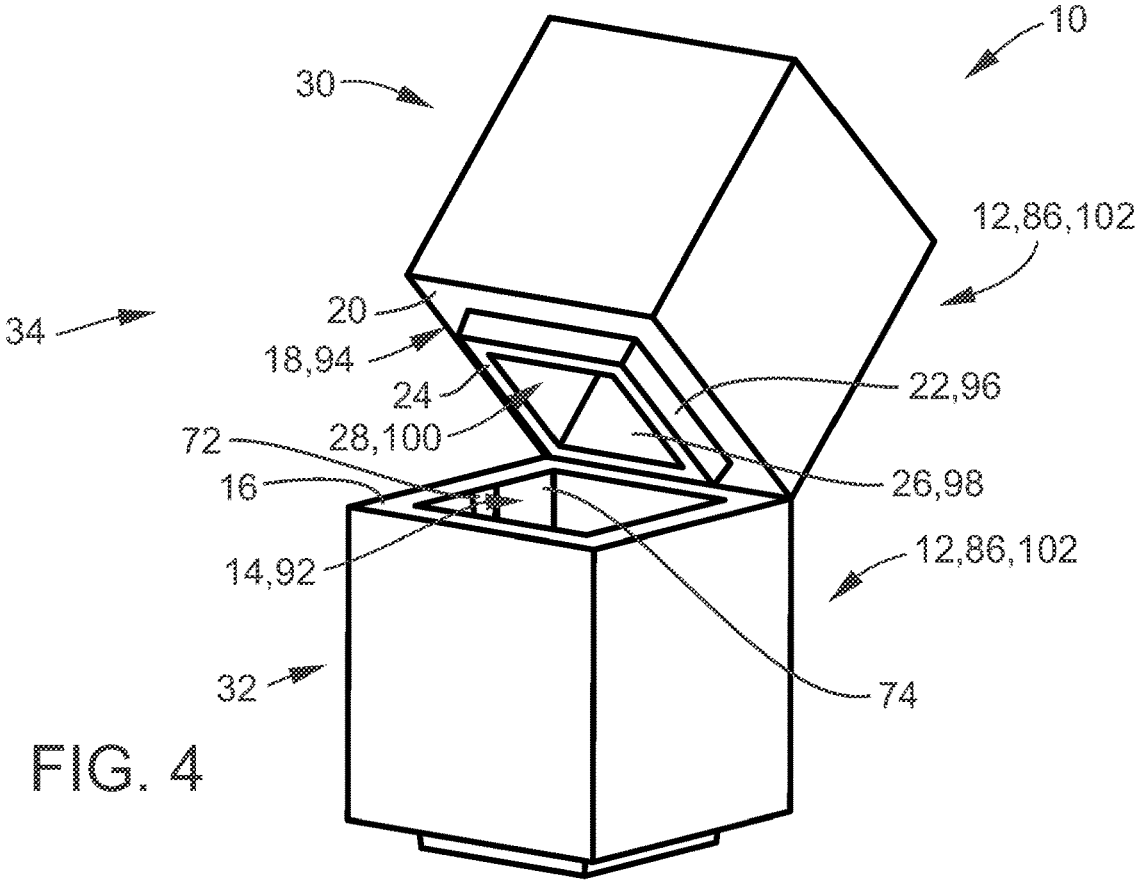
FIG. 4 is a perspective view of the two square 1×1 blocks from FIG. 3 with the top block partially disassembled to show the interlocking element of the interlocking blocking system of the instant disclosure.
Figure 5:
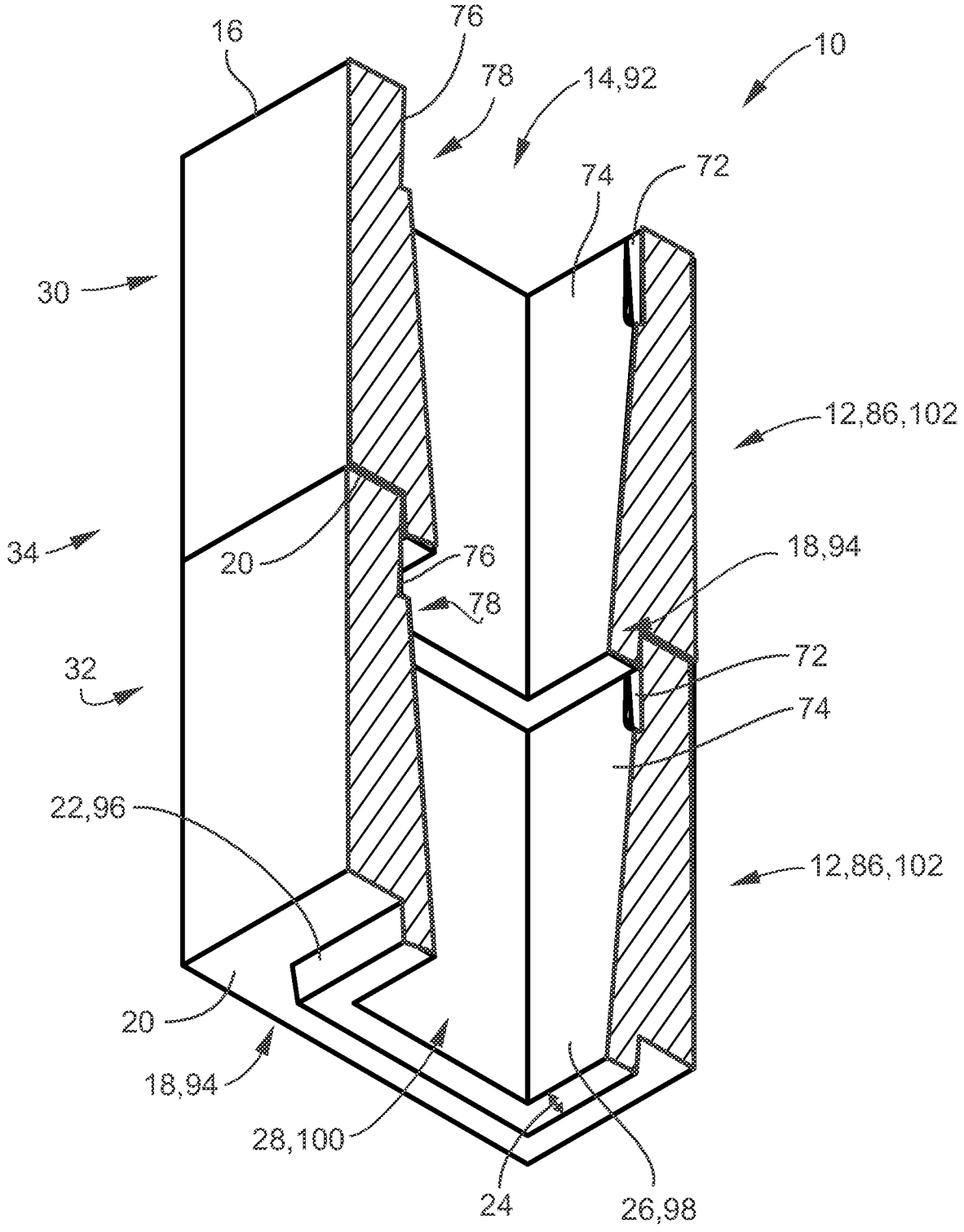
FIG. 5 is a cross-sectional bottom perspective view of the two square 1×1 blocks from FIG. 3.
Figure 6:
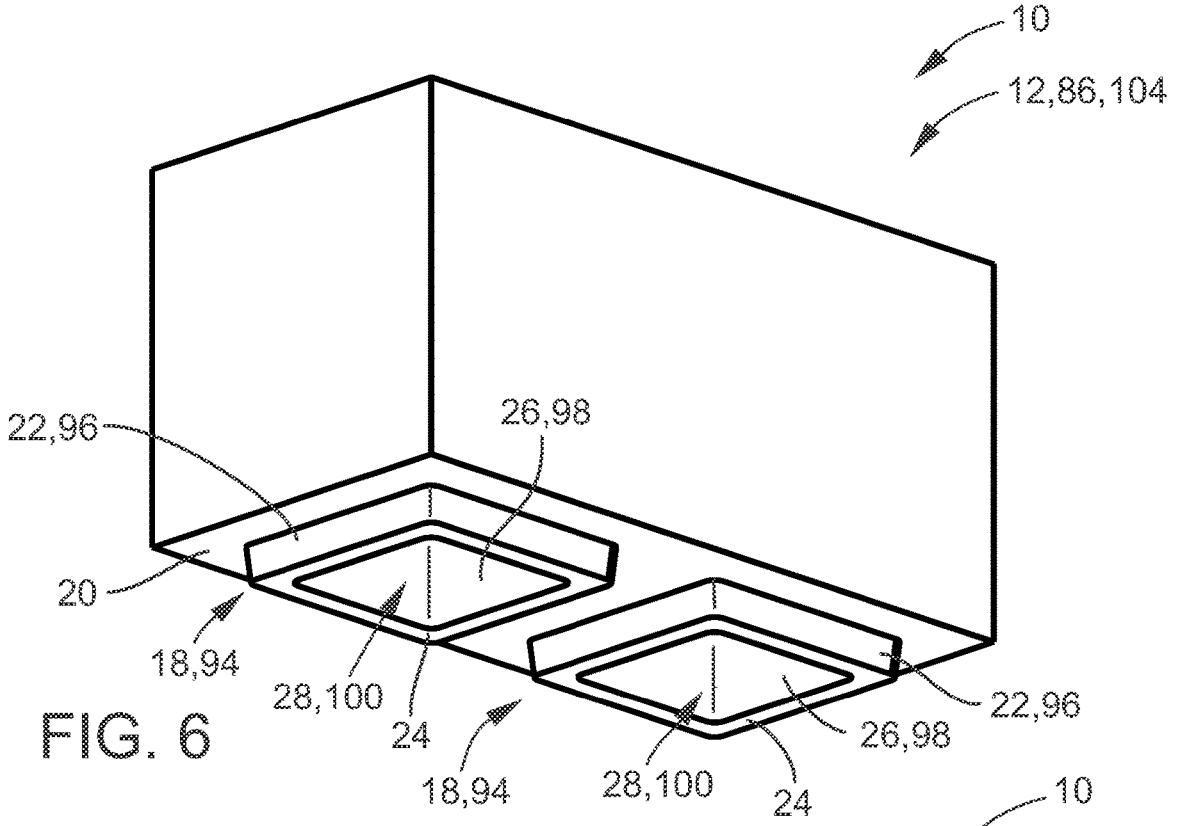
FIG. 6 is a bottom perspective view of a square 2×1 block for the interlocking blocking system according to select embodiments of the instant disclosure.
Figure 7:
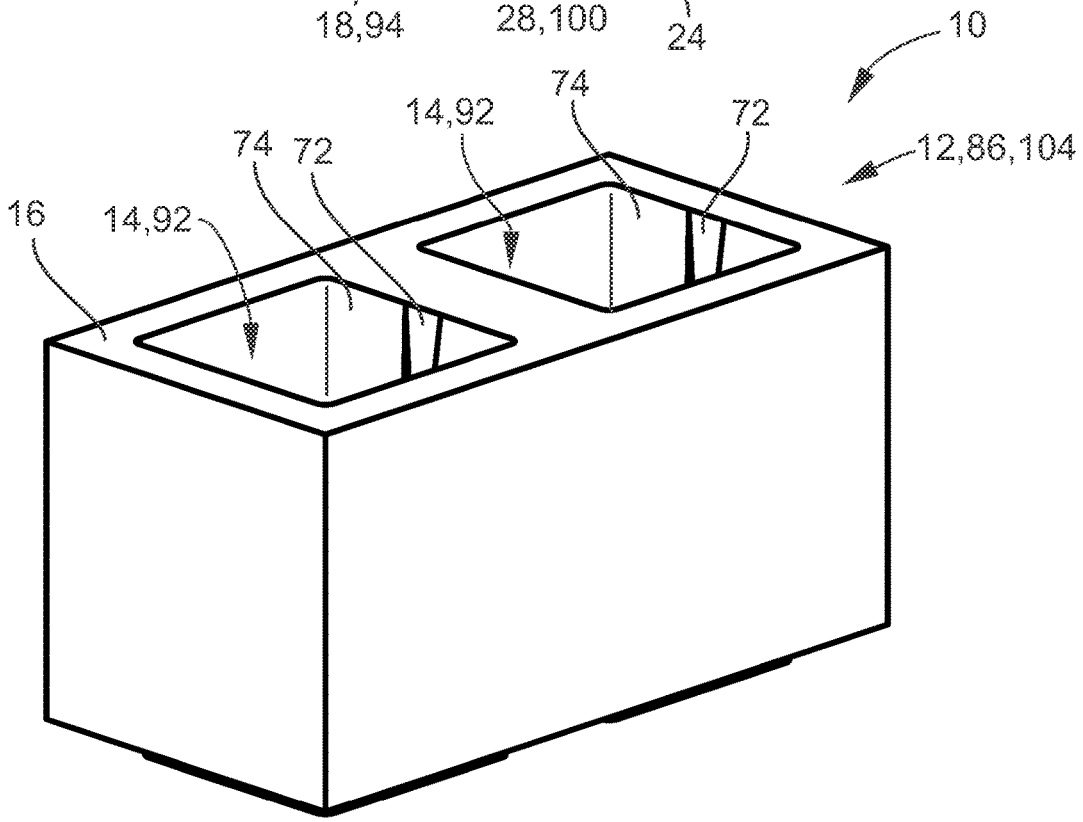
FIG. 7 is a top perspective view of the square 2×1 block of FIG. 6.
Figure 8:
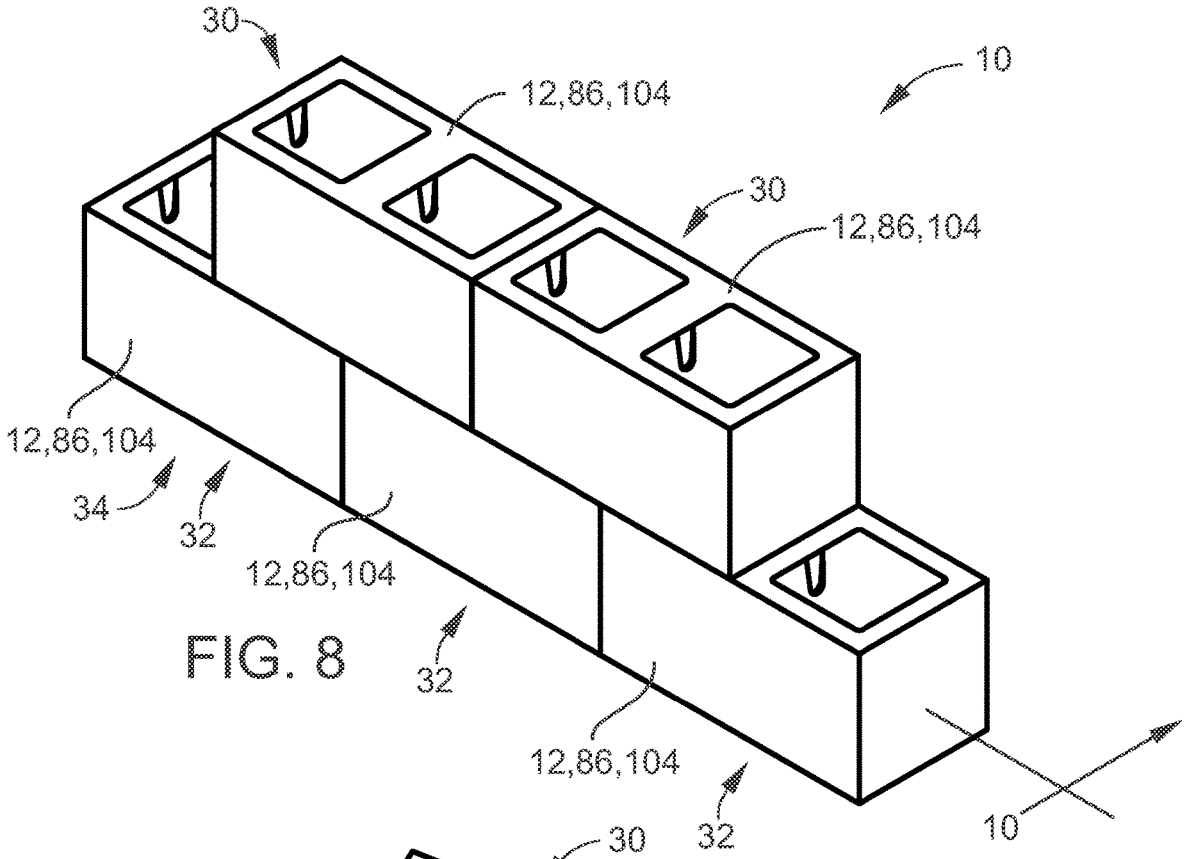
FIG. 8 is a top perspective view of five square 2×1 blocks from FIG. 6 stacked on top of one another according to select embodiments of the interlocking blocking system of the instant disclosure.
Figure 9:
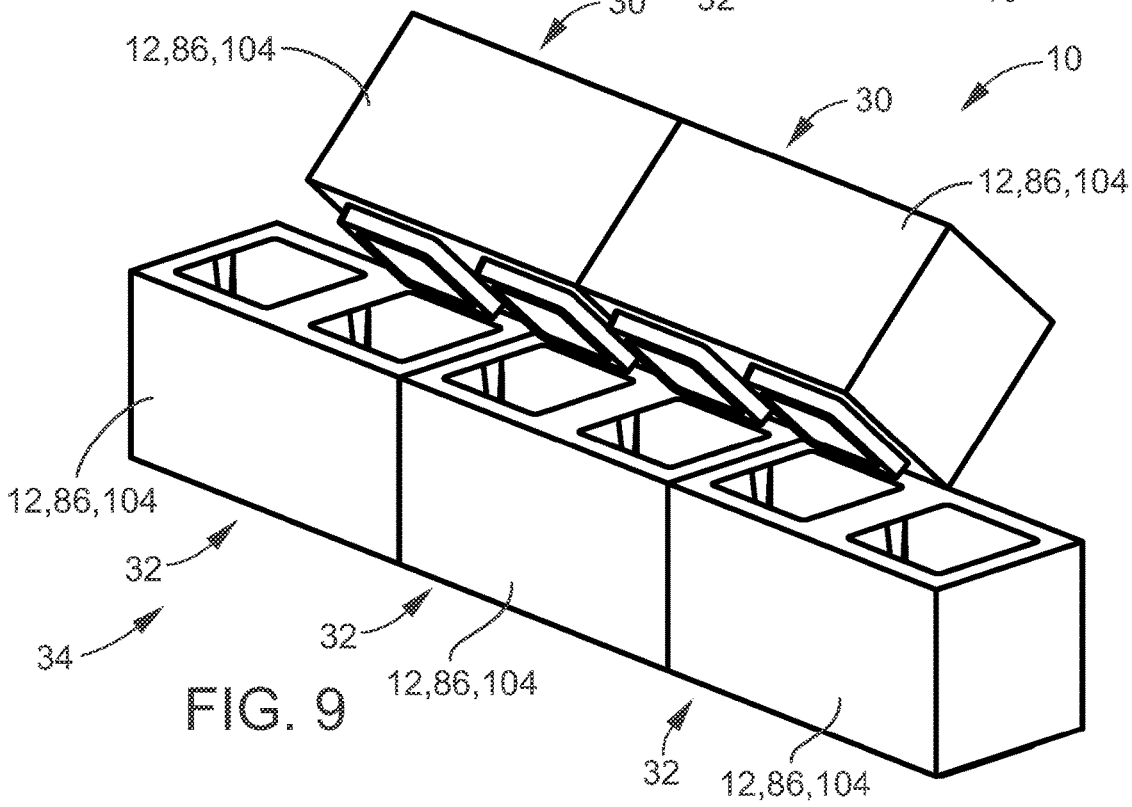
FIG. 9 is a perspective view of the five square 2×1 blocks from FIG. 8 with the two top blocks partially disassembled to show the interlocking element of the interlocking blocking system of the instant disclosure.
Figure 10:
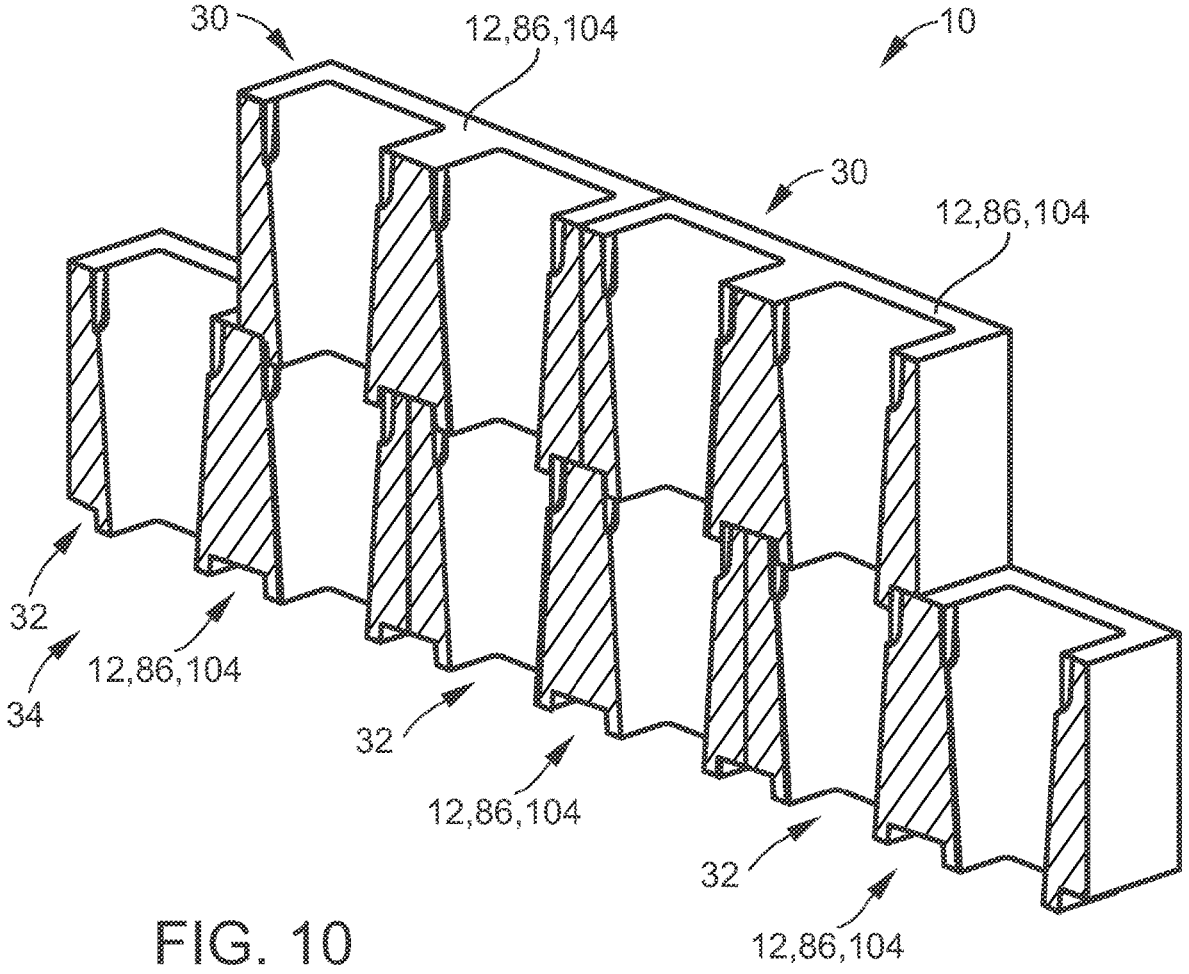
FIG. 10 is a cross-sectional top perspective view of the five square 2×1 blocks from FIG. 8.
Figure 11:
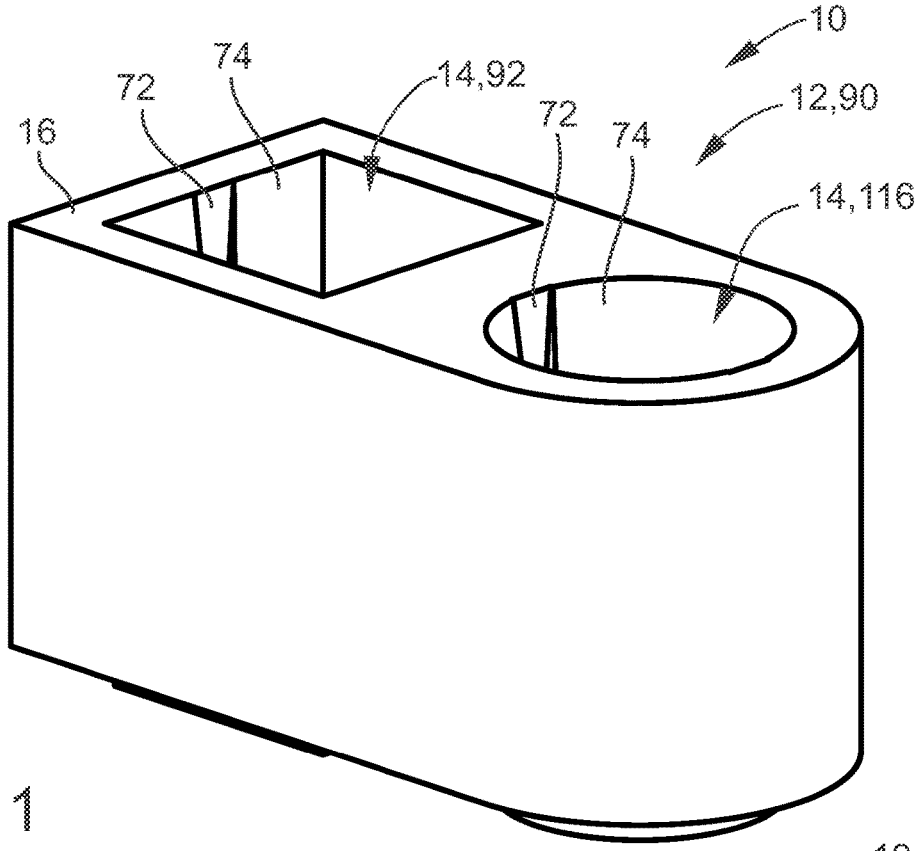
FIG. 11 is a top perspective view of an adaptor block for the interlocking blocking system according to select embodiments of the instant disclosure.
Figure 12:
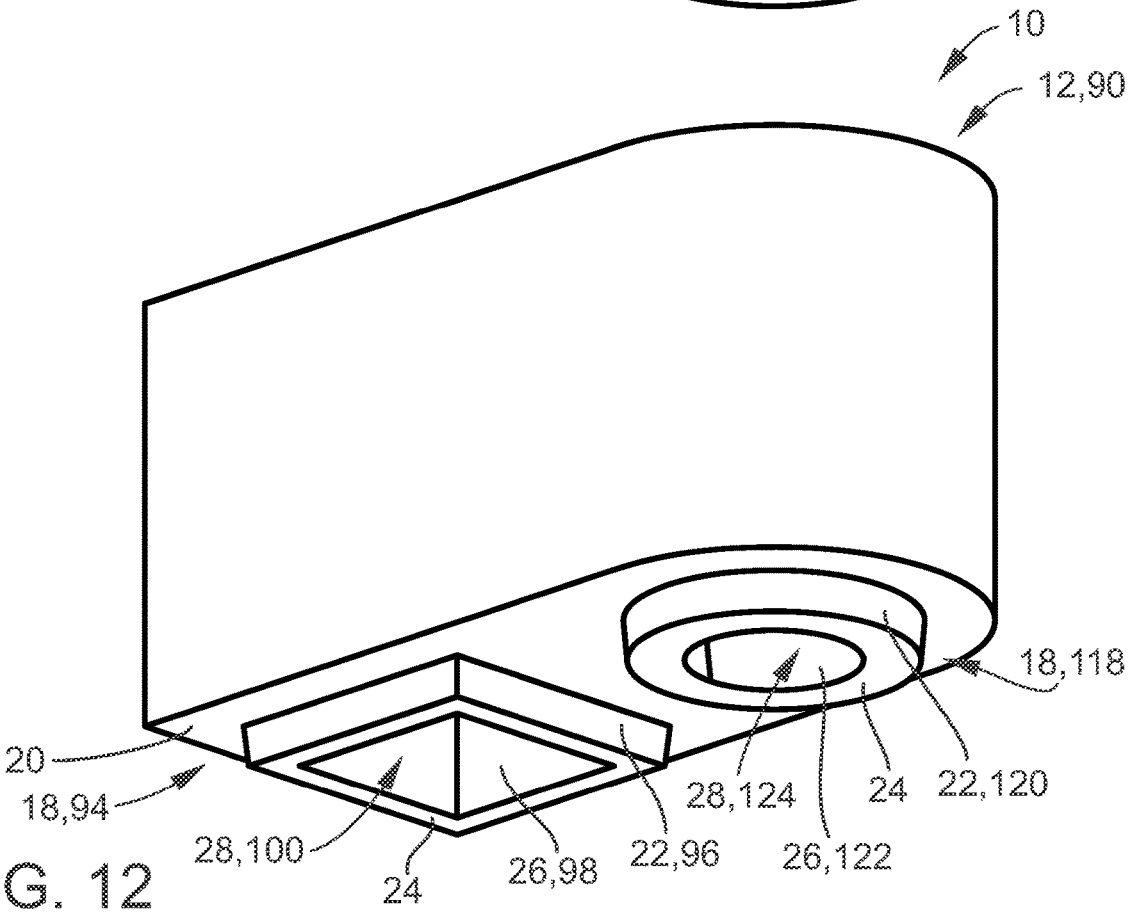
FIG. 12 is a bottom perspective view of the adaptor block of FIG. 11.
Figure 13:
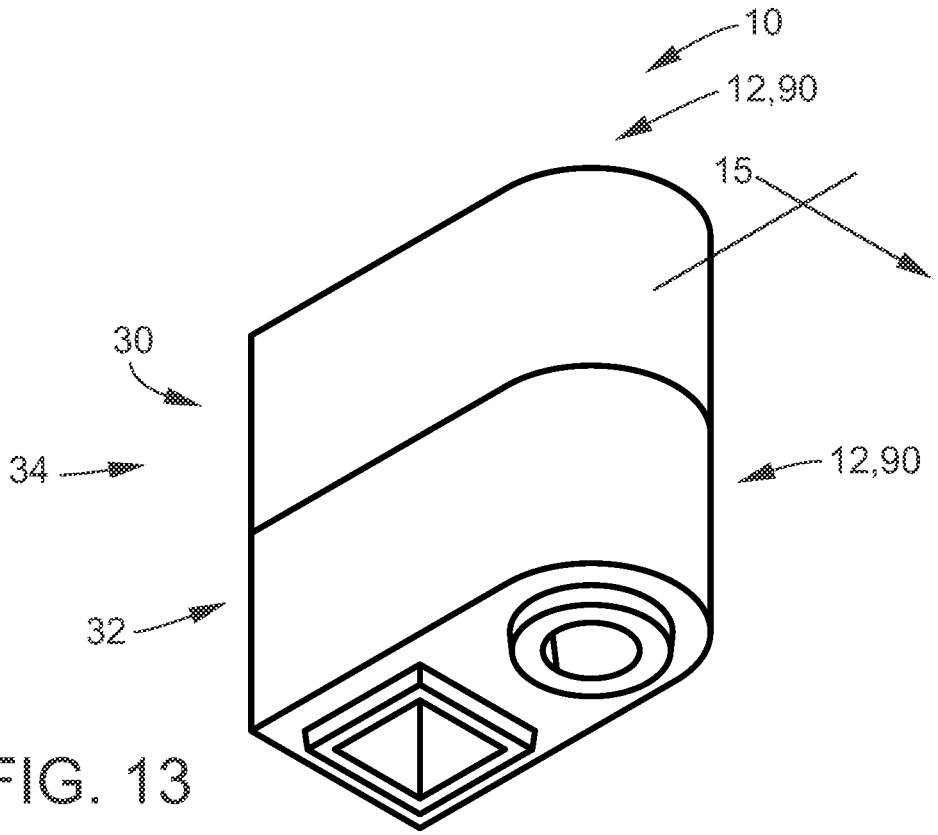
FIG. 13 is a bottom perspective view of two adaptor blocks from FIG. 11 stacked on top of one another according to select embodiments of the interlocking blocking system of the instant disclosure.
Figure 14:
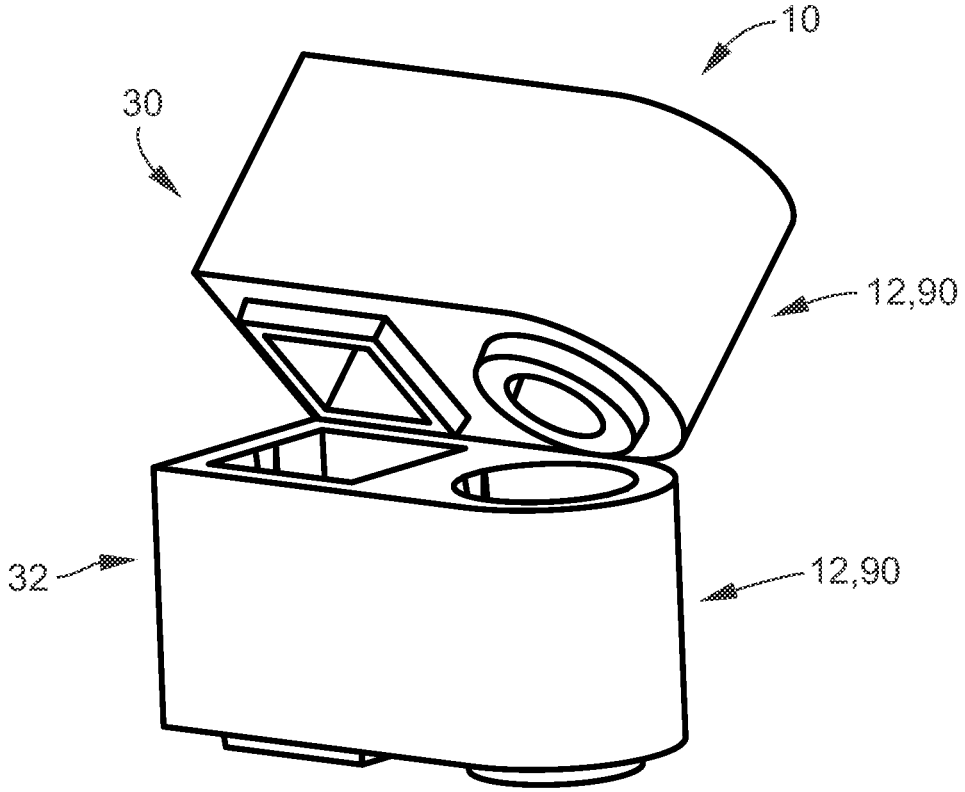
FIG. 14 is a perspective view of the two adaptor blocks from FIG. 13 with the top block partially disassembled to show the interlocking element of the interlocking blocking system of the instant disclosure.
Figure 15:
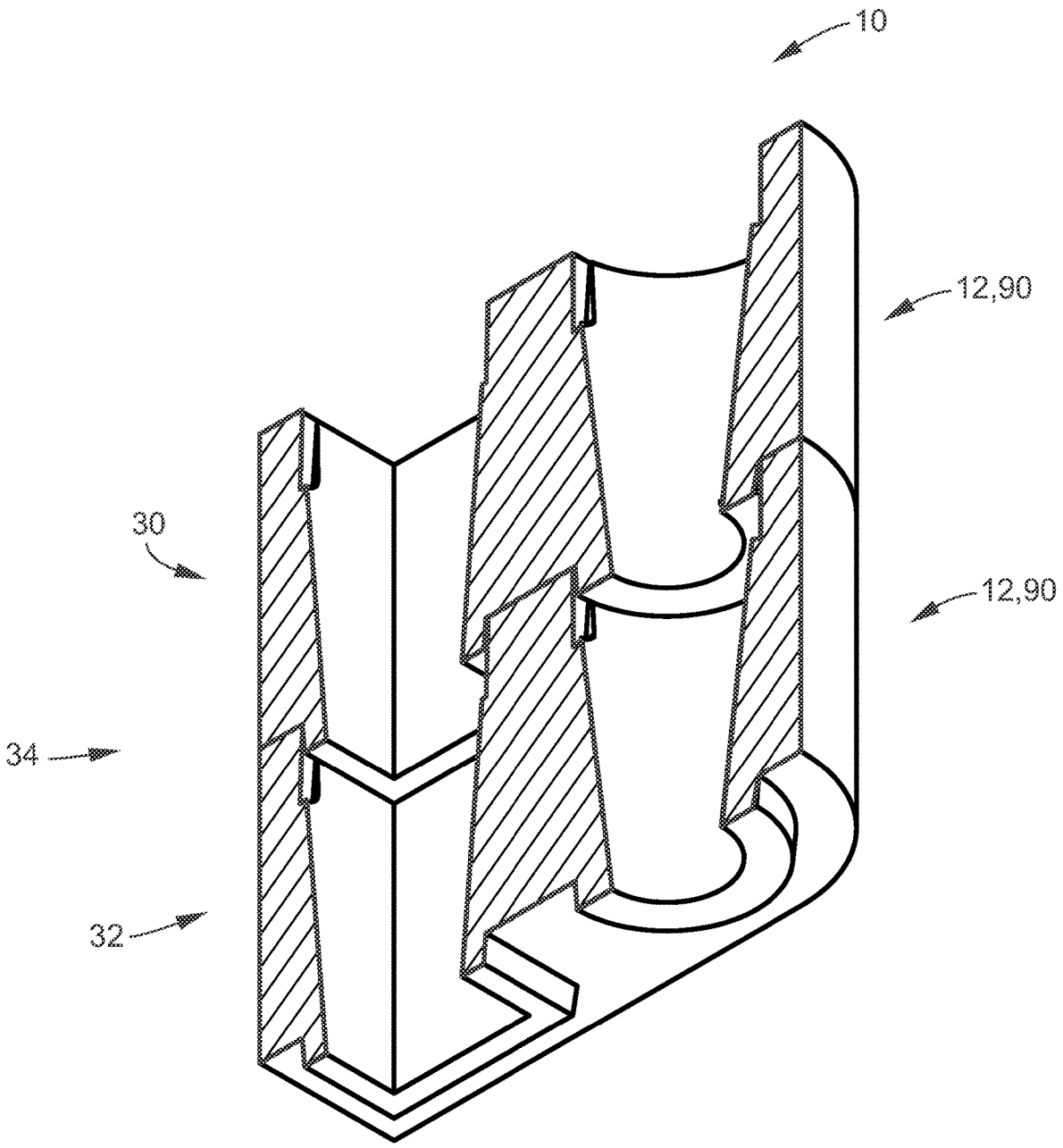
FIG. 15 is a cross-sectional bottom perspective view of the two adaptor blocks from FIG. 13.
Figure 16:
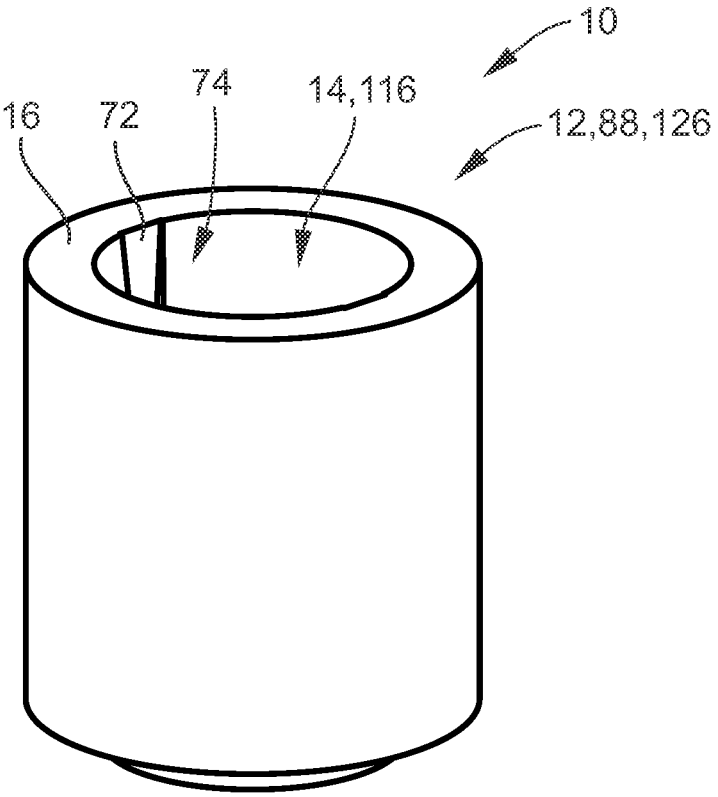
FIG. 16 is a top perspective view of a round 1×1 block for the interlocking blocking system according to select embodiments of the instant disclosure.
Figure 17:
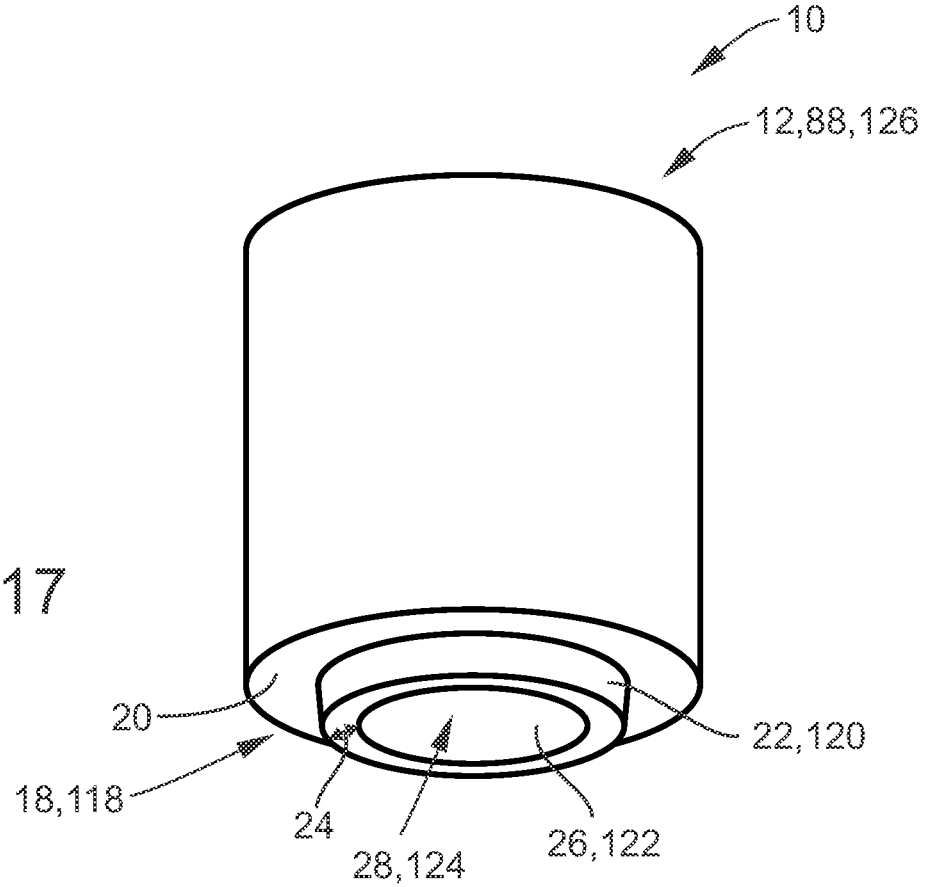
FIG. 17 is a bottom perspective view of the round 1×1 block of FIG. 16.
Figure 18:
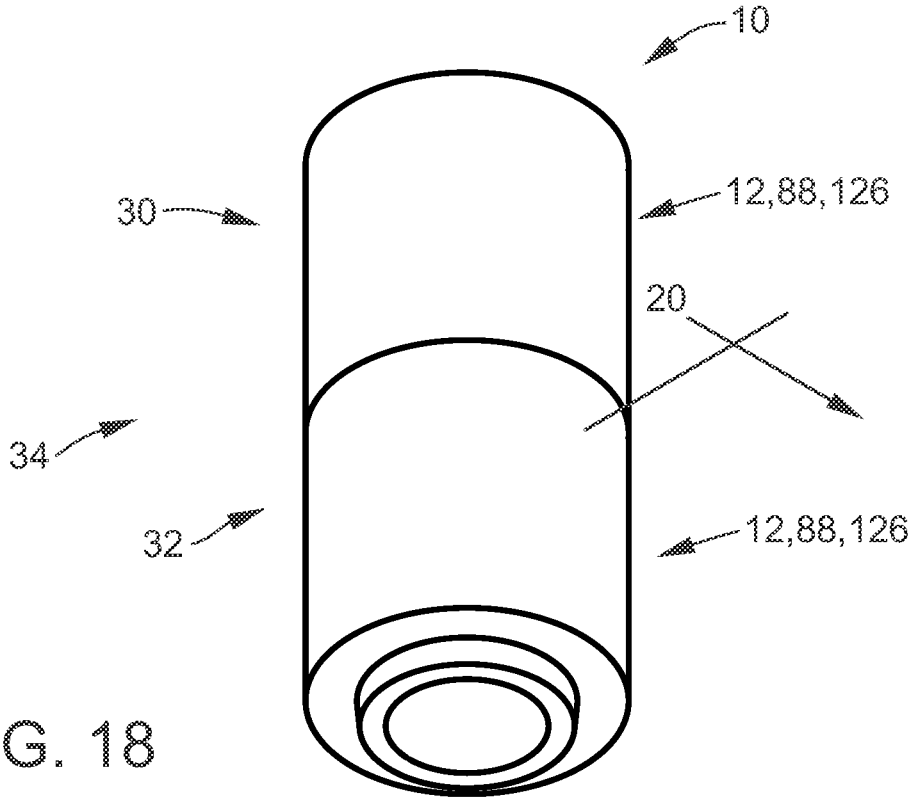
FIG. 18 is a bottom perspective view of two round 1×1 blocks from FIG. 16 stacked on top of one another according to select embodiments of the interlocking blocking system of the instant disclosure.
Figure 19:
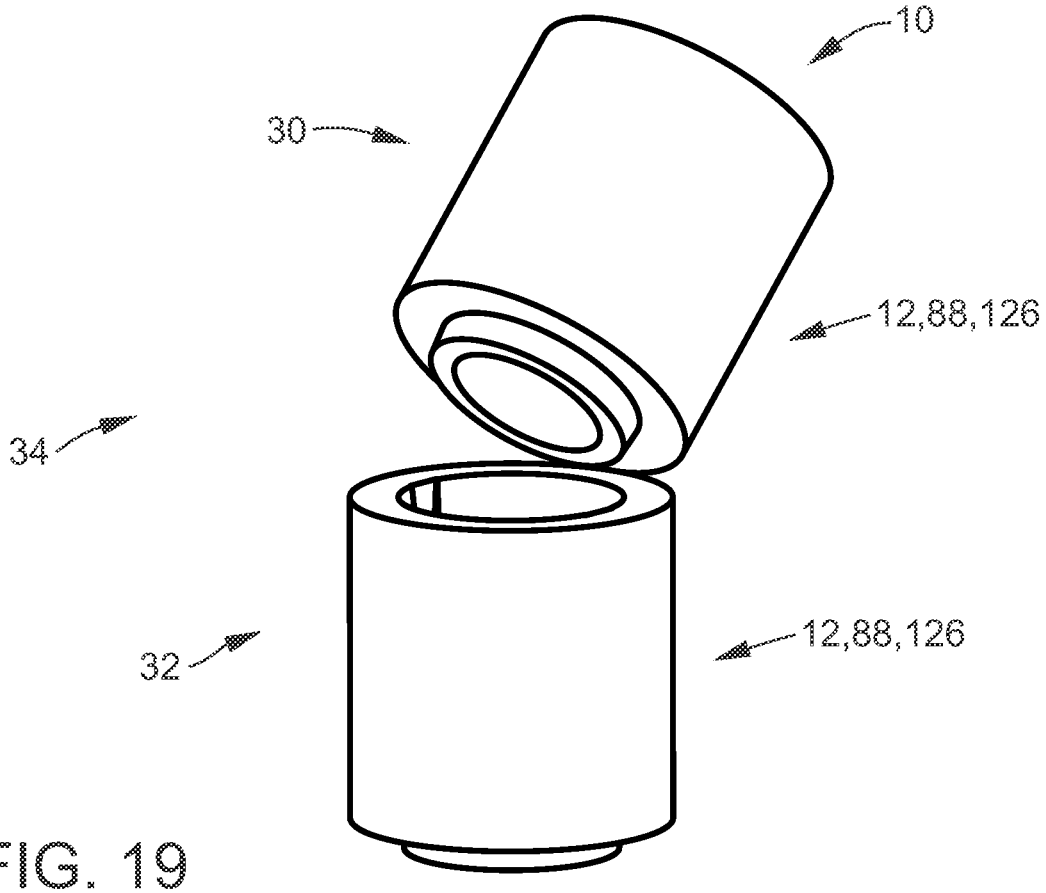
FIG. 19 is a perspective view of the two round 1×1 blocks from FIG. 18 with the top block partially disassembled to show the interlocking element of the interlocking blocking system of the instant disclosure.
Figure 20:
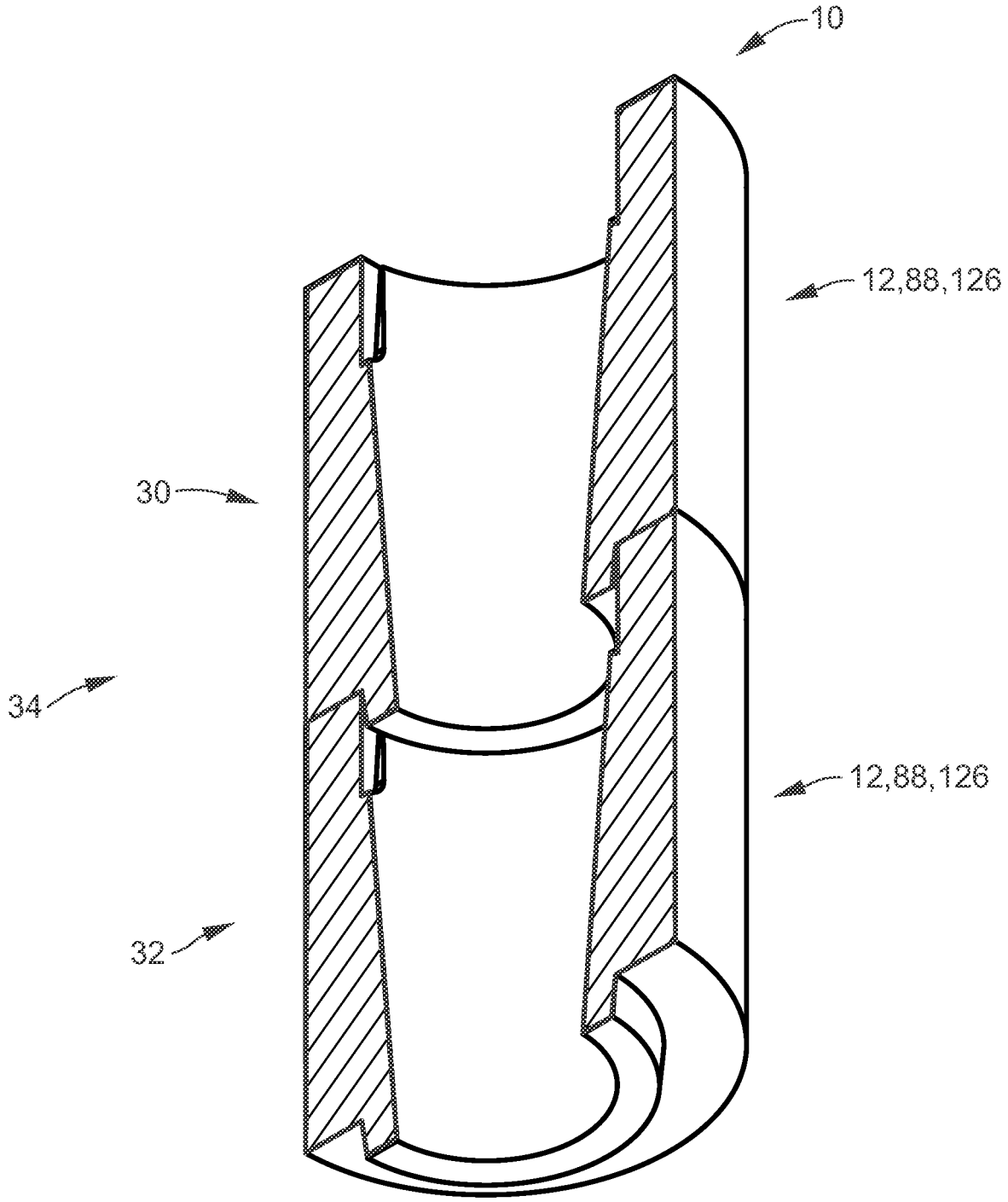
FIG. 20 is a cross-sectional bottom perspective view of the two round 1×1 blocks from FIG. 18.
Figure 21:
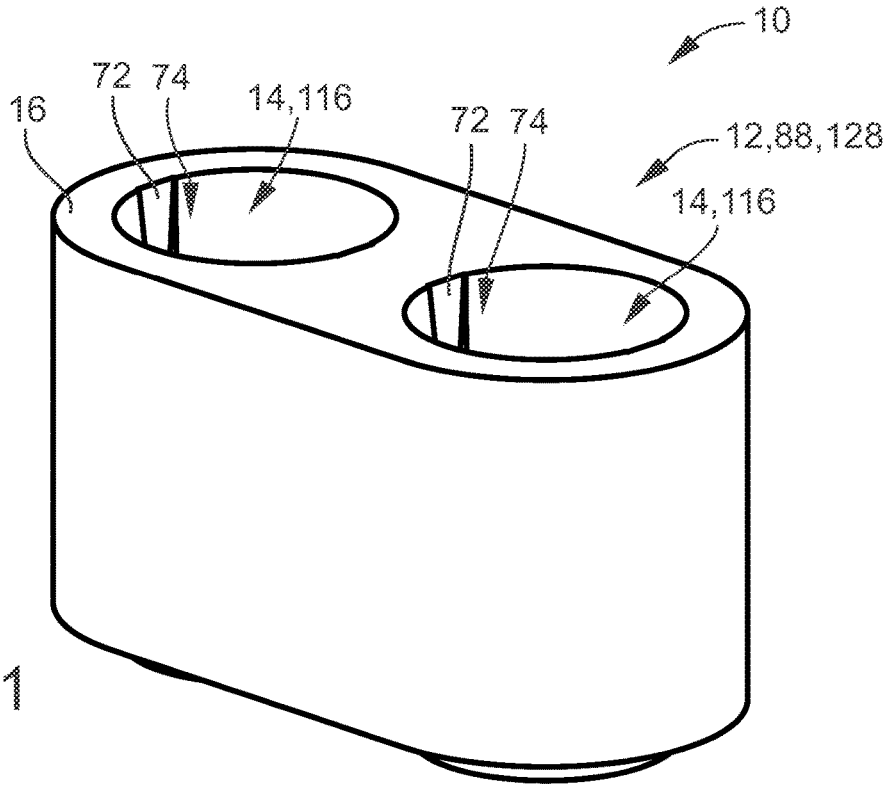
FIG. 21 is a top perspective view of a rounded 2×1 block for the interlocking blocking system according to select embodiments of the instant disclosure.
Figure 22:
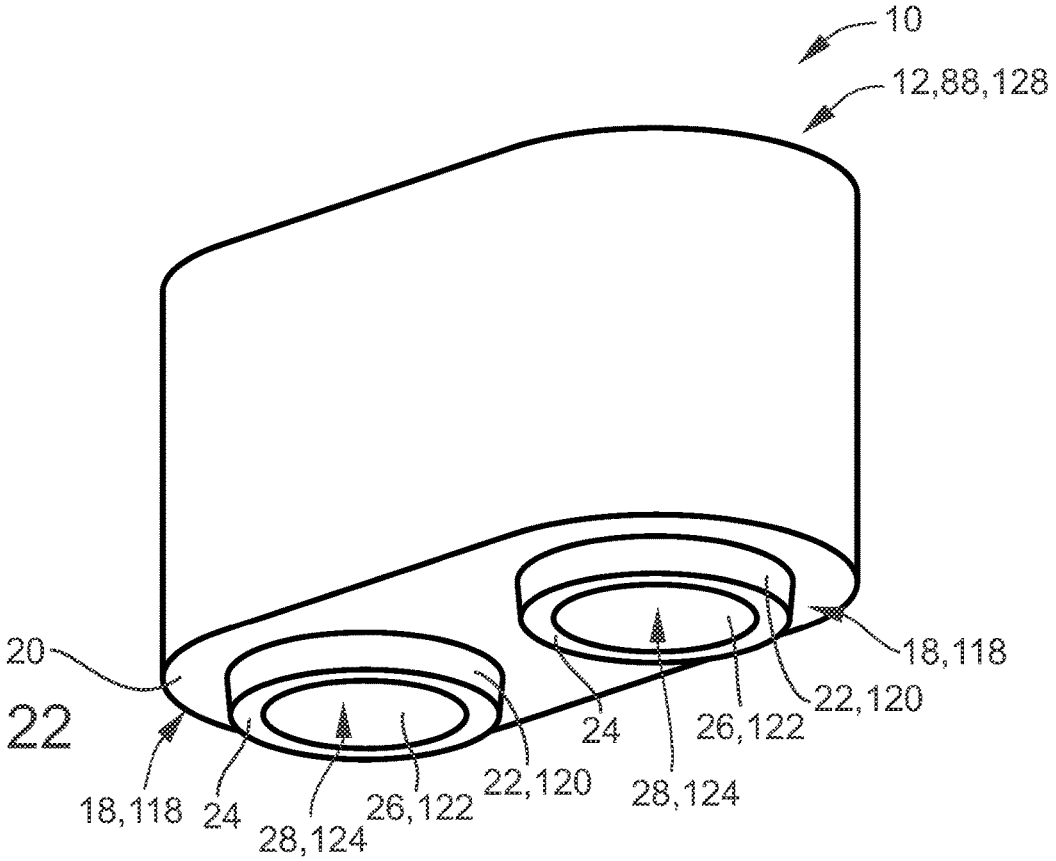
FIG. 22 is a bottom perspective view of the rounded 2×1 block of FIG. 21.
Figure 23:
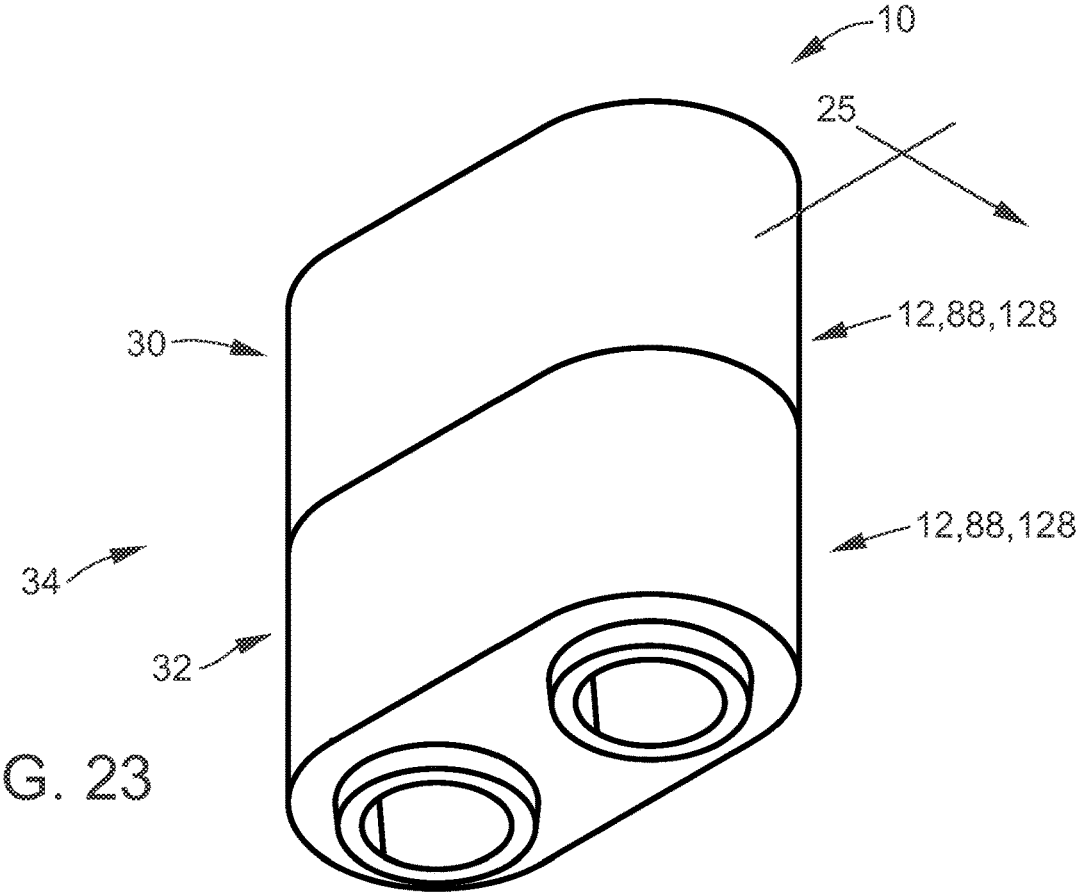
FIG. 23 is a bottom perspective view of two rounded 2×1 blocks from FIG. 21 stacked on top of one another according to select embodiments of the interlocking blocking system of the instant disclosure.
Figure 24:
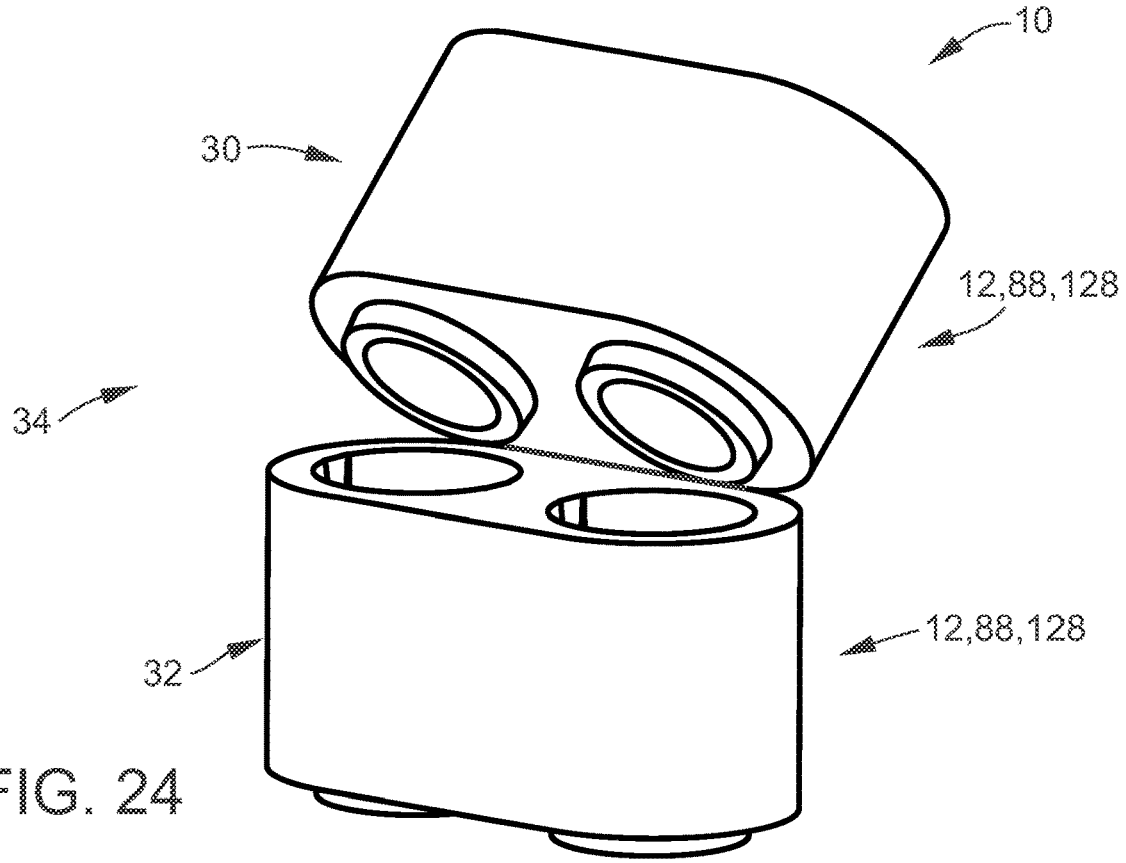
FIG. 24 is a perspective view of the two rounded 2×1 blocks from FIG. 23 with the top block partially disassembled to show the interlocking element of the interlocking blocking system of the instant disclosure.
Figure 25:
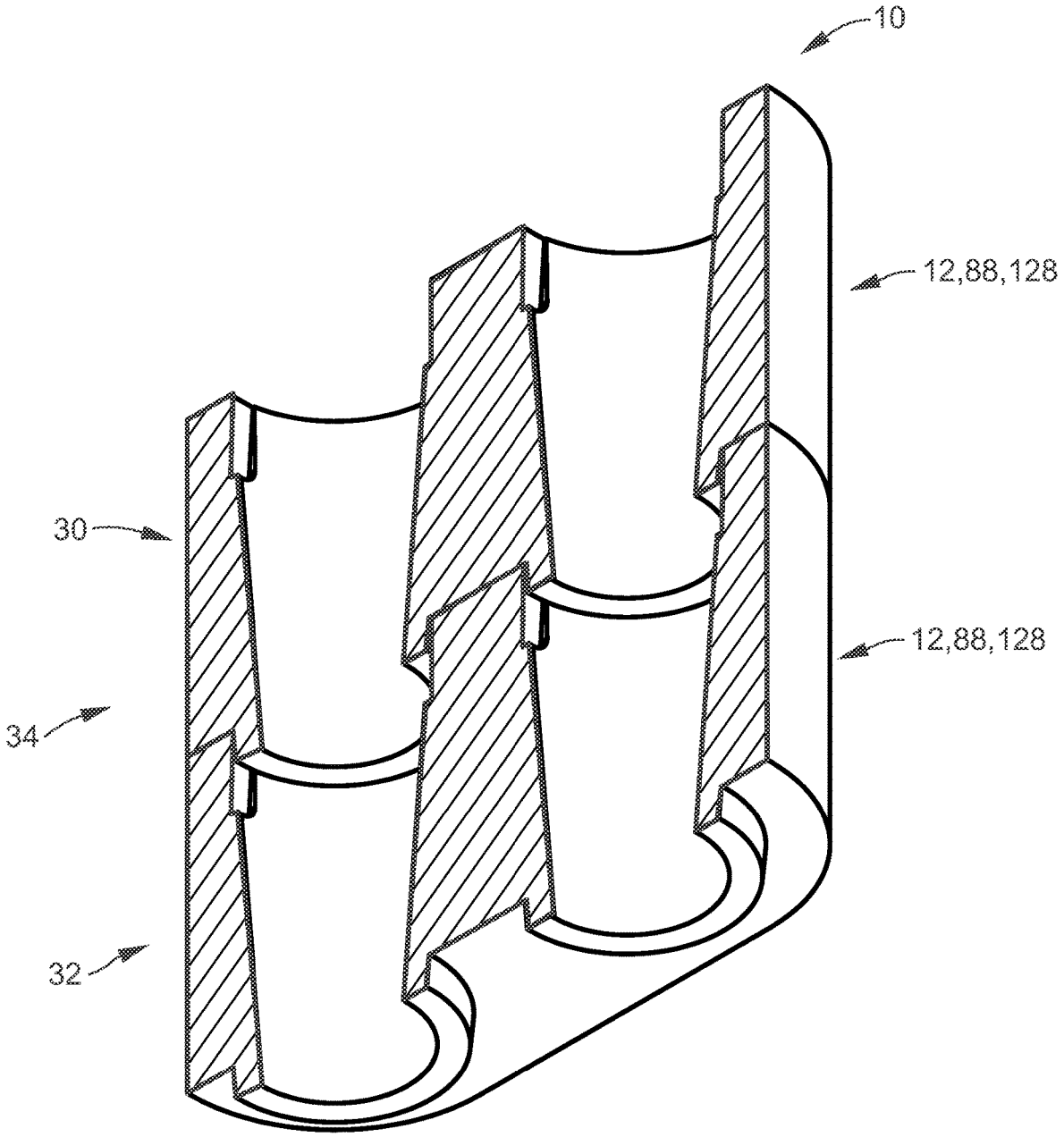
FIG. 25 is a cross-sectional bottom perspective view of the two rounded 2×1 blocks from FIG. 23.
Figure 26:
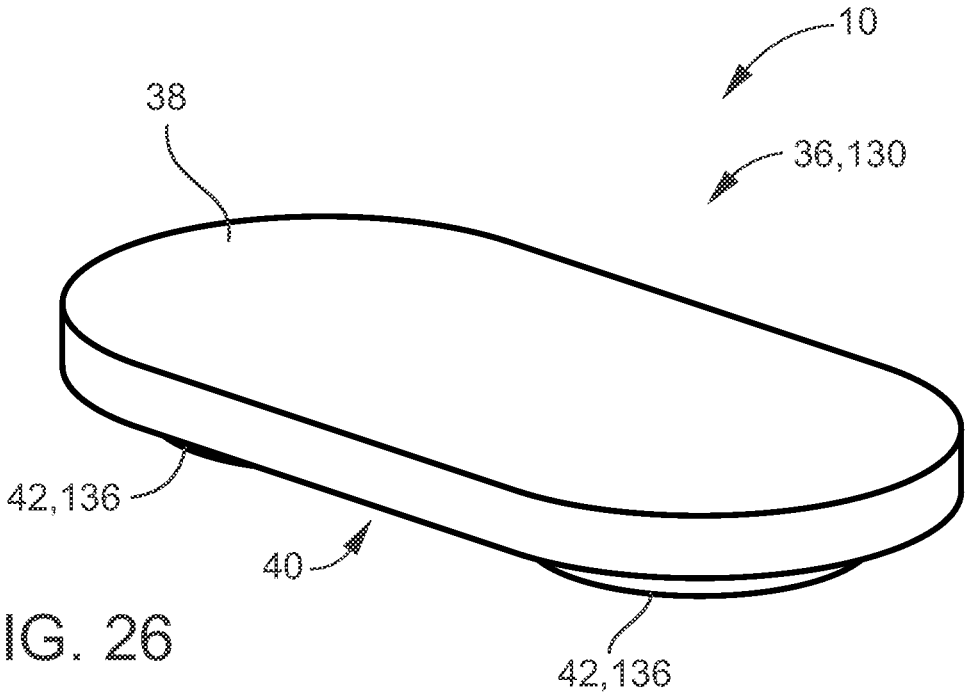
FIG. 26 is a top perspective view of a rounded 2×1 cap for the rounded 2×1 block from FIG. 21 for the interlocking blocking system according to select embodiments of the instant disclosure.
Figure 27:
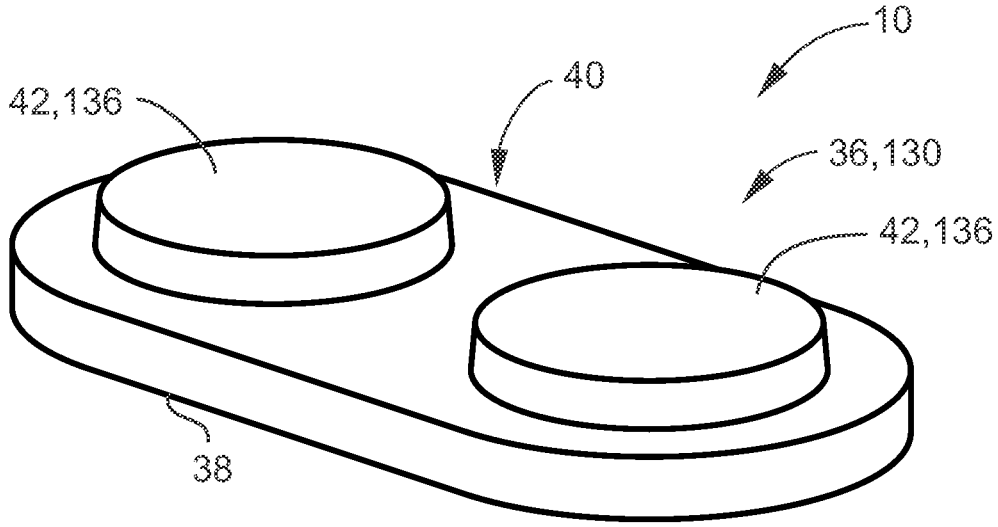
FIG. 27 is a bottom perspective view of the rounded 2×1 cap from FIG. 26.
Figure 28:
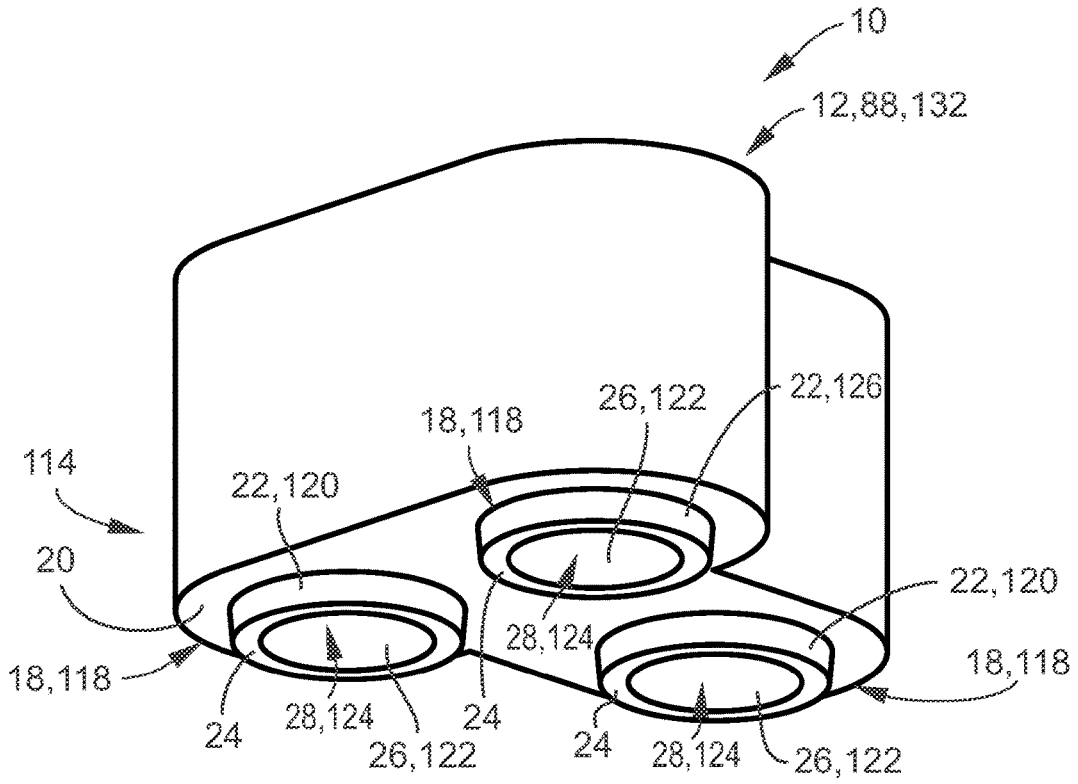
FIG. 28 is a bottom perspective view of a rounded T-block for the interlocking blocking system according to select embodiments of the instant disclosure.
Figure 29:
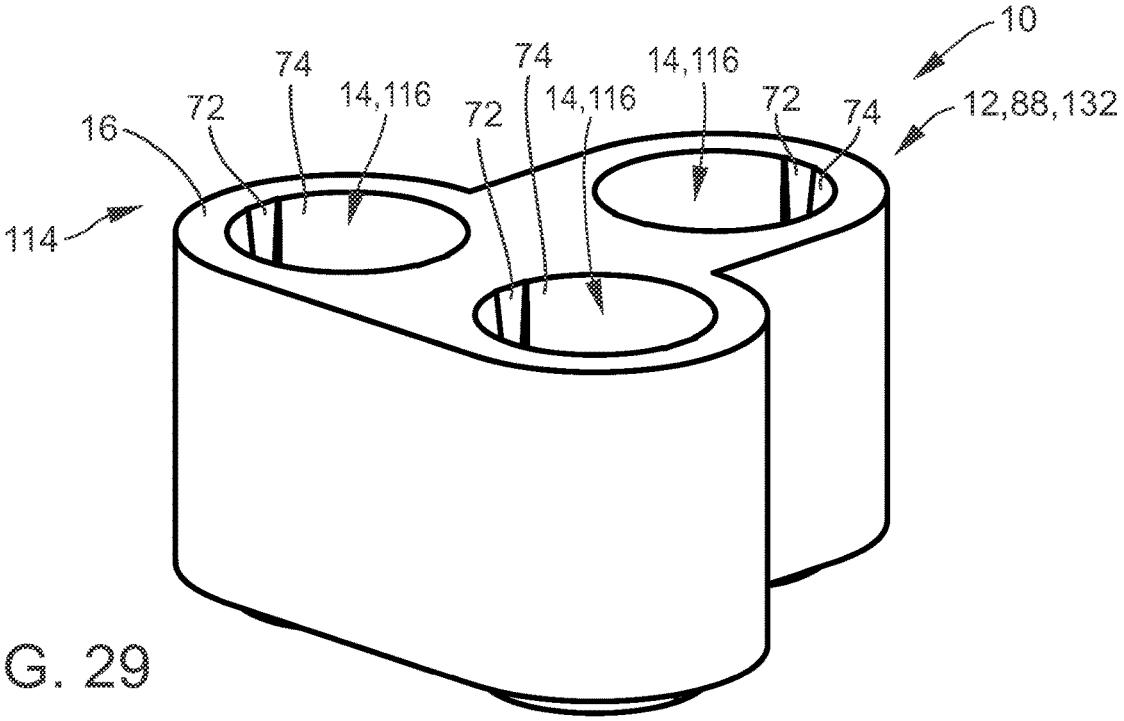
FIG. 29 is a top perspective view of the rounded T-block of FIG. 28.
Figure 30:
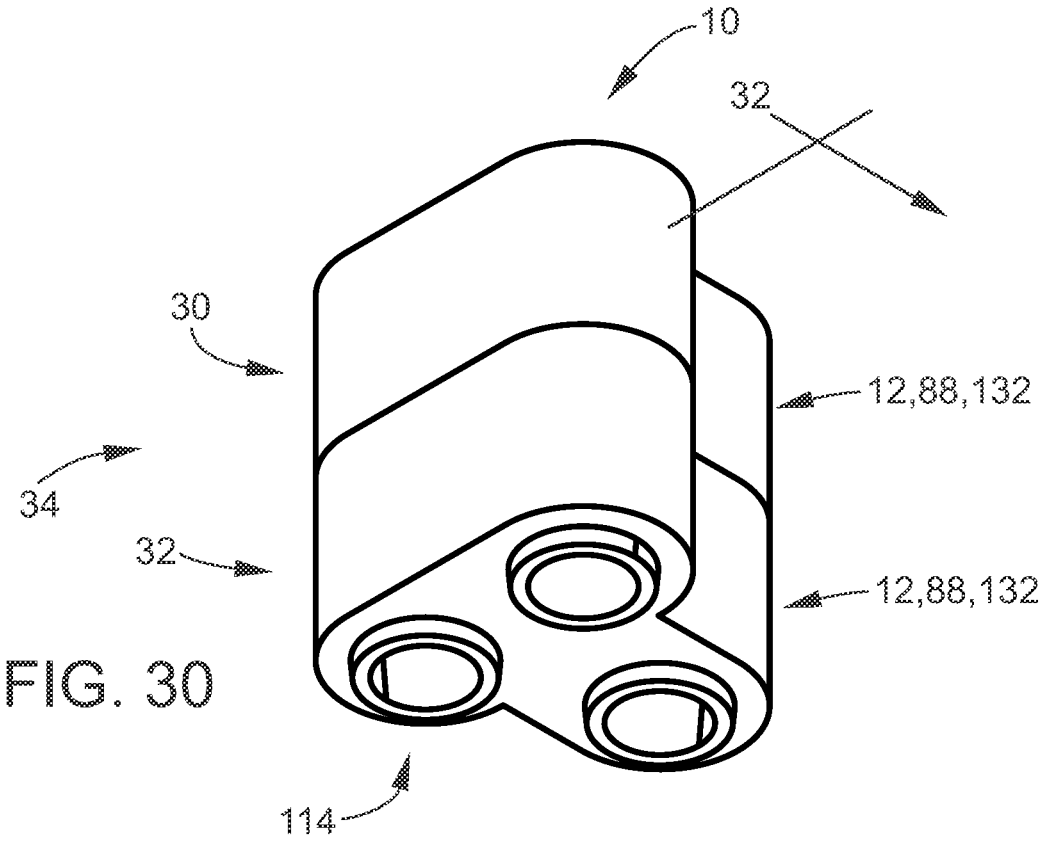
FIG. 30 is a bottom perspective view of two rounded T-blocks from FIG. 28 stacked on top of one another according to select embodiments of the interlocking blocking system of the instant disclosure.
Figure 31:
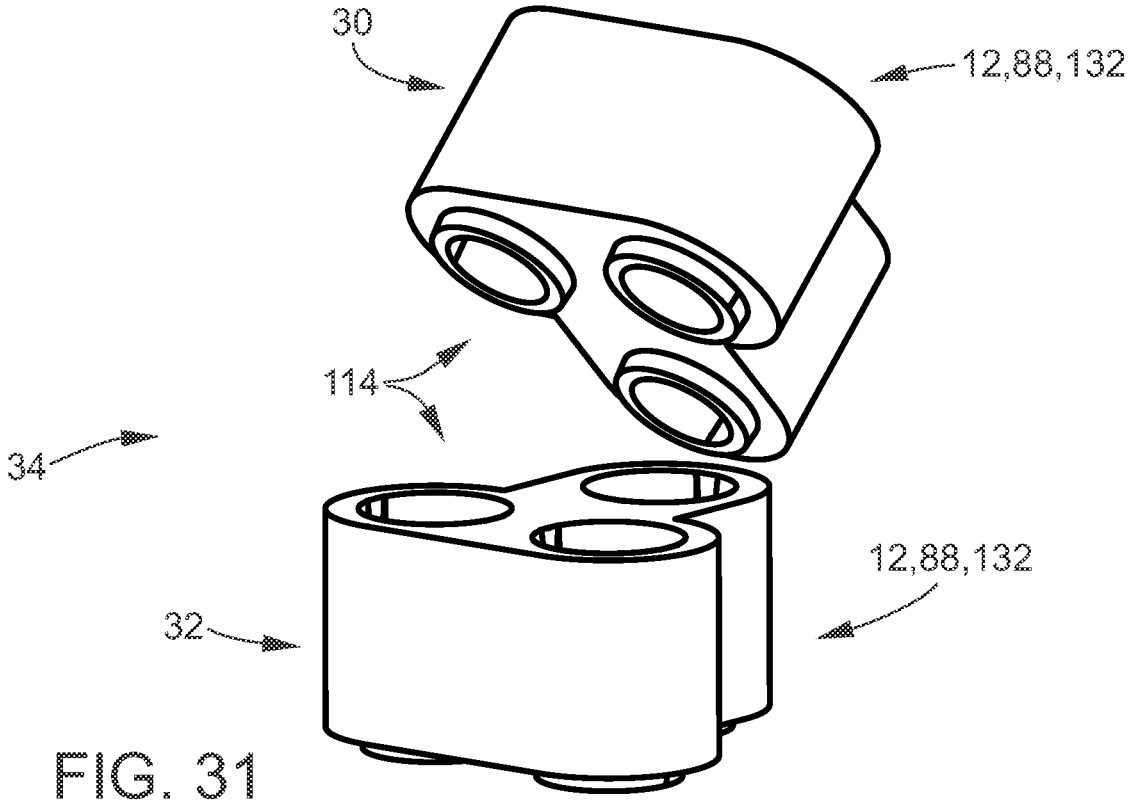
FIG. 31 is a perspective view of the two rounded T-blocks from FIG. 30 with the top block partially disassembled to show the interlocking element of the interlocking blocking system of the instant disclosure.
Figure 32:
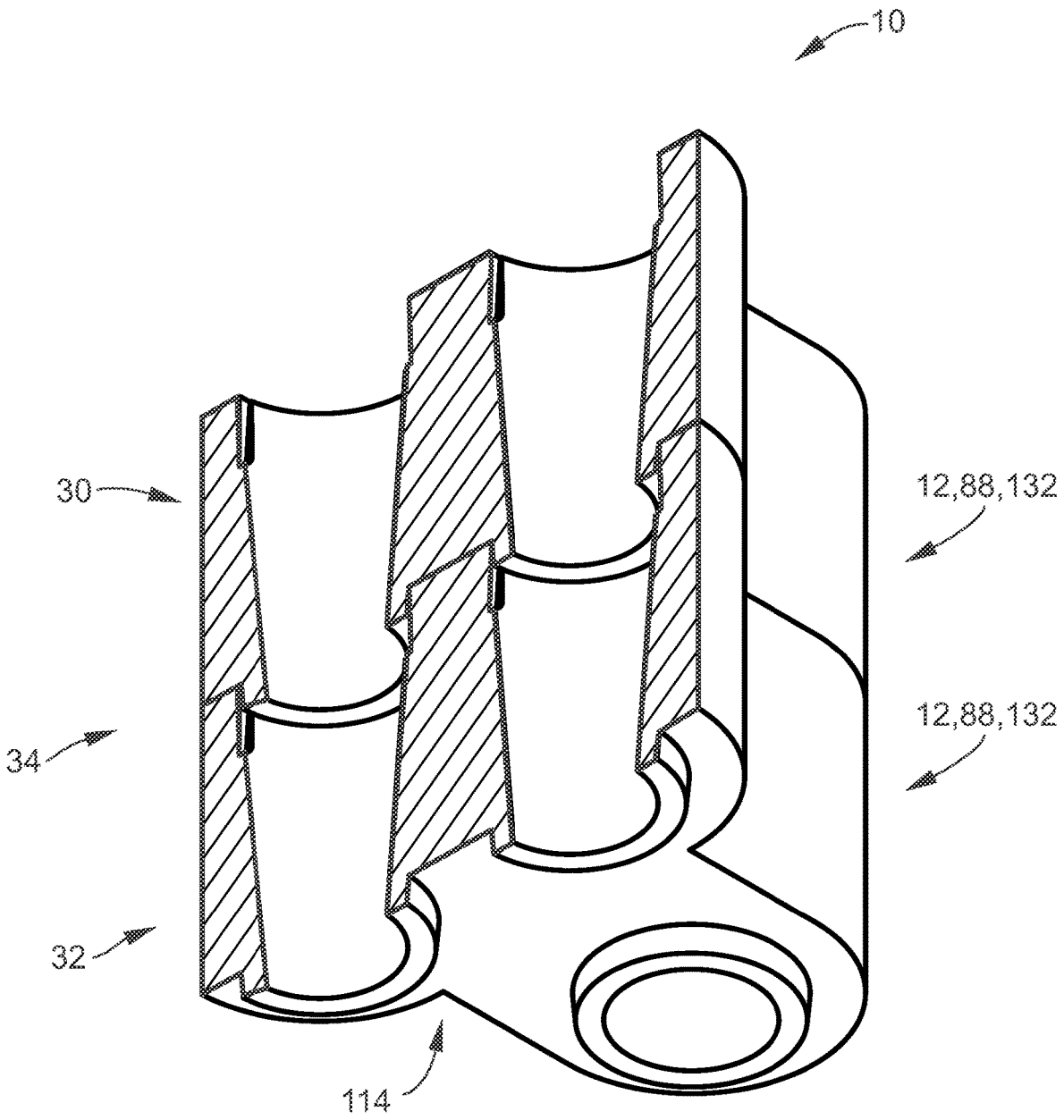
FIG. 32 is a cross-sectional bottom perspective view of the two rounded T-blocks from FIG. 30.
Figure 33:
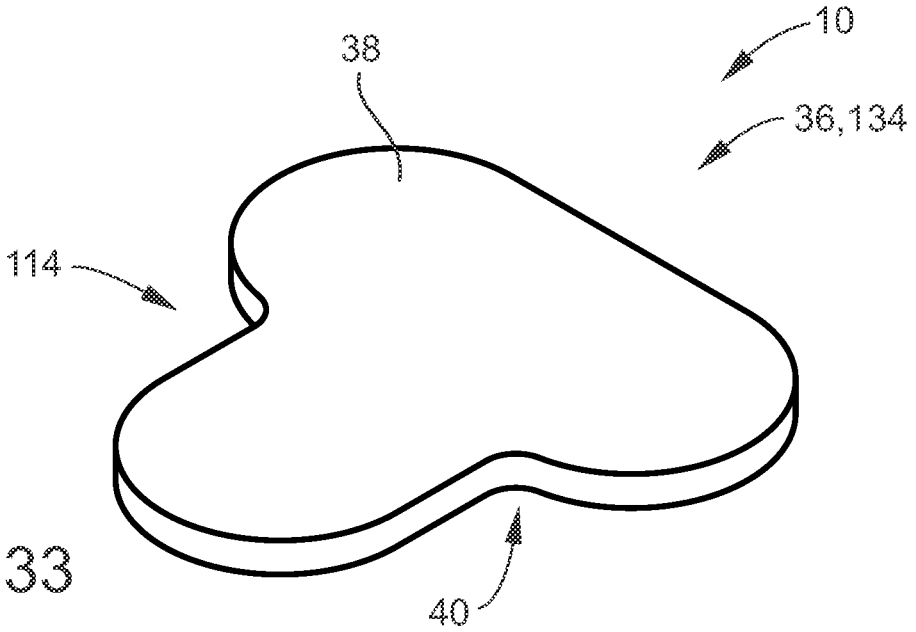
FIG. 33 is a top perspective view of a rounded T-cap for the rounded T-block from FIG. 21 for the interlocking blocking system according to select embodiments of the instant disclosure.
Figure 34:
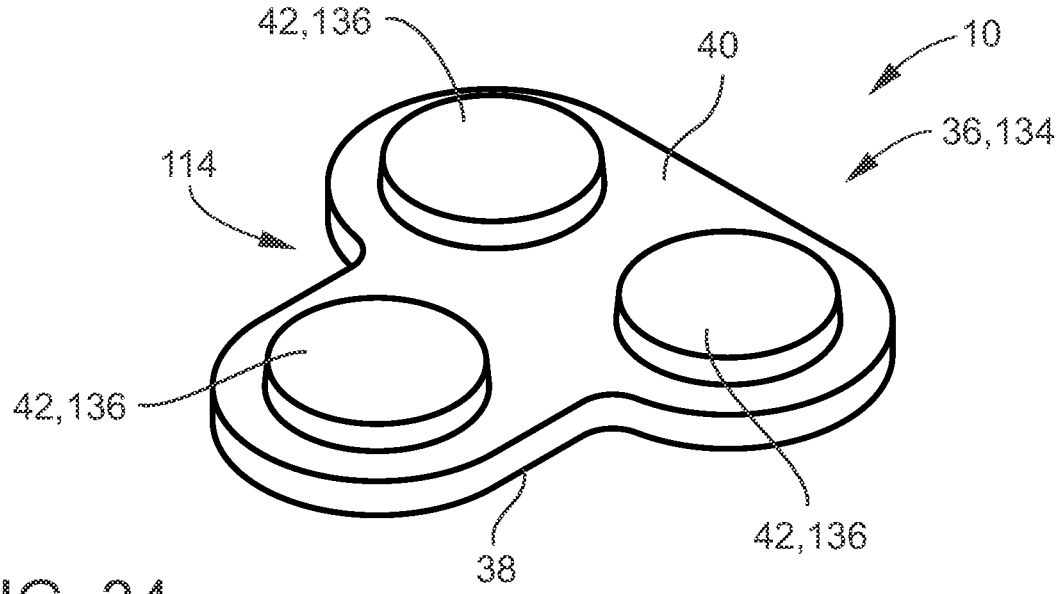
FIG. 34 is a bottom perspective view of the rounded T-cap from FIG. 33.
Figure 35:
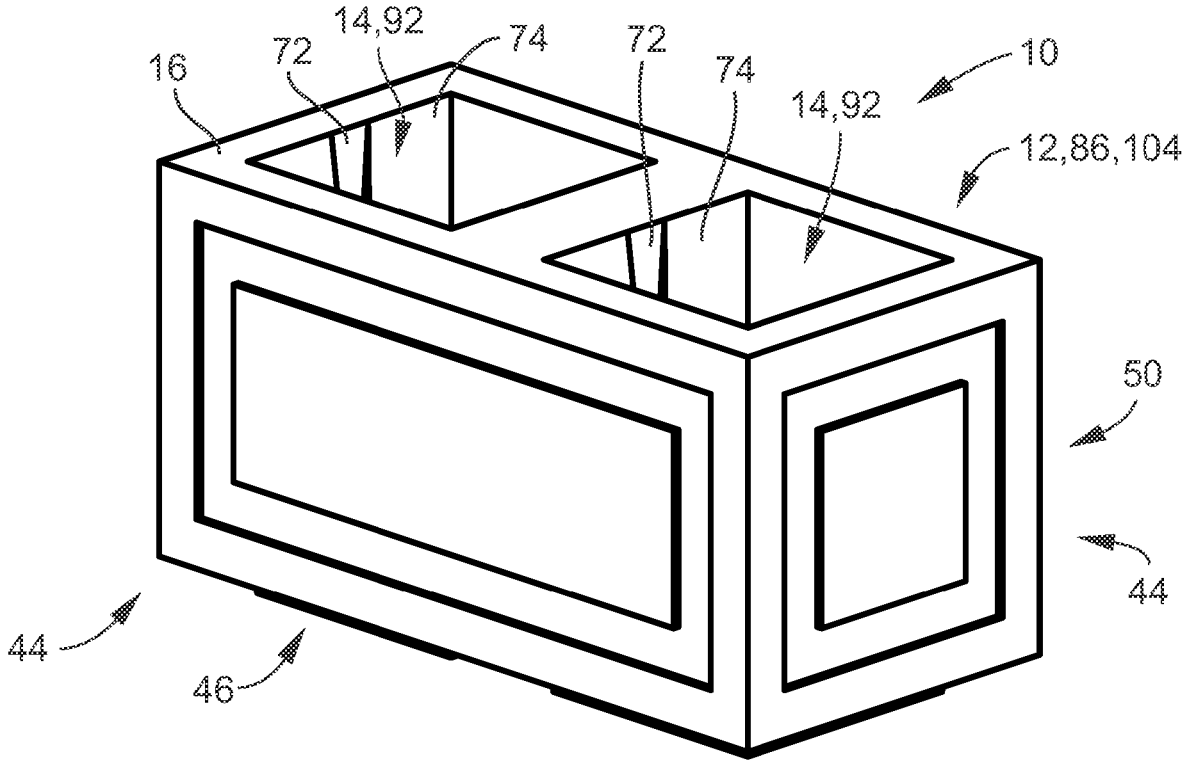
FIG. 35 is a top perspective view of a square 2×1 with face inserts block for the interlocking blocking system according to select embodiments of the instant disclosure.
Figure 36:
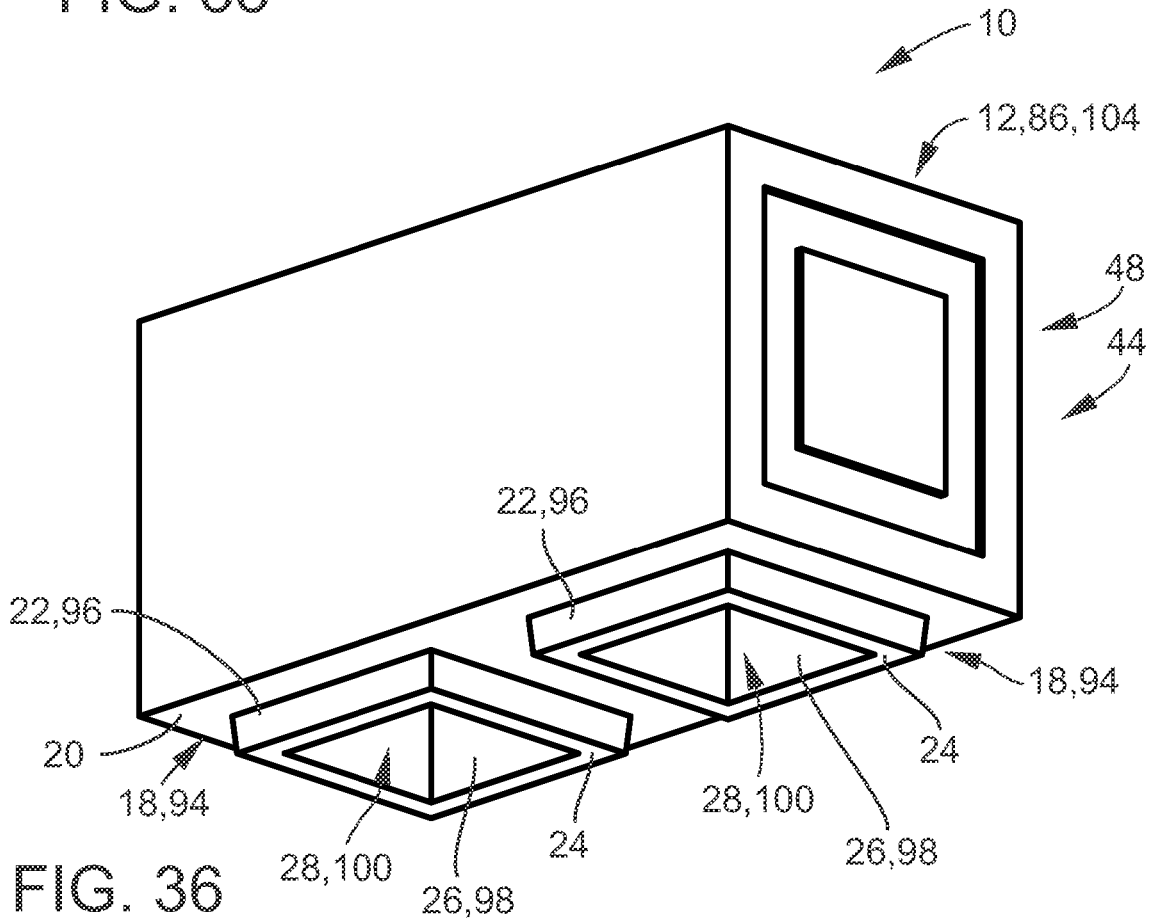
FIG. 36 is a bottom perspective view of the square 2×1 with face inserts block of FIG. 35.
Figure 37:
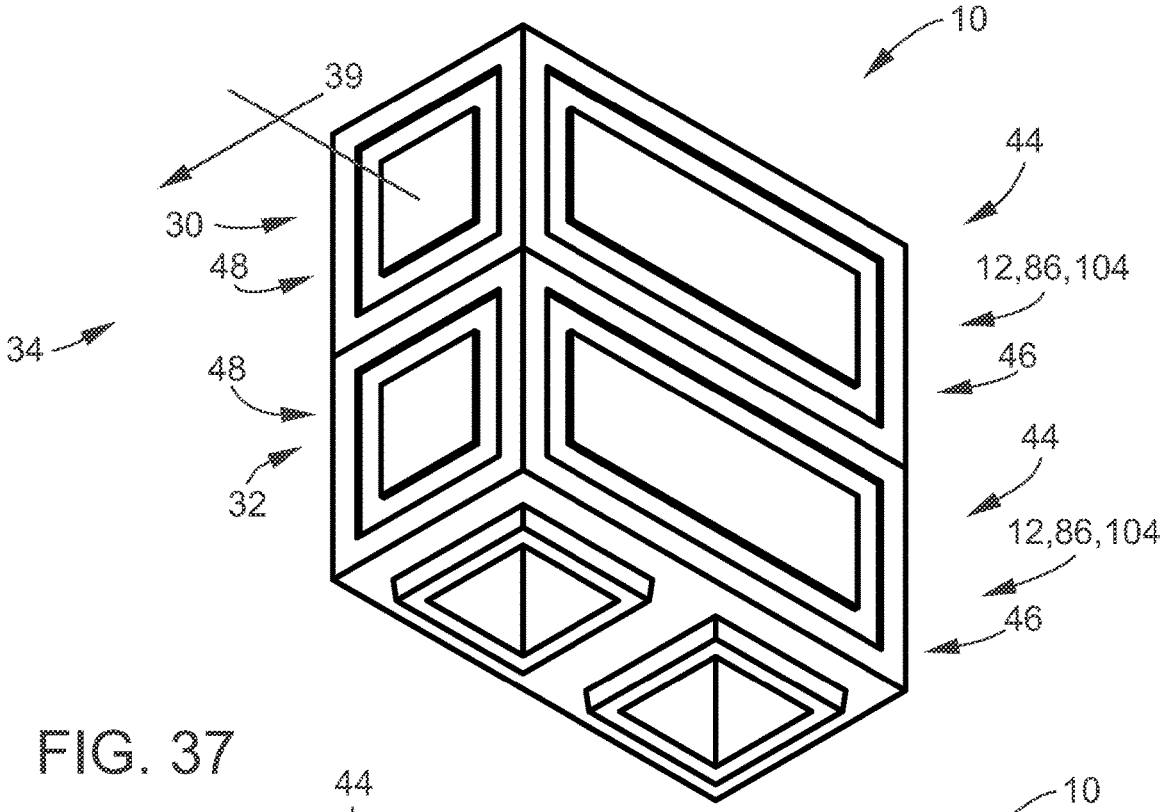
FIG. 37 is a bottom perspective view of two square 2×1 with face inserts blocks from FIG. 35 stacked on top of one another according to select embodiments of the interlocking blocking system of the instant disclosure.
Figure 38:
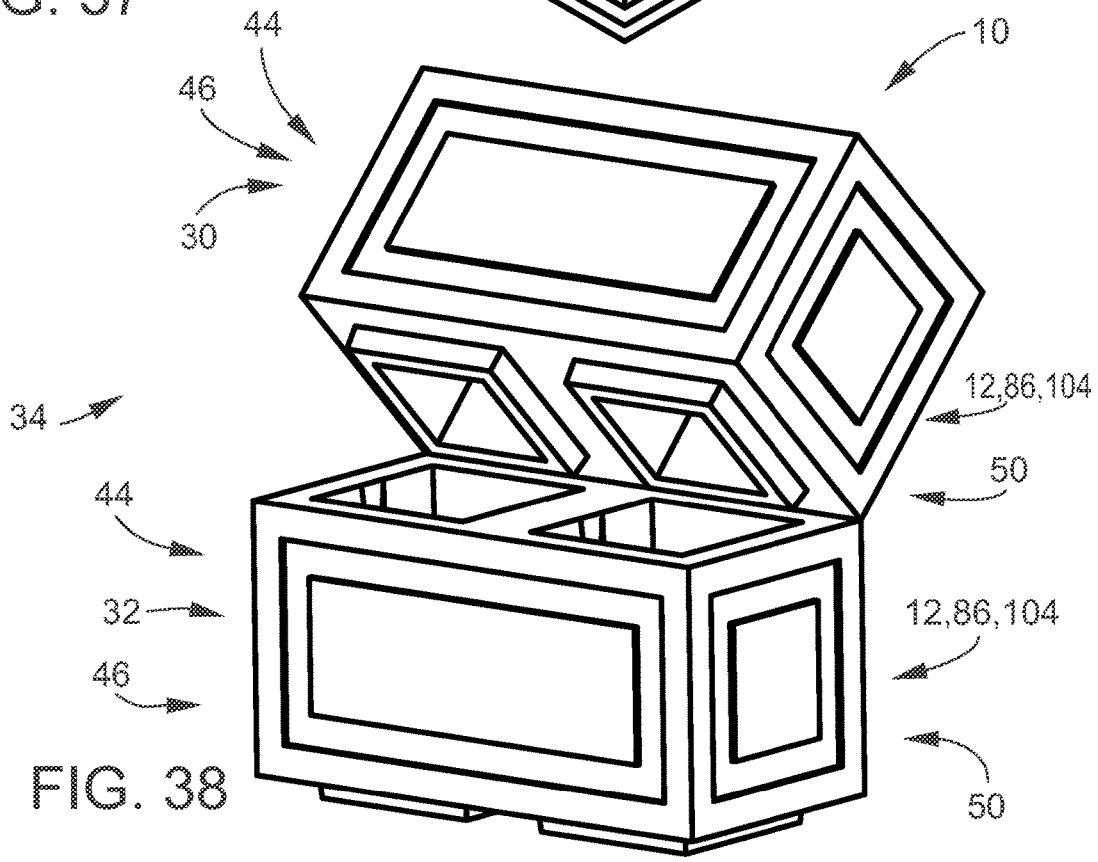
FIG. 38 is a perspective view of the two square 2×1 with face inserts blocks from FIG. 37 with the top block partially disassembled to show the interlocking element of the interlocking blocking system of the instant disclosure.
Figure 39:
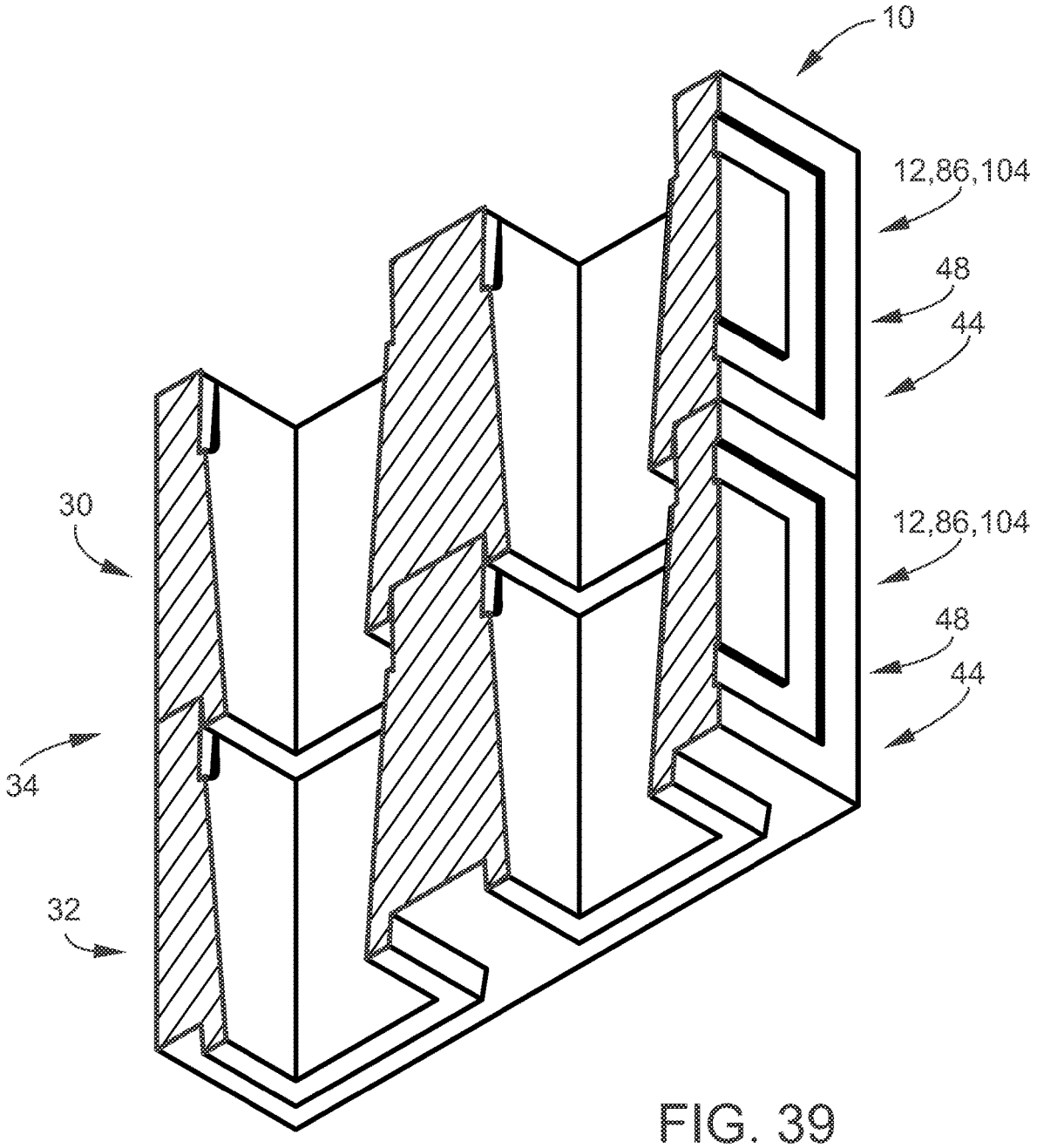
FIG. 39 is a cross-sectional bottom perspective view of the two square 2×1 with face inserts blocks from FIG. 37.
Figure 40:
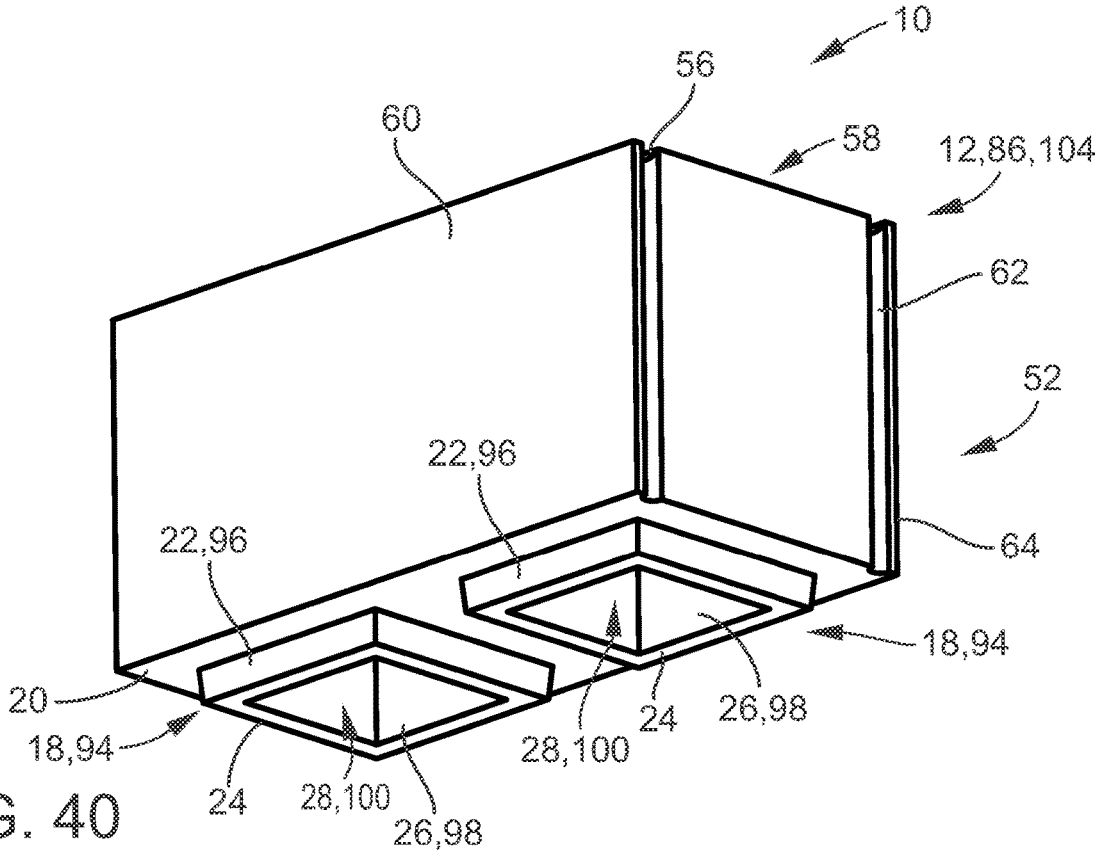
FIG. 40 is a bottom perspective view of a square 2×1 with grooves block for the interlocking blocking system according to select embodiments of the instant disclosure.
Figure 41:
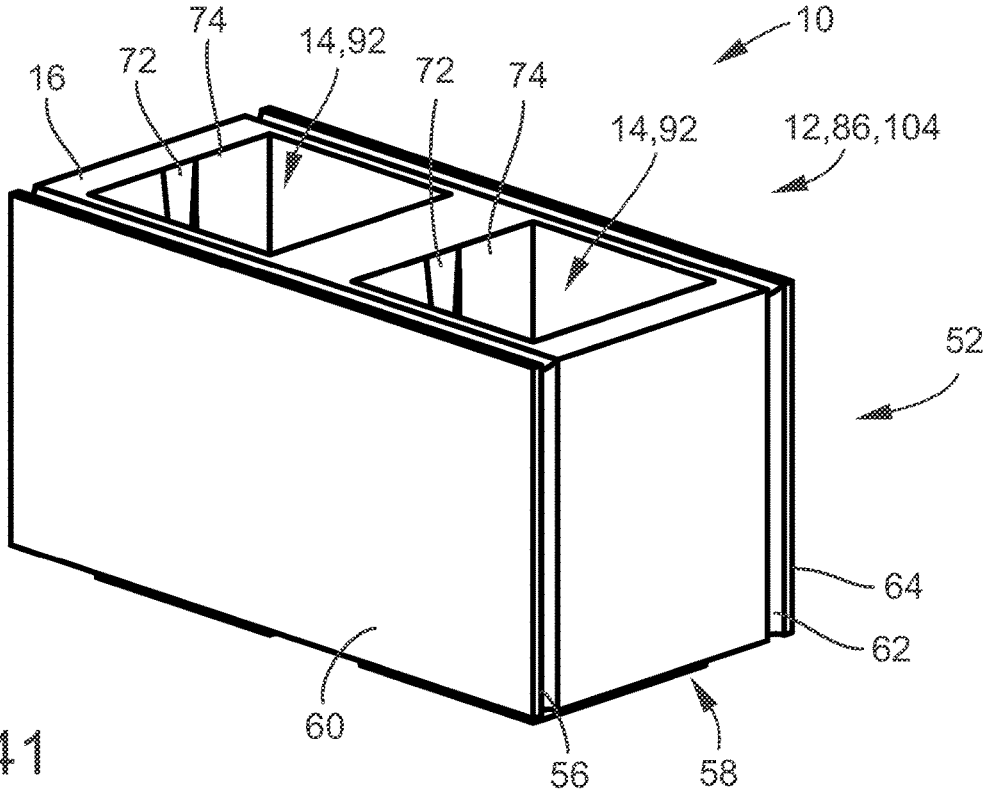
FIG. 41 is a top perspective view of the square 2×1 with grooves block of FIG. 40.

As shown in FIGS. 26, 27, 33, and 24, in select embodiments of interlocking blocking system 10 and/or retaining wall 34, cap 36 or a plurality of caps 36 may be included. Each cap 36 may be configured to interlock and cover top surface 16 of one of the interlocking blocks 12. Each cap 36 may include flat top face 38 and bottom face 40. Bottom face 40 may include tapered protrusion 42. Tapered protrusion 42 may be shaped and sized to match and fit inside of tapered opening 14 at top surface 16 of one of interlocking blocks 12. Referring now specifically to FIGS. 26 and 27, in select embodiments of interlocking blocking system 10, a plurality of rounded 2×1 caps 130 may be included. Each of the rounded 2×1 caps 130 may be configured to interlock and cover top surface 16 of one of the rounded 2×1 blocks 128 (see FIGS. 21-25). Each of the 2×1 rounded caps 130 may include flat top face 38 and bottom face 40. Bottom face 40 may include two rounded tapered protrusions 42. Each of the two rounded tapered protrusions 42 may be shaped and sized to match and fit inside of one of the rounded tapered openings 116 at the top surface of one of the rounded 2×1 blocks 128. Referring now specifically to FIGS. 33 and 34, in select embodiments of interlocking blocking system 10, a plurality of rounded T-caps 134 may be included. Each of the rounded T-caps 134 may be configured to interlock and cover top surface 16 of one of the rounded T-blocks 132 (see FIGS. 28-32). Each of the rounded T-caps 134 may include flat top face 38 and bottom face 40. Bottom face 40 may include three rounded tapered protrusions in T-formation 114. Each of the rounded tapered protrusions 136 may be shaped and sized to match and fit inside of one of the rounded tapered openings 116 at the top surface 16 of one of the rounded T-blocks 132.

Referring now to FIGS. 35-39, in select embodiments of interlocking blocking system 10, and/or retaining wall 34, each of the plurality of interlocking blocks 12 may include optional decorative face inserts 44. Decorative face inserts 44 may be on at least front side 46, left side 48, right side 50, or any various combinations thereof. Decorative face inserts 44 may be configured to provide for texture or patterning of any visible block faces. Decorative face inserts 44 may be created by providing various molding panels to create various designs and/or configurations in the faces or outside surfaces of interlocking blocks 12.

Figure 42:
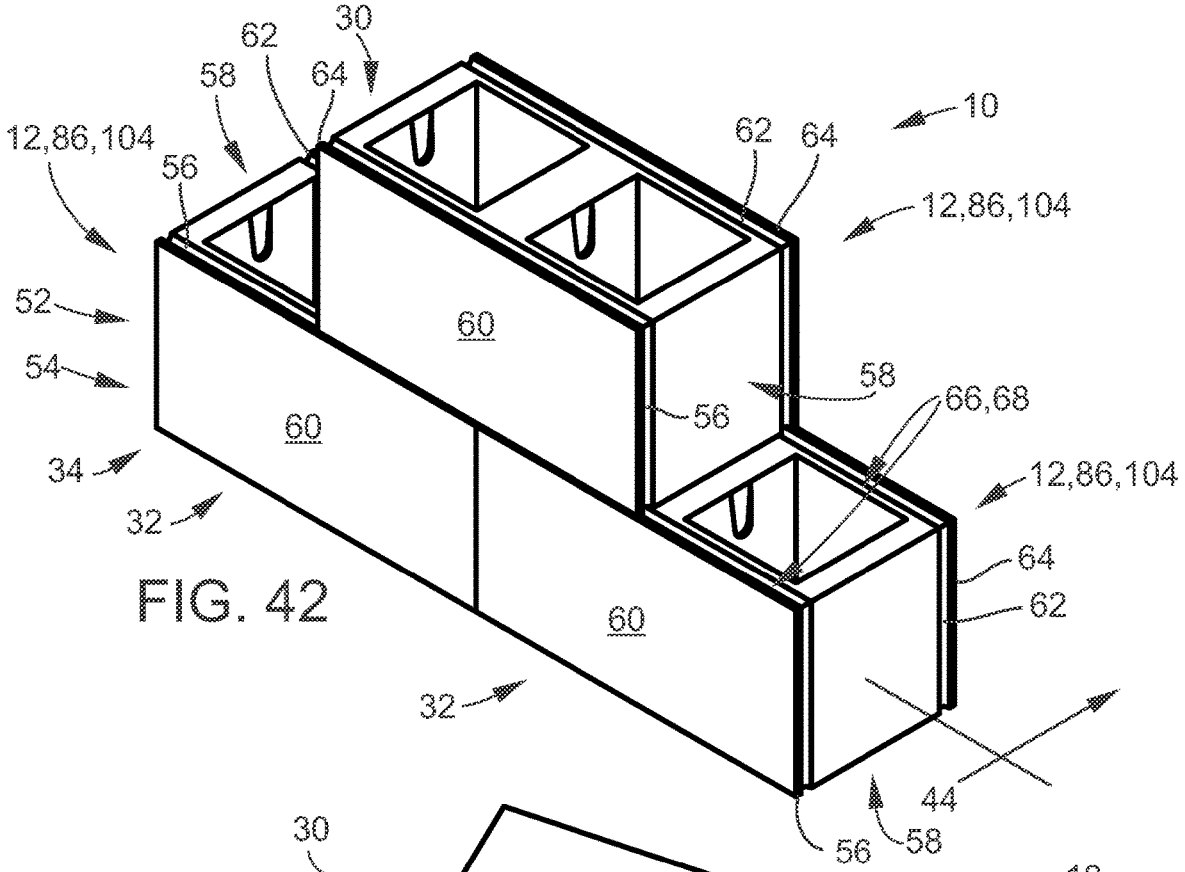
FIG. 42 is a top perspective view of three square 2×1 with grooves blocks from FIG. 40 stacked on top of one another according to select embodiments of the interlocking blocking system of the instant disclosure.
Figure 43:
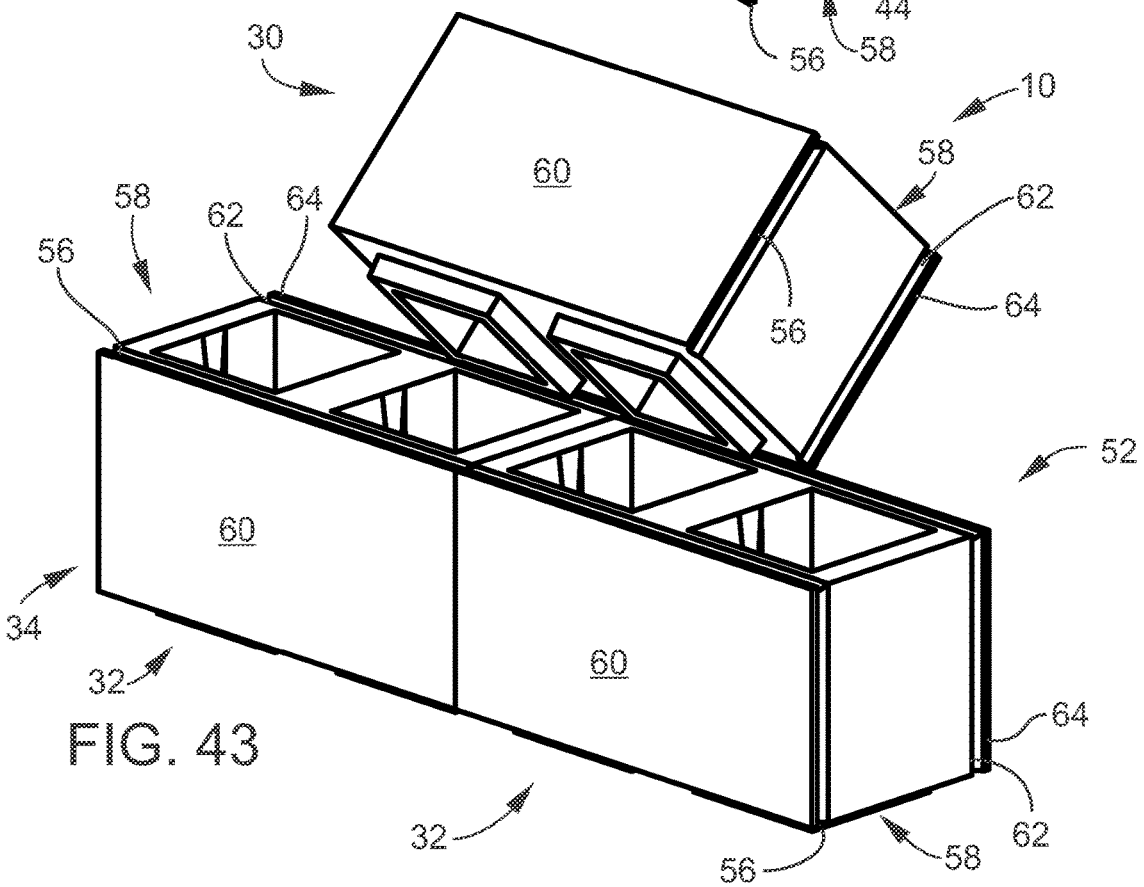
FIG. 43 is a perspective view of the three square 2×1 with grooves blocks from FIG. 42 with the top block partially disassembled to show the interlocking element of the interlocking blocking system of the instant disclosure.
Figure 44:
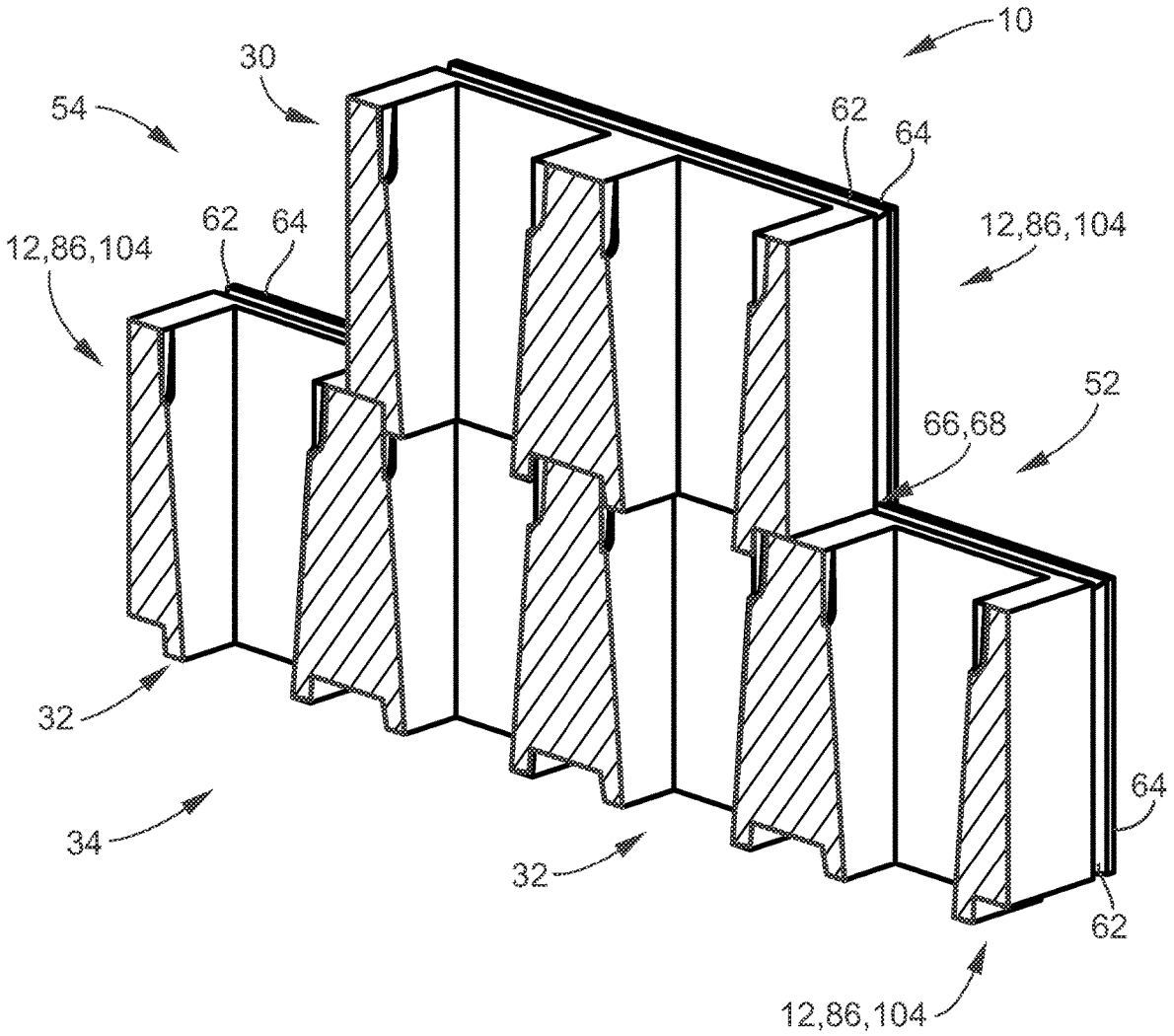
FIG. 44 is a cross-sectional top perspective view of the three square 2×1 with grooves blocks from FIG. 42.
Figure 45:
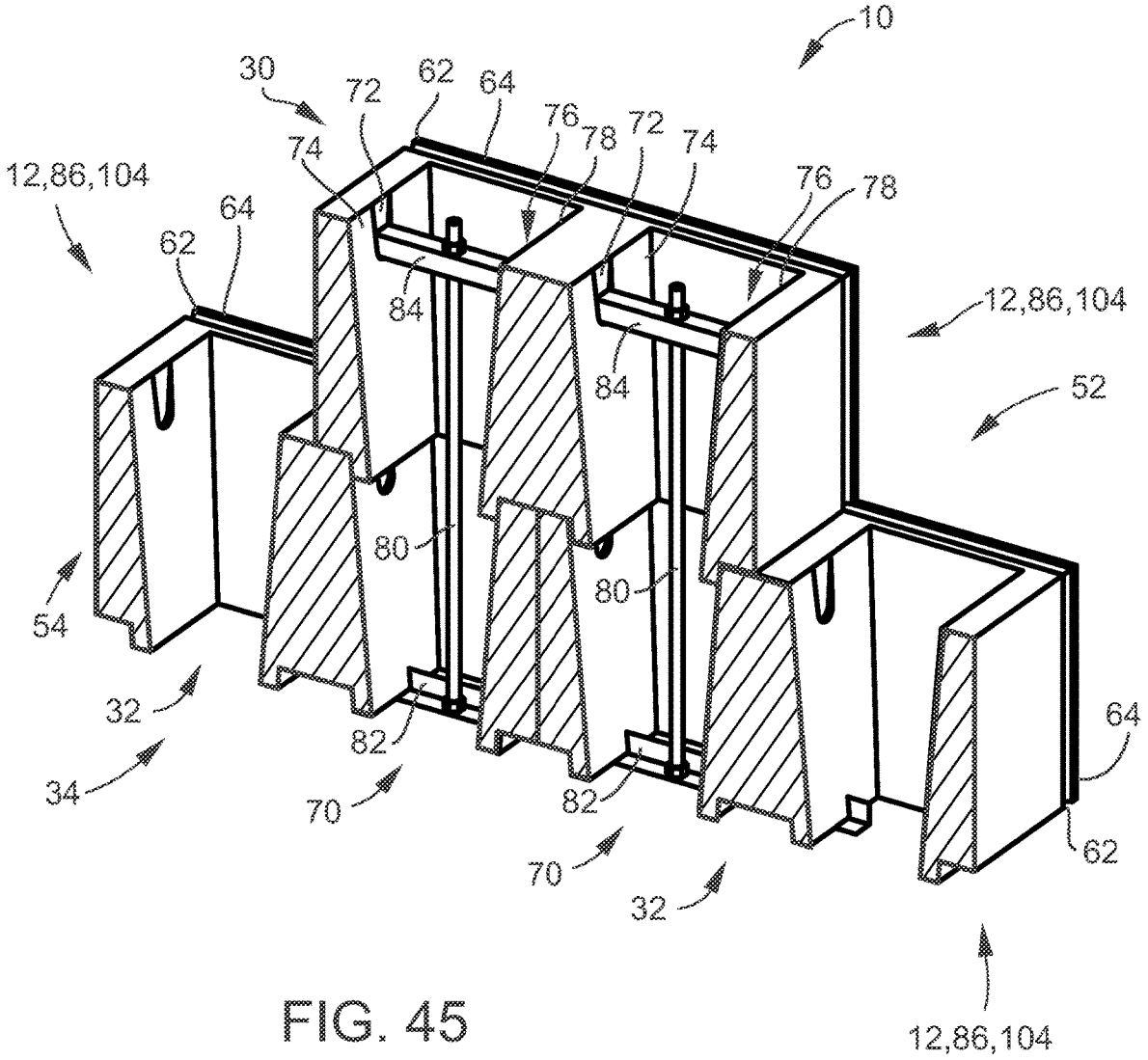
FIG. 45 is another cross-sectional top perspective view of the three square 2×1 with grooves blocks from FIG. 42 stacked together and held in place with a tie down system according to select embodiments of the instant disclosure.
Figure 46:
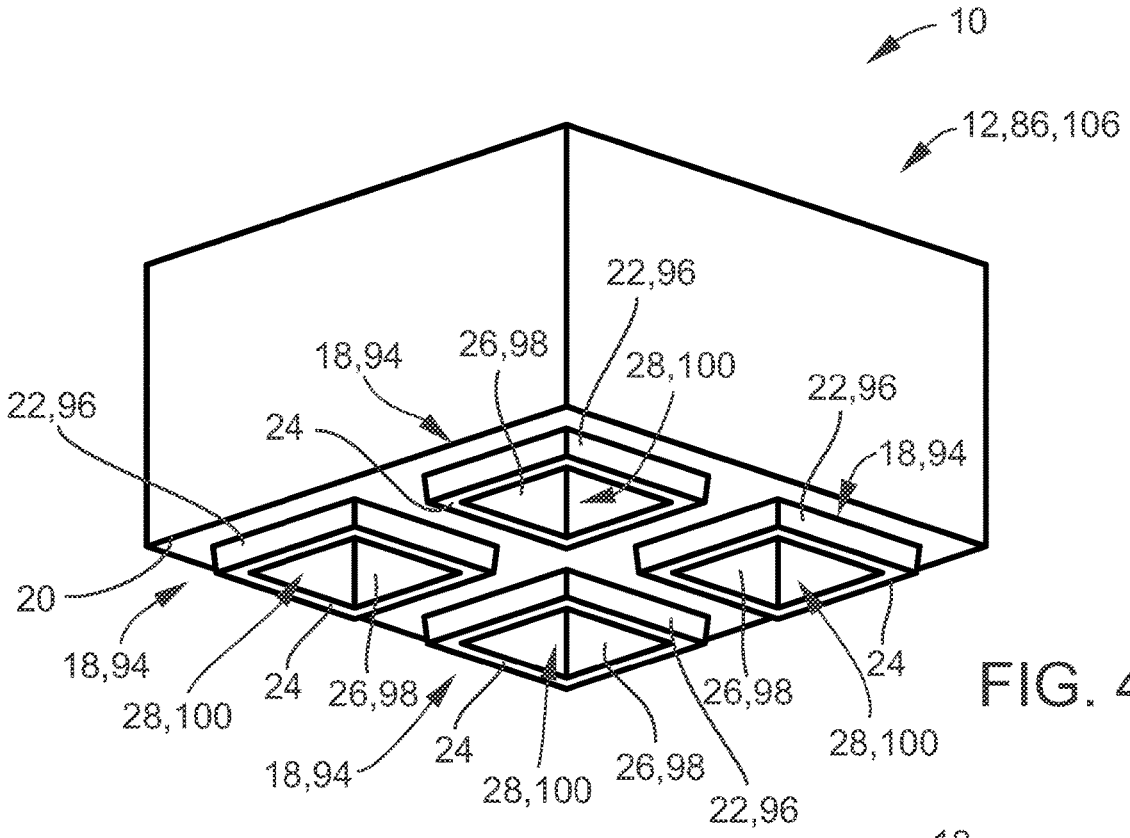
FIG. 46 is a bottom perspective view of a square 2×2 block for the interlocking blocking system according to select embodiments of the instant disclosure.
Figure 47:
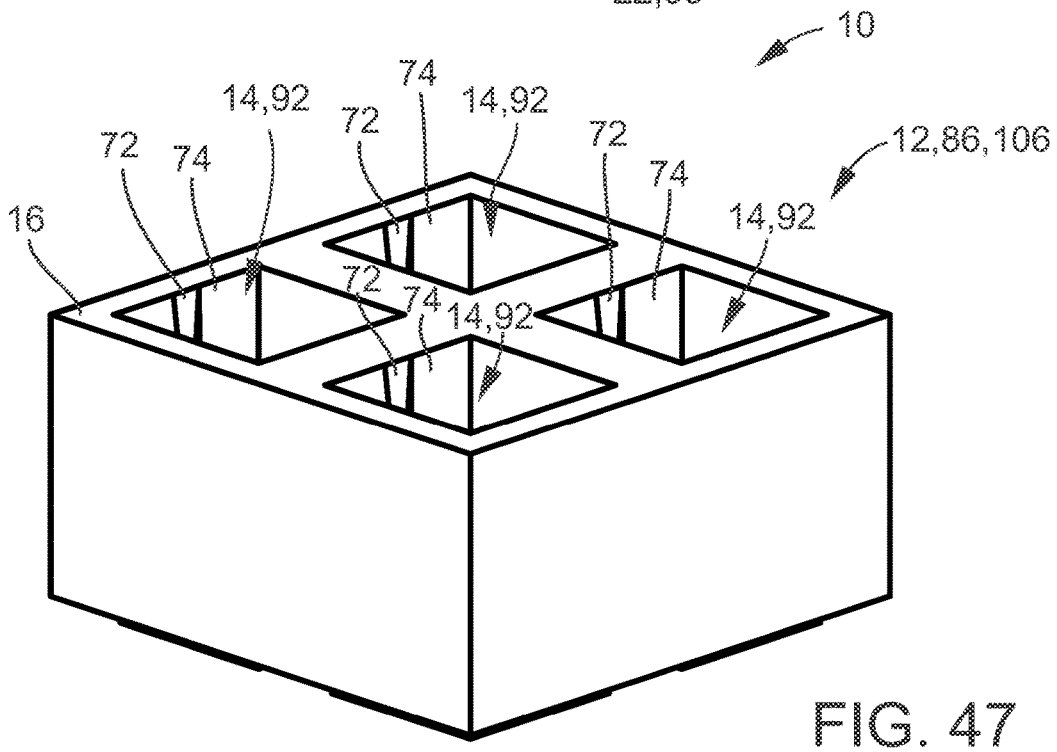
FIG. 47 is a top perspective view of the square 2×2 block of FIG. 46.
Figure 48:
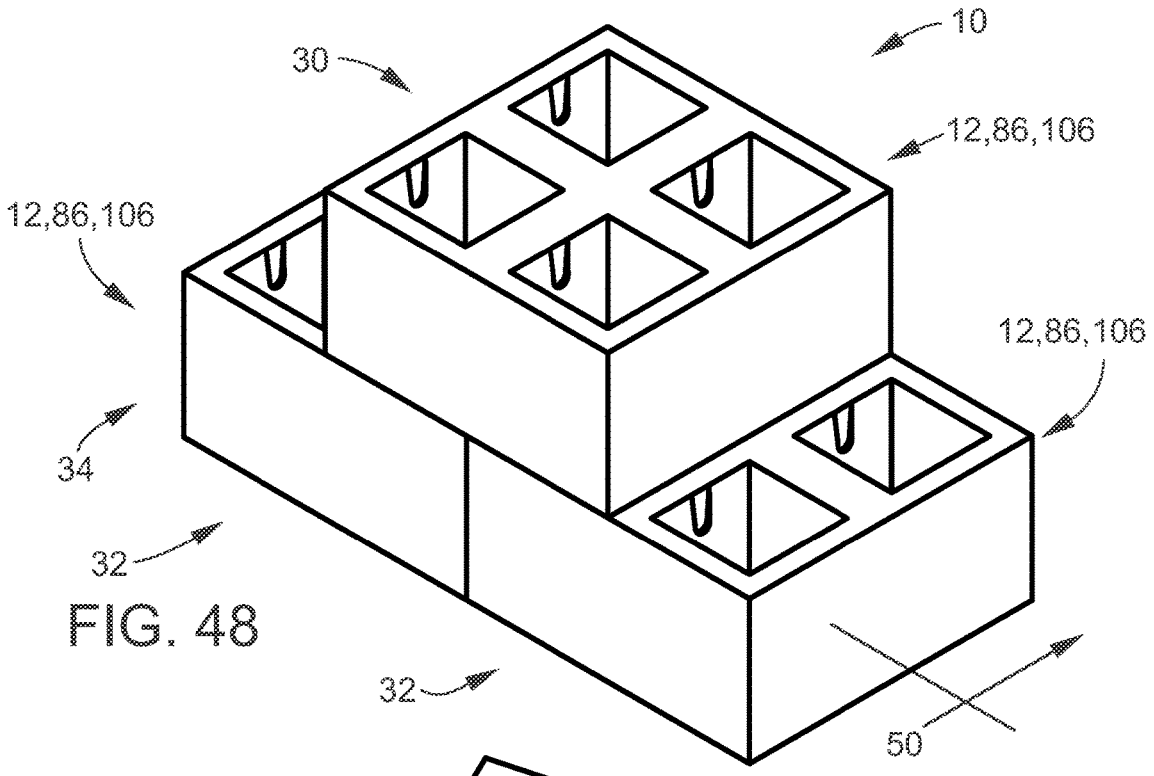
FIG. 48 is a top perspective view of three square 2×2 blocks from FIG. 46 stacked on top of one another according to select embodiments of the interlocking blocking system of the instant disclosure.
Figure 49:
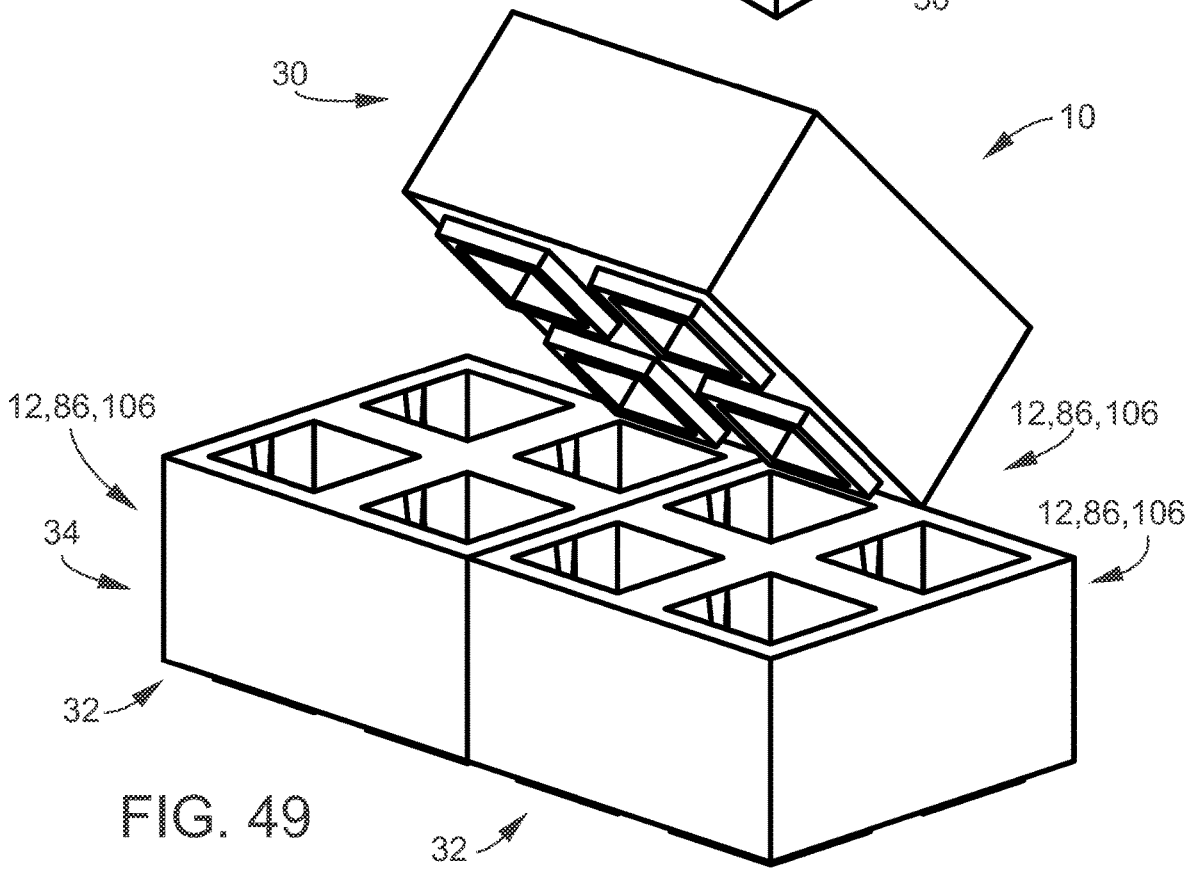
FIG. 49 is a perspective view of the three square 2×2 blocks from FIG. 48 with the top block partially disassembled to show the interlocking element of the interlocking blocking system of the instant disclosure.
Figure 50:
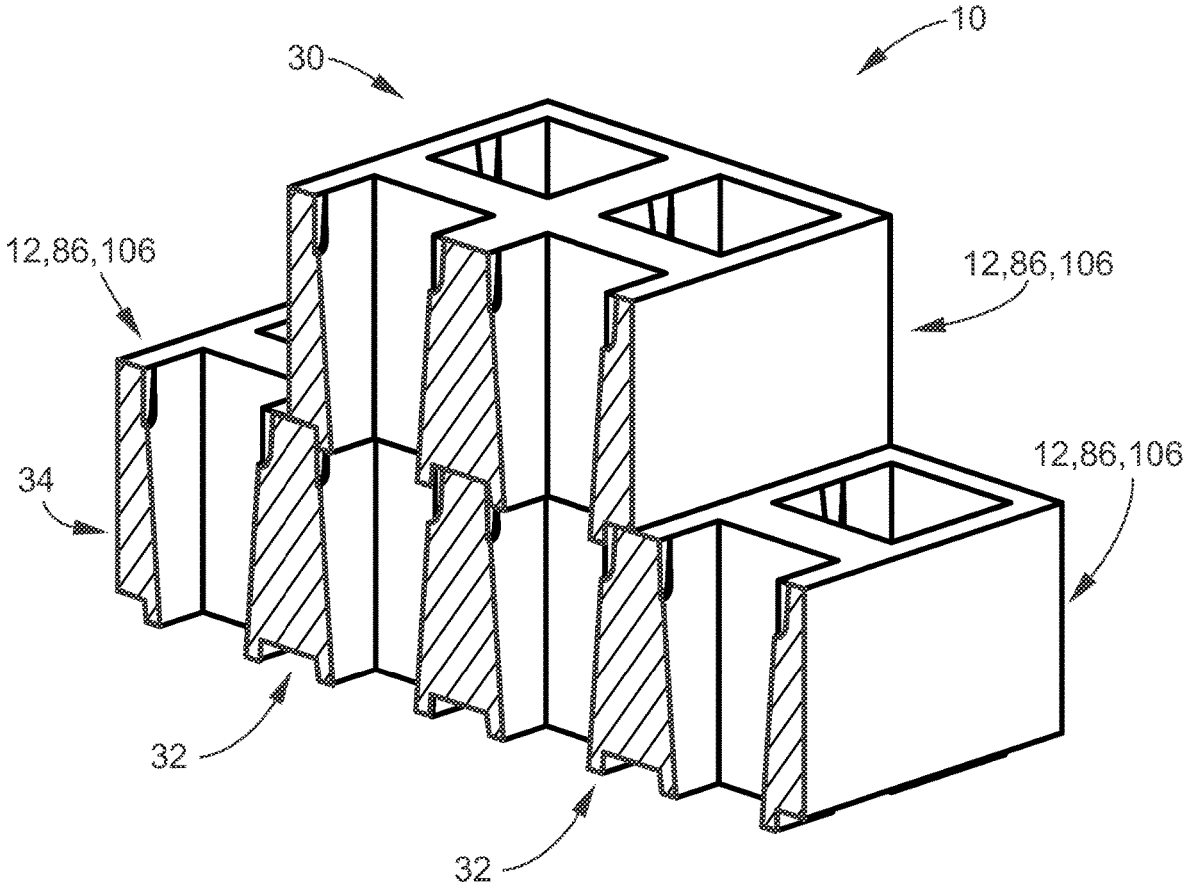
FIG. 50 is a cross-sectional top perspective view of the three square 2×1 with grooves blocks from FIG. 48.
Figure 51:
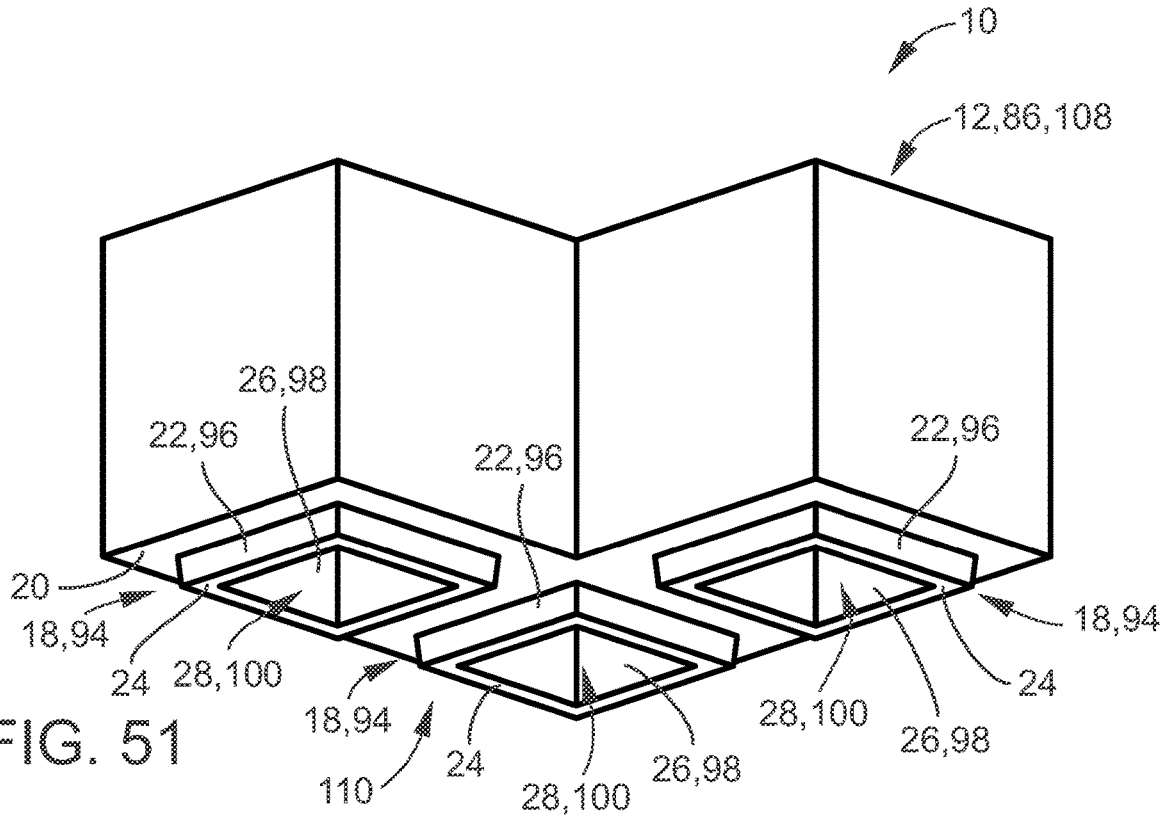
FIG. 51 is a bottom perspective view of a square L-block for the interlocking blocking system according to select embodiments of the instant disclosure.
Figure 52:
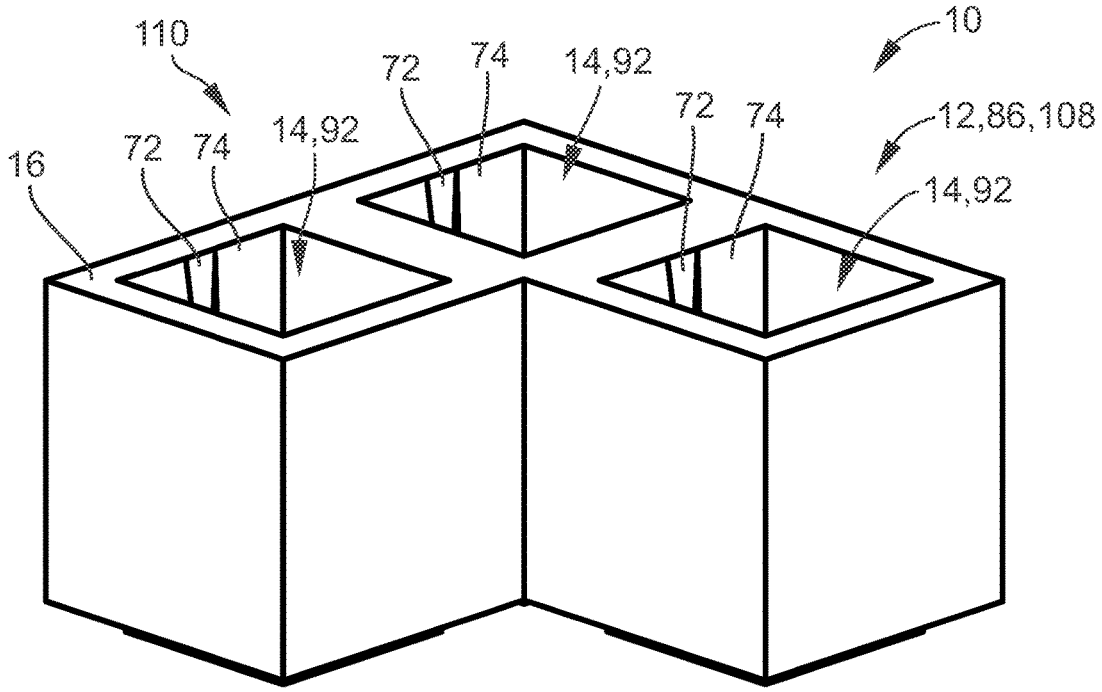
FIG. 52 is a top perspective view of the square L-block of FIG. 51.
Figure 53:
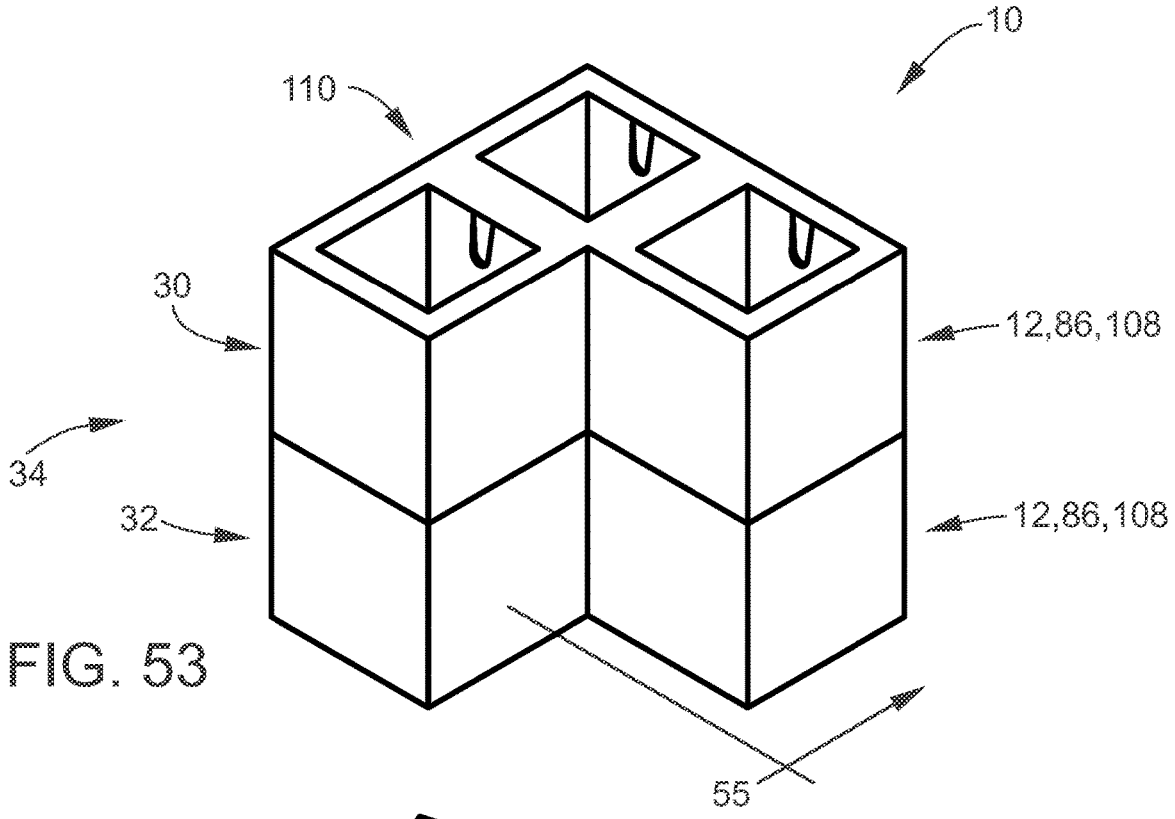
FIG. 53 is a top perspective view of two square L-blocks from FIG. 51 stacked on top of one another according to select embodiments of the interlocking blocking system of the instant disclosure.
Figure 54:
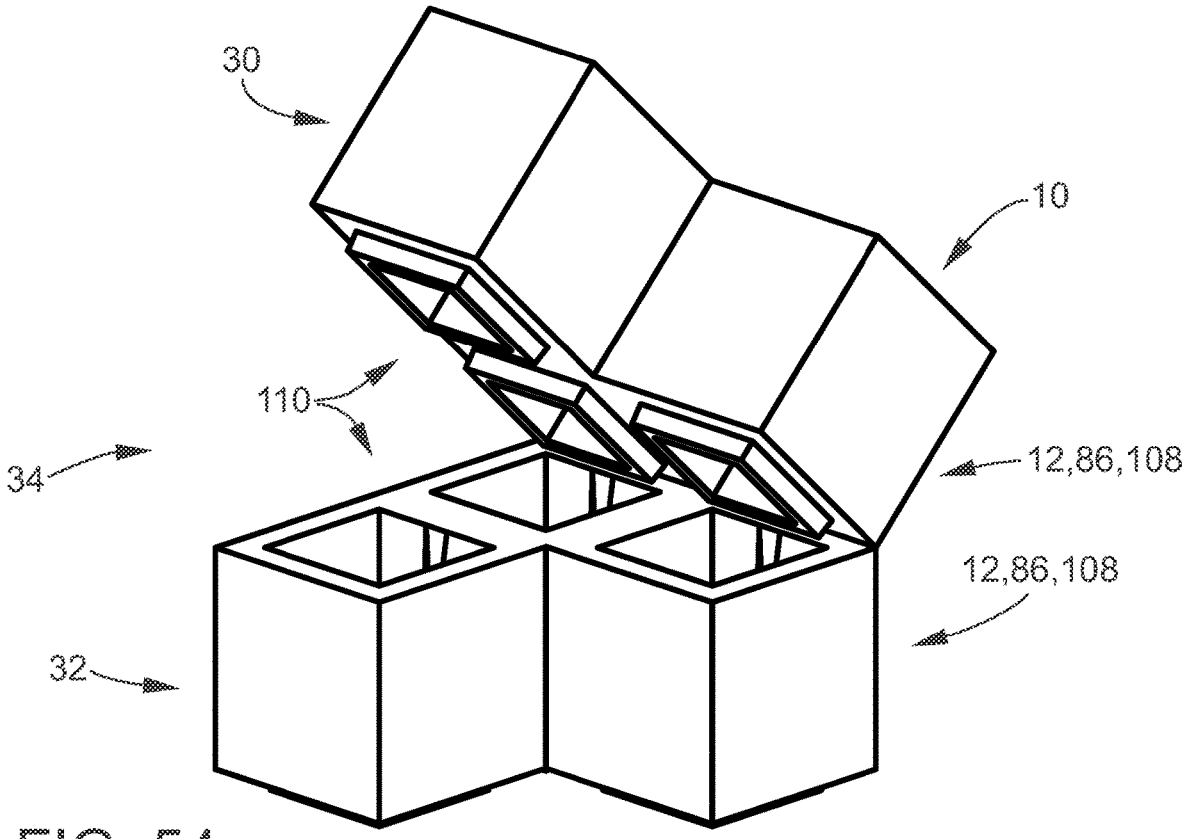
FIG. 54 is a perspective view of the two square L-blocks from FIG. 53 with the top block partially disassembled to show the interlocking element of the interlocking blocking system of the instant disclosure.
Figure 55:
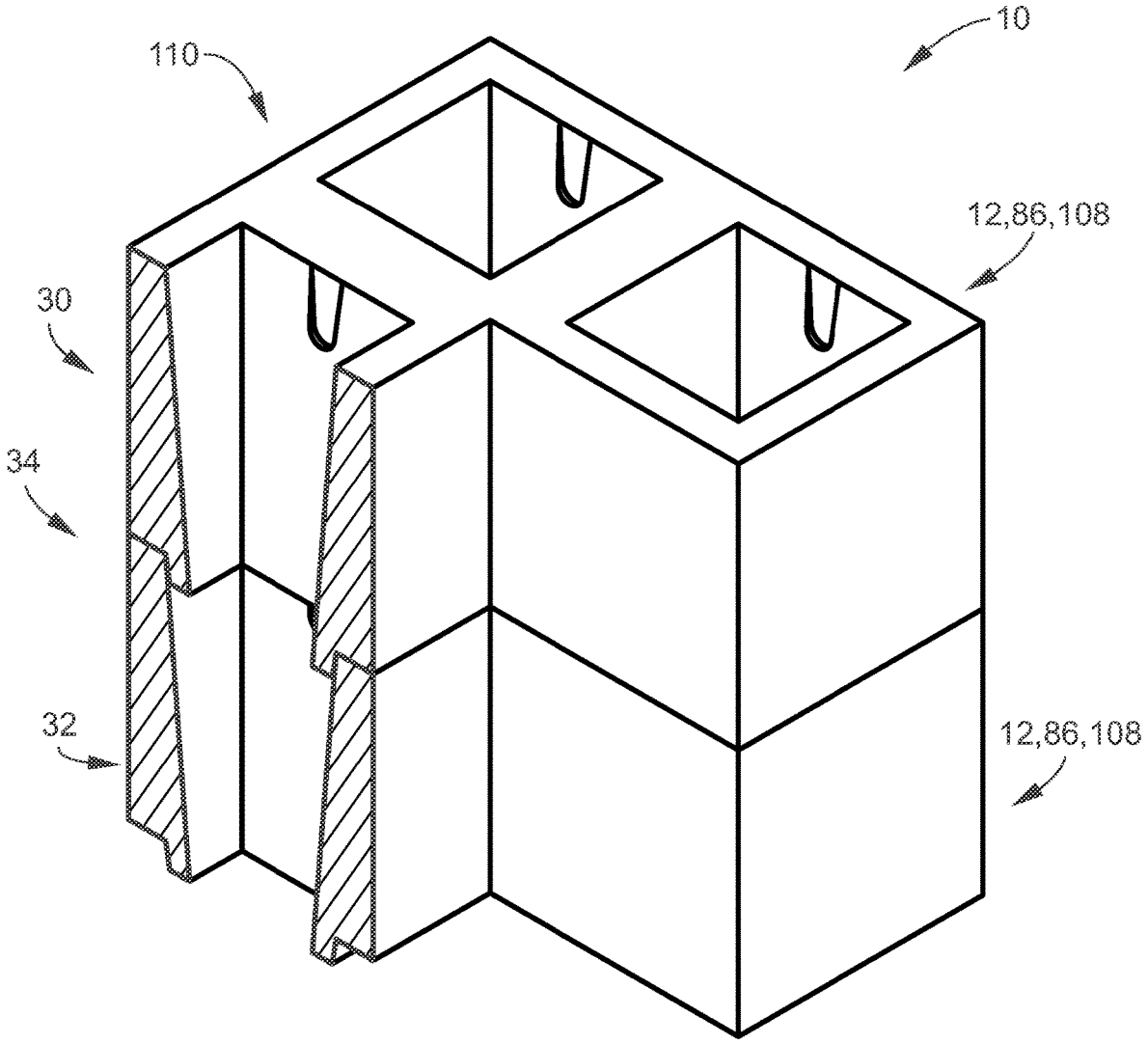
FIG. 55 is a cross-sectional top perspective view of the two square L-blocks from FIG. 53.

Referring now to FIGS. 41-45, in select embodiments of interlocking blocking system 10, and/or retaining wall 34, optional sealing system 52 may be included. Sealing system 52 may be for creating sealed structure or sealed wall 54, as shown in FIGS. 42, 43 and 45. Sealing system 52 may include any devices, means or mechanisms for sealing the plurality of interlocking blocks 12 together. In select embodiments of sealing system 52 for interlocking blocking system 10, front groove 56 and/or back groove 62 may be included. Front groove 56 may be around periphery 58 of each of the interlocking blocks 12 approximate front 60. Back groove 62 may be around periphery 58 of each of the interlocking blocks 12 approximate back 64. Expanding material 66 may be included with sealing system 52. Expanding material 66 may be inserted into front groove 56 and/or back groove 62. Expanding material 66 may be configured to be inserted into front groove 56 and/or back groove 62 and expanded against top block 30 and bottom block 32 for sealing the plurality of interlocking blocks 12 with one another via front groove 56, back groove 62, or the combinations thereof. Expanding material 66 may be any material configured to seal to create a seal between top block 30 and bottom block 32 via front groove 56 and/or back groove 62. In select embodiments, expanding material 66 may be expanding foam 68.

Referring now specifically to FIG. 45, in select embodiments of interlocking blocking system 10, and/or retaining wall 34, tie down system 70 may optionally be included. Tie down system 70 may be for tying down top block 30 to bottom block 32 or for tensioning top block 30 onto bottom block 32. As such, tie down system 70 may be configured for securely tying down top block 30 to bottom block 32, which may aid in reinforcing the structure, like retaining wall 34 and/or tie down system 70 may be for aiding in sealing top block 30 to bottom block 32, like for sealing system 52 noted above and shown in FIG. 45. Tie down system 70 may include any devices, means, mechanisms, or methods for tying down top block 30 to bottom block 32. In select embodiments, tie down system 70 may include first indentation 72 and second indentation 76. First indentation 72 may be on first side 74 of hollow tapered inside 28 extending down from tapered opening 14 at top surface 16. Likewise, second indentation 76 may be on opposing second side 78 of hollow tapered inside 28 extending down from tapered opening 14 at top surface 16 matching first indentation 72. Tie down rod 80 may extend from first bracket 82 positioned below bottom surface 20 of bottom block 32 through tapered hollow interior 28 of bottom block 32 up tapered hollow interior 28 of top block 30 to second bracket 84 positioned in between first indentation 72 and second indentation 76. In select embodiments, tie down rod 80 may be configured to be tightened thereby putting tension between top block 30 and bottom block 32. As shown in FIG. 45, tie down rod 80 may include a threaded end, whereby a threaded nut may be used for tightening or tensioning tie down rod 80 between top block 30 and bottom block 32.

Referring now to FIGS. 10, 15, 25, 32, 39, 44, 45, and 50, another feature of interlocking blocking system 10 may be that, for blocks 12 with multiple hollow tapered insides 28, first indentation 72 on first side 74 of a first hollow tapered inside 28, and second indentation 76 on second side 78 of an adjacent second hollow tapered inside 28, may create a non-tapered or flat surface between the adjacent hollow tapered insides 28. This non-tapered or flat surface between adjacent hollow tapered insides 28 may provide for a gripping surface for lifting, moving and/or manipulating such blocks 12 with multiple hollow tapered insides 28. As an example, and clearly not limited thereto, a scissor type lift or lifting device may be used to clamp down on such a non-tapered or flat surface between adjacent hollow tapered insides 28 for lifting, moving and/or manipulating such blocks 12 with multiple hollow tapered insides 28.

Referring now to FIGS. 1-10, and 45-58, in select embodiments of the disclosed interlocking blocking system 10, and/or retaining wall 34, a plurality of square blocks 86 may be included. Square blocks 86 may be directed to interlocking blocks 12 that interlock via a square interface between top block 30 and bottom block 32. Thus, each of the square blocks 86 may include square tapered opening 92, square protruding bottom 94, and square hollow tapered inside 100. Square tapered opening 92 may be through top surface 16 of square block 86. Square protruding bottom 94 may extend beyond bottom surface 20 of square block 86. Square protruding bottom 94 may include square tapered outer surface 96, thickness 24, and square inner tapered surface 98. Square hollow tapered inside 100 may extend from square tapered opening 92 on top surface 16 and may taper into square inner tapered surface 98 of square protruding bottom 94. Square tapered outer surface 96 of square protruding bottom 94 may be shaped and sized to match and fit inside of square tapered opening 92 at top surface 16 of square block 86.

Referring now specifically to FIGS. 1-5, in select embodiments of interlocking blocking system 10, and/or retaining wall 34, plurality of square 1×1 blocks 102 may be included. Each of the square 1×1 blocks 102 may include square tapered opening 92, square protruding bottom 94, and square hollow tapered inside 100. Square tapered opening 92 may be through top surface 16 of square 1×1 block 102. Square protruding bottom 94 may extend beyond bottom surface 20 of square 1×1 block 102. Square protruding bottom 94 may include square tapered outer surface 96, thickness 24, and square inner tapered surface 98. Square hollow tapered inside 100 may extend from square tapered opening 92 on top surface 16 and may taper into square inner tapered surface 98 of the square protruding bottom 94. The square tapered outer surface 96 of the square protruding bottom 94 may be shaped and sized to match and fit inside of the square tapered opening 92 at the top surface of square 1×1 block 102.

Referring now specifically to FIGS. 7-10, 35-39, and 40-45, in select embodiments of interlocking blocking system 10, and/or retaining wall 34, plurality of square 2×1 blocks 104 may be included. Each of the square 2×1 blocks 104 may include two square tapered openings 92, two square protruding bottoms 94, and two square hollow tapered insides 100. The two square tapered openings 92 may be through the top surface of square 2×1 block 104. The two square protruding bottoms 94 may extend beyond bottom surface 20 of square 2×1 block 104. Each of the two square protruding bottoms 94 may include square tapered outer surface 96, thickness 24, and square inner tapered surface 98. Each of the two square hollow tapered insides 100 may extend from one of the square tapered openings 92 on top surface 16 and taper into one of the square inner tapered surfaces 98 of one of the square protruding bottoms 94. Each of the square tapered outer surfaces 96 of the two square protruding bottoms 94 may be shaped and sized to match and fit inside of one of the square tapered openings 92 at top surface 16 of square 2×1 block 104.

Referring now specifically to FIGS. 47-50, in select embodiments of interlocking blocking system 10, and/or retaining wall 34, plurality of square 2×2 blocks 106 may be included. Each of the square 2×2 blocks 106 may include four square tapered openings 92, four square protruding bottoms 94, and four square hollow tapered insides 100. The four square tapered openings 92 may be through top surface 16 of square 2×2 block 106. The four square protruding bottoms 94 may extend beyond bottom surface 20 of square 2×2 block 106. Each of the four square protruding bottoms 94 may include square tapered outer surface 96, thickness 24, and square inner tapered surface 98. Each of the four square hollow tapered insides 100 may extend from one of the square tapered openings 92 on top surface 16 and taper into one of the square inner tapered surfaces 98 of one of the square protruding bottoms 94. Each of the square tapered outer surfaces 96 of the four square protruding bottoms 94 may be shaped and sized to match and fit inside of one of the square tapered openings 92 at top surface 16 of square 2×2 block 106.

Referring now specifically to FIGS. 52-55, in select embodiments of interlocking blocking system 10, and/or retaining wall 34, a plurality of square L-blocks 108 may be included. Each of the square L-blocks 108 may include three square tapered openings 92 in L-formation 110, three square protruding bottoms 94 in L-formation 110, and three square hollow tapered insides 100 in L-formation 110. The three square tapered openings 92 may be through top surface 16 of square L-block 108. The three square protruding bottoms 94 may extend beyond bottom surface 20 of square L-block 108. Each of the three square protruding bottoms 94 may include square tapered outer surface 96, thickness 24, and square inner tapered surface 98. Each of the three square hollow tapered insides 100 may extend from one of the square tapered openings 92 on top surface 16 and taper into one of the square inner tapered surfaces 98 of one of the square protruding bottoms 94. Each of the square tapered outer surfaces 96 of the three square protruding bottoms 94 may be shaped and sized to match and fit inside of one of the square tapered openings 92 at top surface 16 of square L-block 108.

Figure 56:
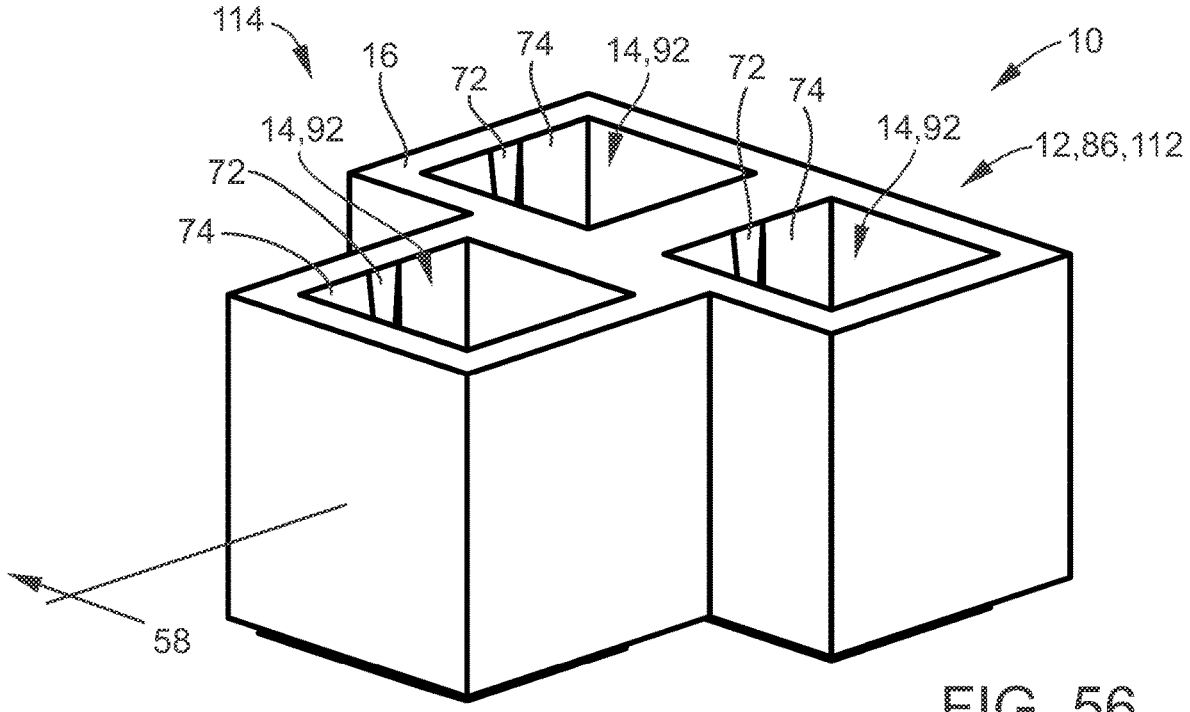
FIG. 56 is a top perspective view of a square T-block for the interlocking blocking system according to select embodiments of the instant disclosure.
Figure 57:
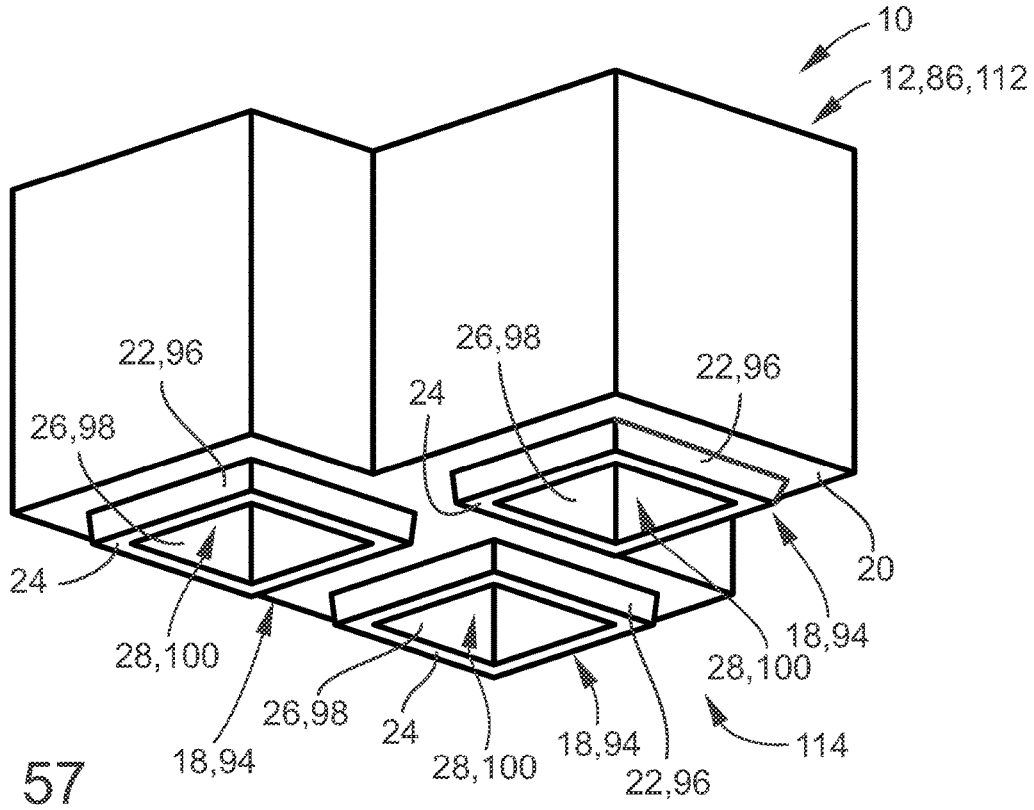
FIG. 57 is a bottom perspective view of the square T-block of FIG. 56.

Referring now specifically to FIGS. 56-58, in select embodiments of interlocking blocking system 10, and/or retaining wall 34, plurality of square T-blocks 112 may be included. Each of the square T-blocks 112 may include three square tapered openings 92 in T-formation 114, three square protruding bottoms 94 in T-formation 114, and three square hollow tapered insides 100 in T-formation 114. The three square tapered openings 92 may be through top surface 16 of square T-block 112. The three square protruding bottoms 94 may extend beyond bottom surface 20 of square T-block 112. Each of the three square protruding bottoms 94 may include square tapered outer surface 96, thickness 24, and square inner tapered surface 98. Each of the three square hollow tapered insides 100 may extend from one of the square tapered openings 92 on top surface 16 and taper into one of the square inner tapered surfaces 98 of one of the square protruding bottoms 94. Each of the square tapered outer surfaces 96 of the three square protruding bottoms 94 may be shaped and sized to match and fit inside of one of the square tapered openings 92 at top surface 16 of square T-block 112.

Referring now to FIGS. 16-25, and 28-32, in select embodiments of the disclosed interlocking blocking system 10, and/or retaining wall 34, a plurality of rounded blocks 88 may be included. Rounded blocks 88 may be directed to interlocking blocks 12 that interlock via a round interface between top block 30 and bottom block 32. Thus, each of the rounded blocks 88 may include rounded tapered opening 116, rounded protruding bottom 118, and rounded hollow tapered inside 124. The rounded tapered opening 116 may be through top surface 16 of rounded block 88. Rounded protruding bottom 118 may extend beyond bottom surface 20 of rounded block 88. Rounded protruding bottom 118 may include rounded tapered outer surface 120, thickness 24, and rounded inner tapered surface 122. The rounded hollow tapered inside 124 may extend from rounded tapered opening 116 on top surface 16 and may taper into rounded inner tapered surface 122 of rounded protruding bottom 118. Rounded tapered outer surface 120 of rounded protruding bottom 118 may be shaped and sized to match and fit inside of rounded tapered opening 116 at top surface 16 of rounded block 88.

Referring now specifically to FIGS. 16-20, in select embodiments of interlocking blocking system 10 a plurality of rounded 1×1 blocks 126 may be included. Each of the rounded 1×1 blocks 126 may include rounded tapered opening 116, rounded protruding bottom 118, and rounded hollow tapered inside 124. Rounded tapered opening 116 may be through top surface 16 of rounded 1×1 block 126. Rounded protruding bottom 118 may extend beyond bottom surface 20 of rounded 1×1 block 126. Rounded protruding bottom 118 may include rounded tapered outer surface 120, thickness 24, and rounded inner tapered surface 122. Rounded hollow tapered inside 124 may extend from rounded tapered opening 116 on top surface 16 and may taper into rounded inner tapered surface 122 of rounded protruding bottom 118. Rounded tapered outer surface 120 of rounded protruding bottom 118 may be shaped and sized to match and fit inside of rounded tapered opening 116 at top surface 16 of rounded 1×1 block 126.

Referring now specifically to FIGS. 21-25, in select embodiments of interlocking blocking system 10, and/or retaining wall 34, plurality of rounded 2×1 blocks 128 may be included. Each of the rounded 2×1 blocks 128 may include two rounded tapered openings 116, two rounded protruding bottoms 118, and two rounded hollow tapered insides 124. The two rounded tapered openings 116 may be through top surface 16 of rounded 2×1 block 128. The two rounded protruding bottoms 118 may extend beyond bottom surface 20 of rounded 2×1 block 128. Each of the two rounded protruding bottoms 118 may include rounded tapered outer surface 120, thickness 24, and rounded inner tapered surface 122. Each of the two rounded hollow tapered insides 124 may extend from one of the rounded tapered openings 116 on top surface 16 and taper into one of the rounded inner tapered surfaces 122 of one of the rounded protruding bottoms 118. Each of the rounded tapered outer surfaces 120 of the two rounded protruding bottoms 118 may be shaped and sized to match and fit inside of one of the rounded tapered openings 116 at top surface 16 of rounded 2×1 block 128.

Referring now specifically to FIGS. 29-32, in select embodiments of interlocking blocking system 10, and/or retaining wall 34, plurality of rounded T-blocks 132 may be included. Each of the rounded T-blocks 132 may include three rounded tapered openings 116 in T-formation 114, three rounded protruding bottoms 118 in T-formation 114, and three rounded hollow tapered insides 124 in T-formation 114. The three rounded tapered openings 116 may be through top surface 16 of rounded T-block 132. The three rounded protruding bottoms 118 may extend beyond bottom surface 20 of rounded T-block 132. Each of the three rounded protruding bottoms 118 may include rounded tapered outer surface 120, thickness 24, and rounded inner tapered surface 122. Each of the three rounded hollow tapered insides 124 may extend from one of the rounded tapered openings 116 on top surface 16 and taper into one of the rounded inner tapered surfaces 122 of one of the rounded protruding bottoms 118. Each of the rounded tapered outer surfaces 120 of the three rounded protruding bottoms 118 may be shaped and sized to match and fit inside of one of the rounded tapered openings 116 at top surface 16 of rounded T-block 132.

Referring now specifically to FIGS. 11-15, in select embodiments of interlocking blocking system 10, and/or retaining wall 34, a plurality of adaptor blocks 90 may be included. Each of the adaptor blocks 90 may include square tapered opening 92, rounded tapered opening 116, square protruding bottom 94, rounded protruding bottom 118, square rounded hollow tapered inside 124, and rounded hollow tapered inside 124. Square tapered opening 92 may be through top surface 16 of adaptor block 90. Rounded tapered opening 116 may be through top surface 16 of adaptor block 90. Square protruding bottom 94 may extend beyond bottom surface 20 of adaptor block 90. Square protruding bottom 94 may include square tapered outer surface 96, thickness 24, and square inner tapered surface 98. Rounded protruding bottom 118 may extend beyond bottom surface 20 of adaptor block 90. Rounded protruding bottom 118 may include rounded tapered outer surface 120, thickness 24, and rounded inner tapered surface 122. Square hollow tapered inside 100 may extend from square tapered opening 92 on top surface 16 and may taper into square inner tapered surface 98 of square protruding bottom 94, where square tapered outer surface 96 of square protruding bottom 94 is shaped and sized to match and fit inside of square tapered opening 92 at top surface 16 of adaptor block 90. Rounded hollow tapered inside 124 may extend from rounded tapered opening 116 on top surface 16 and may taper into rounded inner tapered surface 122 of rounded protruding bottom 118, where rounded tapered outer surface 120 of rounded protruding bottom 118 is shaped and sized to match and fit inside of rounded tapered opening 116 at top surface 16 of adaptor block 90.

One feature of interlocking blocking system 10, and/or retaining wall 34, may be that the included rounded blocks 88 and/or adaptor blocks 90 can be configured for non-right angles and radiuses. As such, rounded blocks 88 and/or adaptor blocks 90 may be configured to allow blocks 12 to be positioned together at various angles without the need to cut or manipulate any blocks 12.

In sum, interlocking blocking system 10, and/or retaining wall 34, may be provided and configured with: blocks 12 that interlock with one another without mortar using matching tapers; open sections of block make forms for additional concrete of other material; center non tapered section allows for easy handling and tying of structure together without mortar; adaptor and double round blocks allow for non-right angles and radiuses; interchangeable mold parts allow for texture or patterning of visible block faces; and/or optional grooves allow for the creation of a sealed wall using expanding foam or similar material A feature of the disclosed interlocking blocking system 10, and/or retaining wall 34, may be its ability to use a minimal amount of concrete to reduce manufacture cost, weight, and shipping costs.

Another feature of the disclosed interlocking blocking system 10, and/or retaining wall 34, may be that it can be configured with the ability to tie the structure together without the use of mortar reducing the time and skill level necessary to install.

Another feature of the disclosed interlocking blocking system 10, and/or retaining wall 34, may be its ability to use cavities as a form for additional reinforcement and and/or concrete once the structure is in place.

Another feature of the disclosed interlocking blocking system 10, and/or retaining wall 34, may be its ability to easily be handled by light equipment since a significant portion of the block is a hole.

Another advantage of the disclosed interlocking blocking system 10, and/or retaining wall 34, may be the modular design allows for multiple configurations with a minimum number of different pieces.

Another advantage of the disclosed interlocking blocking system 10, and/or retaining wall 34, may be that different facing appearances can be achieved by changing out any of the outside panels of the mold.

Another advantage of the disclosed interlocking blocking system 10, and/or retaining wall 34, may be the ability to build either structures that allow water to flow thru them or ones that are a barrier to water.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. An interlocking blocking system comprising:

a plurality of interlocking blocks, each of the interlocking blocks including:

a tapered opening through a top surface of the interlocking block;

a protruding bottom that extends beyond a bottom surface of the interlocking block, the protruding bottom including a tapered outer surface, a thickness, and an inner tapered surface; and a hollow tapered inside, the hollow tapered inside extends from the tapered opening on the top surface and tapers into the inner tapered surface of the protruding bottom;

the tapered outer surface of the protruding bottom is shaped and sized to match and fit inside of the tapered opening at the top surface of the interlocking block;

a first indentation, the first indentation is on a first side of the hollow tapered inside extending down from the tapered opening at the top surface with a first left side, a first right side, and a first bottom, the first indentation is sized to receive a first end of a second bracket between the first left side and the first right side onto the first bottom, thereby centering the second bracket on the first side of the hollow tapered inside;

a second indentation, the second indentation is on a second side of the hollow tapered inside extending down from the tapered opening at the top surface with a second left side, a second right side, and a second bottom, the second indentation is sized to receive a second end of the second bracket between the second left side and the second right side onto the second bottom, thereby centering the second bracket on the second side of the hollow tapered inside;

wherein, the tapered opening, the protruding bottom and the hollowed tapered inside of each of the interlocking blocks is integrally formed;

wherein the plurality of interlocking blocks including a plurality of rounded blocks, each of the rounded blocks including:

a rounded tapered opening through the top surface of the rounded block;

a rounded protruding bottom that extends beyond the bottom surface of the rounded block, the rounded protruding bottom including a rounded tapered outer surface, the thickness, and a rounded inner tapered surface; and a rounded hollow tapered inside, the rounded hollow tapered inside extends from the rounded tapered opening on the top surface and tapers into the rounded inner tapered surface of the rounded protruding bottom;

the rounded tapered outer surface of the rounded protruding bottom is shaped and sized to match and fit inside of the rounded tapered opening at the top surface of the rounded block;

wherein, the rounded blocks including a rounded outer radius configured for non-right angles and radiuses without the need to cut any of the blocks.

2. The interlocking blocking system of claim 1, wherein the plurality of interlocking blocks are configured to be stacked onto one another, where the protruding bottom of a top block is inserted into the tapered opening of a bottom block, whereby the top block is interlocked to the bottom block.

3. The interlocking blocking system of claim 1, wherein the interlocking blocking system is configured for a retaining wall, wherein:

the plurality of interlocking blocks interlock without mortar using their matching tapers thereby reducing a time and skill level necessary to install the retaining wall;

the hollow tapered inside of each of the interlocking blocks are configured as forms for additional concrete of other material;

the hollow tapered inside of each of the interlocking blocks is configured to allow for handling and tying of structure together without mortar;

the interlocking blocking system is configured with a minimal amount of concrete to reduce manufacture cost, weight, and shipping costs;

the interlocking blocking system is configured with the ability to easily be handled by equipment since a significant portion of each of the interlocking blocks is the hollow tapered inside;

the interlocking blocking system is configured with a modular design that is configured to allow for multiple configurations with a minimum number of different pieces;

the interlocking blocking system is configured with the ability to build either structures that allow water to flow thru them or ones that are a barrier to water;

the disclosed interlocking blocking system is configured to use the hollow tapered inside of each interlocking block as a form for additional reinforcement or for adding concrete once the structure is in place;

or combinations thereof.

4. The interlocking blocking system of claim 1 further comprising a cap, the cap is configured to interlock and cover the top surface of one of the interlocking blocks, the cap including:

a flat top face; and a bottom face comprising a tapered protrusion, the tapered protrusion is shaped and sized to match and fit inside of the tapered opening at the top surface of one of the interlocking blocks.

5. The interlocking blocking system of claim 1, wherein each of the plurality of interlocking blocks including decorative face inserts on at least a front side, a left side, a right side, or a combination thereof, the decorative face inserts are configured to provide for texture or patterning of any visible block faces.

6. The interlocking blocking system of claim 1 further comprising a sealing system, wherein, the sealing system including:

a front groove around a periphery of each of the interlocking blocks approximate a front;

a back groove around the periphery of each of the interlocking blocks approximate a back;

or combinations thereof; and an expanding material inserted into the front groove, the back groove, or the combinations thereof, the expanding material is configured for sealing the plurality of interlocking blocks with one another via the front groove, the back groove, or the combinations thereof.

7. The interlocking blocking system of claim 6, wherein the expanding material is an expanding foam.

8. The interlocking blocking system of claim 1 further comprising a tie down system configured for securely tying down a top block to a bottom block.

9. The interlocking blocking system of claim 8, wherein the tie down system including:

a tie down rod extending from a first bracket positioned below the bottom surface of the bottom block through the tapered hollow interior of the bottom block up the tapered hollow interior of the top block to the second bracket positioned in between the first indentation and the second indentation, the tie down rod is configured to be tightened thereby putting tension between the top block and the bottom block.

10. The interlocking blocking system of claim 1, wherein the plurality of rounded blocks including:

a plurality of rounded 1×1 blocks, each of the rounded 1×1 blocks including:

the rounded tapered opening through the top surface of the rounded 1×1 block;

the rounded protruding bottom that extends beyond the bottom surface of the rounded 1×1 block, the rounded protruding bottom including the rounded tapered outer surface, the thickness, and the rounded inner tapered surface; and the rounded hollow tapered inside, the rounded hollow tapered inside extends from the rounded tapered opening on the top surface and tapers into the rounded inner tapered surface of the rounded protruding bottom;

the rounded tapered outer surface of the rounded protruding bottom is shaped and sized to match and fit inside of the rounded tapered opening at the top surface of the rounded 1×1 block;

a plurality of rounded 2×1 blocks, each of the rounded 2×1 blocks including:

two of the rounded tapered opening through the top surface of the rounded 2×1 block;

two of the rounded protruding bottoms that extend beyond the bottom surface of the rounded 2×1 block, each of the two rounded protruding bottoms including the rounded tapered outer surface, the thickness, and the rounded inner tapered surface; and two of the rounded hollow tapered insides, each of the two rounded hollow tapered insides extend from one of the rounded tapered openings on the top surface and taper into one of the rounded inner tapered surfaces of one of the rounded protruding bottoms;

each of the rounded tapered outer surfaces of the two rounded protruding bottoms is shaped and sized to match and fit inside of one of the rounded tapered openings at the top surface of the rounded 2×1 block;

a 2×1 rounded cap, the 2×1 rounded cap is configured to interlock and cover the top surface of one of the rounded 2×1 blocks, the 2×1 rounded cap including:

a flat top face; and a bottom face comprising two rounded tapered protrusions, each of the rounded tapered protrusions are shaped and sized to match and fit inside of one of the rounded tapered openings at the top surface of one of the rounded 2×1 blocks;

a plurality of rounded T-blocks, each of the rounded T-blocks including:

three of the rounded tapered opening through the top surface of the rounded 2×1 block in a T-formation;

three of the rounded protruding bottoms that extend beyond the bottom surface of the rounded 2×1 block in the T-formation, each of the three rounded protruding bottoms including the rounded tapered outer surface, the thickness, and the rounded inner tapered surface; and three of the rounded hollow tapered insides in the T-formation, each of the three rounded hollow tapered insides extend from one of the rounded tapered openings on the top surface and taper into one of the rounded inner tapered surfaces of one of the rounded protruding bottoms;

each of the rounded tapered outer surfaces of the three rounded protruding bottoms is shaped and sized to match and fit inside of one of the rounded tapered openings at the top surface of the rounded T-block; and a rounded T-cap, the rounded T-cap is configured to interlock and cover the top surface of one of the rounded T-blocks, the rounded T-cap including:

a flat top face; and a bottom face comprising three of the rounded tapered protrusions in the T-formation, each of the rounded tapered protrusions are shaped and sized to match and fit inside of one of the rounded tapered openings at the top surface of one of the rounded T-blocks.

11. A retaining wall comprising:

an interlocking blocking system comprising:

a plurality of interlocking blocks, each of the interlocking blocks including:

a tapered opening through a top surface of the interlocking block;

a protruding bottom that extends beyond a bottom surface of the interlocking block, the protruding bottom including a tapered outer surface, a thickness, and an inner tapered surface; and a hollow tapered inside, the hollow tapered inside extends from the tapered opening on the top surface and tapers into the inner tapered surface of the protruding bottom;

the tapered outer surface of the protruding bottom is shaped and sized to match and fit inside of the tapered opening at the top surface of the interlocking block;

a first indentation, the first indentation is on a first side of the hollow tapered inside extending down from the tapered opening at the top surface with a first left side, a first right side, and a first bottom, the first indentation is sized to receive a first end of a second bracket between the first left side and the first right side onto the first bottom, thereby centering the second bracket on the first side of the hollow tapered inside;

a second indentation, the second indentation is on a second side of the hollow tapered inside extending down from the tapered opening at the top surface with a second left side, a second right side, and a second bottom, the second indentation is sized to receive a second end of the second bracket between the second left side and the second right side onto the second bottom, thereby centering the second bracket on the second side of the hollow tapered inside;

wherein, the tapered opening, the protruding bottom and the hollowed tapered inside of each of the interlocking blocks is integrally formed;

wherein the plurality of interlocking blocks including a plurality of rounded blocks, each of the rounded blocks including:

a rounded tapered opening through the top surface of the rounded block;

a rounded protruding bottom that extends beyond the bottom surface of the rounded block, the rounded protruding bottom including a rounded tapered outer surface, the thickness, and a rounded inner tapered surface; and a rounded hollow tapered inside, the rounded hollow tapered inside extends from the rounded tapered opening on the top surface and tapers into the rounded inner tapered surface of the rounded protruding bottom;

the rounded tapered outer surface of the rounded protruding bottom is shaped and sized to match and fit inside of the rounded tapered opening at the top surface of the rounded block;

wherein, the rounded blocks including a rounded outer radius configured for non-right angles and radiuses without the need to cut any of the blocks.

12. The retaining wall of claim 11, wherein the plurality of interlocking blocks are configured to be stacked onto one another, where the protruding bottom of a top block is inserted into the tapered opening of a bottom block, whereby the top block is interlocked to the bottom block.

13. The retaining wall of claim 11, wherein:

the interlocking blocks interlock without mortar using their matching tapers thereby reducing a time and skill level necessary to install;

the hollow tapered inside of each of the interlocking blocks are configured as forms for additional concrete of other material;

the hollow tapered inside of each of the interlocking blocks is configured to allow for handling and tying of structure together without mortar;

the interlocking blocking system is configured with a minimal amount of concrete to reduce manufacture cost, weight, and shipping costs;

the interlocking blocking system is configured with the ability to easily be handled by equipment since a significant portion of each of the interlocking blocks is the hollow tapered inside;

the interlocking blocking system is configured with a modular design that is configured to allow for multiple configurations with a minimum number of different pieces;

the interlocking blocking system is configured with the ability to build either structures that allow water to flow thru them or ones that are a barrier to water;

the disclosed interlocking blocking system is configured to use the hollow tapered inside of each interlocking block as a form for additional reinforcement or for adding concrete once the structure is in place;

or combinations thereof.

14. The retaining wall of claim 11 further comprising:

a cap, the cap is configured to interlock and cover the top surface of one of the interlocking blocks, the cap including:

a flat top face; and a bottom face comprising a tapered protrusion, the tapered protrusion is shaped and sized to match and fit inside of the tapered opening at the top surface of one of the interlocking blocks;

each of the plurality of interlocking blocks including decorative face inserts on at least a front side, a left side, a right side, or a combination thereof, the decorative face inserts are configured to provide for texture or patterning of any visible block faces.

15. The retaining wall of claim 11 further comprising a sealing system configured for creating a sealed wall, the sealing system including:

a front groove around a periphery of each of the interlocking blocks approximate a front;

a back groove around the periphery of each of the interlocking blocks approximate a back;

or combinations thereof;

wherein the sealing system further comprising an expanding material inserted into the front groove, the back groove, or the combinations thereof, the expanding material is configured for sealing the plurality of interlocking blocks with one another via the front groove, the back groove, or the combinations thereof.

16. The retaining wall of claim 15, wherein the expanding material is an expanding foam.

17. The retaining wall of claim 11 further comprising a tie down system configured for securely tying down a top block to a bottom block, wherein the tie down system including:

a tie down rod extending from a first bracket positioned below the bottom surface of the bottom block through the tapered hollow interior of the bottom block up the tapered hollow interior of the top block to the second bracket positioned in between the first indentation and the second indentation, the tie down rod is configured to be tightened thereby putting tension between the top block and the bottom block.

18. The retaining wall of claim 11, wherein the plurality of interlocking blocks including a plurality of square blocks, a plurality of rounded blocks, a plurality of adaptor blocks, or a combination thereof.

19. An interlocking blocking system comprising:

a plurality of interlocking blocks, each of the interlocking blocks including:

a tapered opening through a top surface of the interlocking block;

a protruding bottom that extends beyond a bottom surface of the interlocking block, the protruding bottom including a tapered outer surface, a thickness, and an inner tapered surface; and a hollow tapered inside, the hollow tapered inside extends from the tapered opening on the top surface and tapers into the inner tapered surface of the protruding bottom;

the tapered outer surface of the protruding bottom is shaped and sized to match and fit inside of the tapered opening at the top surface of the interlocking block;

wherein the plurality of interlocking blocks including a plurality of square blocks, a plurality of rounded blocks, a plurality of adaptor blocks, or a combination thereof;

wherein, each of the square blocks including:

a square tapered opening through the top surface of the square block;

a square protruding bottom that extends beyond the bottom surface of the square block, the square protruding bottom including a square tapered outer surface, the thickness, and a square inner tapered surface; and a square hollow tapered inside, the square hollow tapered inside extends from the square tapered opening on the top surface and tapers into the square inner tapered surface of the square protruding bottom;

the square tapered outer surface of the square protruding bottom is shaped and sized to match and fit inside of the square tapered opening at the top surface of the square block;

each of the rounded blocks including:

a rounded tapered opening through the top surface of the rounded block;

a rounded protruding bottom that extends beyond the bottom surface of the rounded block, the rounded protruding bottom including a rounded tapered outer surface, the thickness, and a rounded inner tapered surface; and a rounded hollow tapered inside, the rounded hollow tapered inside extends from the rounded tapered opening on the top surface and tapers into the rounded inner tapered surface of the rounded protruding bottom;

the rounded tapered outer surface of the rounded protruding bottom is shaped and sized to match and fit inside of the rounded tapered opening at the top surface of the rounded block; and each of the adaptor blocks including:

the square tapered opening through the top surface of the adaptor block;

the rounded tapered opening through the top surface of the adaptor block;

the square protruding bottom that extends beyond the bottom surface of the adaptor block, the square protruding bottom including the square tapered outer surface, the thickness, and the square inner tapered surface;

the rounded protruding bottom that extends beyond the bottom surface of the adaptor block, the rounded protruding bottom including the rounded tapered outer surface, the thickness, and the rounded inner tapered surface;

the square hollow tapered inside, the square hollow tapered inside extends from the square tapered opening on the top surface and tapers into the square inner tapered surface of the square protruding bottom, where the square tapered outer surface of the square protruding bottom is shaped and sized to match and fit inside of the square tapered opening at the top surface of the adaptor block; and the rounded hollow tapered inside, the rounded hollow tapered inside extends from the rounded tapered opening on the top surface and tapers into the rounded inner tapered surface of the rounded protruding bottom, where the rounded tapered outer surface of the rounded protruding bottom is shaped and sized to match and fit inside of the rounded tapered opening at the top surface of the adaptor block;

wherein, the rounded blocks and the adaptor blocks are configured for non-right angles and radiuses without the need to cut any of the blocks wherein the plurality of interlocking blocks including:

a plurality of square 1×1 blocks, each of the square 1×1 blocks including:

a square tapered opening through the top surface of the square 1×1 block;

a square protruding bottom that extends beyond the bottom surface of the square 1×1 block, the square protruding bottom including a square tapered outer surface, the thickness, and a square inner tapered surface; and a square hollow tapered inside, the square hollow tapered inside extends from the square tapered opening on the top surface and tapers into the square inner tapered surface of the square protruding bottom;

the square tapered outer surface of the square protruding bottom is shaped and sized to match and fit inside of the square tapered opening at the top surface of the square 1×1 block;

a plurality of square 2×1 blocks, each of the square 2×1 blocks including:

two square tapered opening through the top surface of the square 2×1 block;

two square protruding bottoms that extend beyond the bottom surface of the square 2×1 block, each of the two square protruding bottoms including a square tapered outer surface, the thickness, and a square inner tapered surface; and two square hollow tapered insides, each of the two square hollow tapered insides extend from one of the square tapered openings on the top surface and taper into one of the square inner tapered surfaces of one of the square protruding bottoms;

each of the square tapered outer surfaces of the two square protruding bottoms is shaped and sized to match and fit inside of one of the square tapered openings at the top surface of the square 2×1 block;

a plurality of square 2×2 blocks, each of the square 2×2 blocks including:

four square tapered opening through the top surface of the square 2×2 block;

four square protruding bottoms that extend beyond the bottom surface of the square 2×2 block, each of the two square protruding bottoms including a square tapered outer surface, the thickness, and a square inner tapered surface; and four square hollow tapered insides, each of the two square hollow tapered insides extend from one of the square tapered openings on the top surface and taper into one of the square inner tapered surfaces of one of the square protruding bottoms;

each of the square tapered outer surfaces of the four square protruding bottoms is shaped and sized to match and fit inside of one of the square tapered openings at the top surface of the square 2×2 block;

a plurality of square L-blocks, each of the square L-blocks including:

three square tapered opening through the top surface of the square L-block in an L-formation;

three square protruding bottoms in the L-formation that extend beyond the bottom surface of the square L-block, each of the three square protruding bottoms including a square tapered outer surface, the thickness, and a square inner tapered surface; and three square hollow tapered insides in the L-formation, each of the three square hollow tapered insides extend from one of the square tapered openings on the top surface and taper into one of the square inner tapered surfaces of one of the square protruding bottoms;

each of the square tapered outer surfaces of the three square protruding bottoms is shaped and sized to match and fit inside of one of the square tapered openings at the top surface of the square L-block;

a plurality of square T-blocks, each of the square T-blocks including:

three square tapered opening through the top surface of the square T-block in a T-formation;

three square protruding bottoms in the T-formation that extend beyond the bottom surface of the square T-block, each of the three square protruding bottoms including a square tapered outer surface, the thickness, and a square inner tapered surface; and three square hollow tapered insides in the T-formation, each of the three square hollow tapered insides extend from one of the square tapered openings on the top surface and taper into one of the square inner tapered surfaces of one of the square protruding bottoms;

each of the square tapered outer surfaces of the three square protruding bottoms is shaped and sized to match and fit inside of one of the square tapered openings at the top surface of the square T-block;

a plurality of rounded 1×1 blocks, each of the rounded 1×1 blocks including:

the rounded tapered opening through the top surface of the rounded 1×1 block;

the rounded protruding bottom that extends beyond the bottom surface of the rounded 1×1 block, the rounded protruding bottom including the rounded tapered outer surface, the thickness, and the rounded inner tapered surface; and the rounded hollow tapered inside, the rounded hollow tapered inside extends from the rounded tapered opening on the top surface and tapers into the rounded inner tapered surface of the rounded protruding bottom;

the rounded tapered outer surface of the rounded protruding bottom is shaped and sized to match and fit inside of the rounded tapered opening at the top surface of the rounded 1×1 block;

a plurality of rounded 2×1 blocks, each of the rounded 2×1 blocks including:

two of the rounded tapered opening through the top surface of the rounded 2×1 block;

two of the rounded protruding bottoms that extend beyond the bottom surface of the rounded 2×1 block, each of the two rounded protruding bottoms including the rounded tapered outer surface, the thickness, and the rounded inner tapered surface; and two of the rounded hollow tapered insides, each of the two rounded hollow tapered insides extend from one of the rounded tapered openings on the top surface and taper into one of the rounded inner tapered surfaces of one of the rounded protruding bottoms;

each of the rounded tapered outer surfaces of the two rounded protruding bottoms is shaped and sized to match and fit inside of one of the rounded tapered openings at the top surface of the rounded 2×1 block;

a 2×1 rounded cap, the 2×1 rounded cap is configured to interlock and cover the top surface of one of the rounded 2×1 blocks, the 2×1 rounded cap including:

a flat top face; and a bottom face comprising two rounded tapered protrusions, each of the rounded tapered protrusions are shaped and sized to match and fit inside of one of the rounded tapered openings at the top surface of one of the rounded 2×1 blocks;

a plurality of rounded T-blocks, each of the rounded T-blocks including:

three of the rounded tapered opening through the top surface of the rounded 2×1 block in a T-formation;

three of the rounded protruding bottoms that extend beyond the bottom surface of the rounded 2×1 block in the T-formation, each of the three rounded protruding bottoms including the rounded tapered outer surface, the thickness, and the rounded inner tapered surface; and three of the rounded hollow tapered insides in the T-formation, each of the three rounded hollow tapered insides extend from one of the rounded tapered openings on the top surface and taper into one of the rounded inner tapered surfaces of one of the rounded protruding bottoms;

each of the rounded tapered outer surfaces of the three rounded protruding bottoms is shaped and sized to match and fit inside of one of the rounded tapered openings at the top surface of the rounded T-block; and a rounded T-cap, the rounded T-cap is configured to interlock and cover the top surface of one of the rounded T-blocks, the rounded T-cap including:

a flat top face; and a bottom face comprising three of the rounded tapered protrusions in the T-formation, each of the rounded tapered protrusions are shaped and sized to match and fit inside of one of the rounded tapered openings at the top surface of one of the rounded T-blocks.

* * * * *